US008027604B2

(12) United States Patent
Matsuzaki

(10) Patent No.: US 8,027,604 B2
(45) Date of Patent: Sep. 27, 2011

(54) IMAGE FORMING APPARATUS HAVING A VOLTAGE CHANGE DETERMINER

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 588 days.

(21) Appl. No.: 12/169,666

(22) Filed: Jul. 9, 2008

(65) Prior Publication Data

US 2009/0016758 A1 Jan. 15, 2009

(30) Foreign Application Priority Data

Jul. 10, 2007 (JP) ..... 2007-180562
Jun. 11, 2008 (JP) ..... 2008-153521

(51) Int. Cl.
*G03G 15/06* (2006.01)

(52) U.S. Cl. ..... 399/55

(58) Field of Classification Search ..... 399/55, 399/53, 285

See application file for complete search history.

(56) References Cited

U.S. PATENT DOCUMENTS 7,035,561 B2 * 4/2006 Onishi ..... 399/55

FOREIGN PATENT DOCUMENTS

JP 2003323012 A 11/2003
JP 2004-029681 1/2004
JP 2005017631 A 1/2005

OTHER PUBLICATIONS

Machine translation of Onishi (JP 2004-029,681, Listed in IDS) Pub date Jan. 29, 2004.*

* cited by examiner

*Primary Examiner* — David Gray
*Assistant Examiner* — Rodney Bonnette
(74) *Attorney, Agent, or Firm* — Panitch Schwarze Belisario & Nadel LLP

(57) ABSTRACT

An image forming apparatus includes data conversion, charging, exposure, developer supply, image density calculation, determination and voltage change mechanisms. The data conversion mechanism converts image data into printing data. The charging mechanism charges an image carrier. The exposure mechanism forms an electrostatic latent image on the image carrier based on the printing data. The developer supply mechanism supplies a developer to the image carrier having the electrostatic latent image with an electrostatic force. The image density calculation mechanism calculates an image density of an image having a predetermined number of lines in the printing data. The determination mechanism determines whether a voltage to be applied to the developer supply mechanism is changed based on a calculation result by the image density calculation mechanism. The voltage change mechanism changes the voltage to be applied to the developer supply mechanism based on a determination result by the determination mechanism.

12 Claims, 47 Drawing Sheets

FIG. 5

| CONDITION 1 | CONDITION 2 | DB |
|---|---|---|
| $D_{n+p} < 80$ | (NONE) | -200V |
| $D_{n+p} \geqq 80$ | $D_{(n+1)+p} < 80$ | -200V |
| $D_{n+p} \geqq 80$ | $D_{(n+1)+p} \geqq 80$ | -250V |

FIG. 9

| CONDITION 1 | CONDITION 2 | DB | SB |
|---|---|---|---|
| $D_{n+p} < 80$ | (NONE) | -200V | -350V |
| $D_{n+p} \geqq 80$ | $D_{(n+1)+p} < 80$ | -200V | -350V |
| $D_{n+p} \geqq 80$ | $D_{(n+1)+p} \geqq 80$ | -200V | -400V |

FIG. 12

| CONDITION 1 | CONDITION 2 | DB | SB | DS |
|---|---|---|---|---|
| $D_{n+p} < 80$ | (NONE) | -200V | -350V | 150V |
| $D_{n+p} \geqq 80$ | $D_{(n+1)+p} < 80$ | -200V | -350V | 150V |
| $D_{n+p} \geqq 80$ | $D_{(n+1)+p} \geqq 80$ | -250V | -450V | 200V |

FIG. 15

| CONDITION 1 | CONDITION 2 | DB | SB | DS |
|---|---|---|---|---|
| $D_{n+p} < 80$ | (NONE) | -200V | -350V | 150V |
| $D_{n+p} \geqq 80$ | $D_{(n+1)+p} < 80$ | -200V | -350V | 150V |
| $D_{n+p} \geqq 80$ | $D_{(n+1)+p} \geqq 80$ | -175V | -425V | 250V |

FIG. 17

| | | CONTROL | PRINTING DENSITY | |
|---|---|---|---|---|
| | | | LEADING END | TAILING END |
| 1ST EMBODIMENT | EXAMPLE 1-1 | YES | 1.41 | 1.38 |
| | COMP.EX.111 | NO | 1.40 | 1.10 |
| 2ND EMBODIMENT | EXAMPLE 2-1 | YES | 1.39 | 1.40 |
| | COMP.EX.222 | NO | 1.39 | 1.09 |
| 3RD EMBODIMENT | EXAMPLE 3-1 | YES | 1.42 | 1.41 |
| | COMP.EX.333 | NO | 1.40 | 1.12 |
| 4TH EMBODIMENT | EXAMPLE 4-1 | YES | 1.38 | 1.39 |
| | COMP.EX.444 | NO | 1.40 | 1.11 |

FIG. 19

| CONDITION 1 | CONDITION 2 | CONDITION 3 | DB |
|---|---|---|---|
| $D_x < 80$ | (NONE) | (NONE) | −200V |
| $D_x \geqq 80$ | $D_{x+1} < 80$ | (NONE) | −200V |
| $D_x \geqq 80$ | $D_{x+1} \geqq 80$ | $v < p$ | −200V |
| $D_x \geqq 80$ | $D_{x+1} \geqq 80$ | $v \geqq p$ | −250V |

FIG. 23

| CONDITION 1 | CONDITION 2 | CONDITION 3 | SB |
|---|---|---|---|
| $D_x < 80$ | (NONE) | (NONE) | −350V |
| $D_x \geqq 80$ | $D_{x+1} < 80$ | (NONE) | −350V |
| $D_x \geqq 80$ | $D_{x+1} \geqq 80$ | $v < p$ | −350V |
| $D_x \geqq 80$ | $D_{x+1} \geqq 80$ | $v \geqq p$ | −400V |

FIG. 26

| CONDITION 1 | CONDITION 2 | CONDITION 3 | DB | SB | DS |
|---|---|---|---|---|---|
| $D_x < 80$ | (NONE) | (NONE) | -200V | -350V | 150V |
| $D_x \geqq 80$ | $D_{x+1} < 80$ | (NONE) | -200V | -350V | 150V |
| $D_x \geqq 80$ | $D_{x+1} \geqq 80$ | $v < p$ | -200V | -350V | 150V |
| $D_x \geqq 80$ | $D_{x+1} \geqq 80$ | $v \geqq p$ | -250V | -450V | 200V |

FIG. 29

| CONDITION 1 | CONDITION 2 | CONDITION 3 | DB | SB | DS |
|---|---|---|---|---|---|
| $D_x < 80$ | (NONE) | (NONE) | -200V | -350V | 150V |
| $D_x \geqq 80$ | $D_{x+1} < 80$ | (NONE) | -200V | -350V | 150V |
| $D_x \geqq 80$ | $D_{x+1} \geqq 80$ | $v < p$ | -200V | -350V | 150V |
| $D_x \geqq 80$ | $D_{x+1} \geqq 80$ | $v \geqq p$ | -175V | -425V | 250V |

FIG. 31

| | | CONTROL | PRINTING DENSITY | |
|---|---|---|---|---|
| | | | LEADING END | TAILING END |
| 5TH EMBODIMENT | EXAMPLE 5-1 | YES | 1.41 | 1.38 |
| | COMP.EX.555 | NO | 1.40 | 1.10 |
| 6TH EMBODIMENT | EXAMPLE 6-1 | YES | 1.39 | 1.40 |
| | COMP.EX.666 | NO | 1.39 | 1.09 |
| 7TH EMBODIMENT | EXAMPLE 7-1 | YES | 1.42 | 1.41 |
| | COMP.EX.777 | NO | 1.40 | 1.12 |
| 8TH EMBODIMENT | EXAMPLE 8-1 | YES | 1.38 | 1.39 |
| | COMP.EX.888 | NO | 1.40 | 1.11 |

IMAGE FORMING APPARATUS HAVING A VOLTAGE CHANGE DETERMINER

BACKGROUND OF THE INVENTION

1. Field of the Invention

The present invention relates to an image forming apparatus such as an electrophotographic printer.

2. Description of Related Art

A conventional image forming apparatus such as an electrophotographic printer generally executes a series of operations in image forming processes such as charging, exposing, developing, transferring and fixing.

According to the image forming processes, a photoconductive insulation layer on a surface of a photosensitive drum is uniformly charged in the charging process. Subsequently, the photoconductive insulation layer on the surface of the photosensitive drum is exposed, so that an electric charge on the exposed area is extinguished, thereby forming an electrostatic latent image thereon in the exposing process. In the development process, the electrostatic latent image is developed by adhesion of toner having a color agent thereto by using a development roller, a toner conveyance roller and the like. The toner image is transferred onto a transfer medium such as a recording sheet in the transfer process. The toner image on the transfer member is fixed by heat, pressure or an appropriate fixing manner in the fixing process.

Such an image forming apparatus of prior art needs to precisely control an amount of the toner to be adhered to the transfer medium so as to reproduce the image correctly. The toner amount is determined by controlling a process condition. For example, density of a patch pattern or the like formed on a sheet conveyance belt such as a transfer belt is frequently measured to control the process condition based on the measured data.

Japanese Un-examined Patent Application Publication No. 2004-029681 discloses a method of controlling a process condition that a printer controller changes a potential difference between an electric potential to be applied to a development roller serving as a developer carrier and an electric potential to be applied to a toner conveyance roller serving as a developer supply carrier based on a dot number per A4-sized sheet of image data before the development process.

However, such a prior art method of controlling the process condition causes a blurring image due to inadequate image density. For example, when an image with a high toner density such as an image density of 100 percent (e.g., solid image) is printed, an adequate toner amount is adhered to a leading end of the image on the recording sheet during the beginning of the printing. However, a supply shortage of the toner to the development roller occurs during the end of the printing to print a tailing end of the image. Consequently, the printed result cannot obtain an adequate image density, and there raises a problem that so called phenomenon of "blur" may occur. Since the printer controller determines the voltage to be applied to the development roller and the toner conveyance roller before the development process, the determined voltage cannot be changed during the development process, thereby causing the blurring image.

BRIEF SUMMARY OF THE INVENTION

According to at least one aspect of the present invention, an image forming apparatus includes a data conversion mechanism converting received image data into printing data, a charging mechanism charging an image carrier, an exposure mechanism forming an electrostatic latent image on the image carrier charged by the charging mechanism based on the printing data, a developer supply mechanism supplying a developer to the image carrier having the electrostatic latent image with electrostatic force, an image density calculation mechanism calculating an image density of an image having a predetermined number of lines in the printing data, a determination mechanism determining whether a voltage to be applied to the developer supply mechanism is changed based on a calculation result calculated by the image density calculation mechanism, and a voltage change mechanism changing the voltage to be applied to the developer supply mechanism based on a determination result determined by the determination mechanism.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein:

FIG. 5 is a table summarizing an output amount of the development bias voltage in each condition according to the first embodiment;

FIG. 9 is a table summarizing an output amount of the sponge bias voltage in each condition according to the second embodiment of the present invention;

FIG. 12 is a table summarizing output amounts of the development bias voltage, sponge bias voltage and absolute value in each condition according to the third embodiment of the present invention;

FIG. 15 is a table summarizing output amounts of the development bias voltage, sponge bias voltage and absolute value in each condition according to the fourth embodiment of the present invention;

FIG. 17 is a table illustrating print results according to the first, second, third and fourth embodiments of the present invention.

FIG. 19 is a table summarizing an output amount of the development bias voltage in each condition according to the fifth embodiment;

FIG. 23 is a table summarizing an output amount of the sponge bias voltage in each condition according to the sixth embodiment of the present invention;

FIG. 26 is a table summarizing output amounts of the development bias voltage, sponge bias voltage and absolute value in each condition according to the seventh embodiment of the present invention;

FIG. 29 is a table summarizing output amounts of the development bias voltage, sponge bias voltage and absolute value in each condition according to the eighth embodiment of the present invention;

FIG. 31 is a table illustrating print results according to the fifth, sixth, seventh and eighth embodiments of the present invention;

DETAILED DESCRIPTION OF PREFERRED EMBODIMENTS

Figure 1:
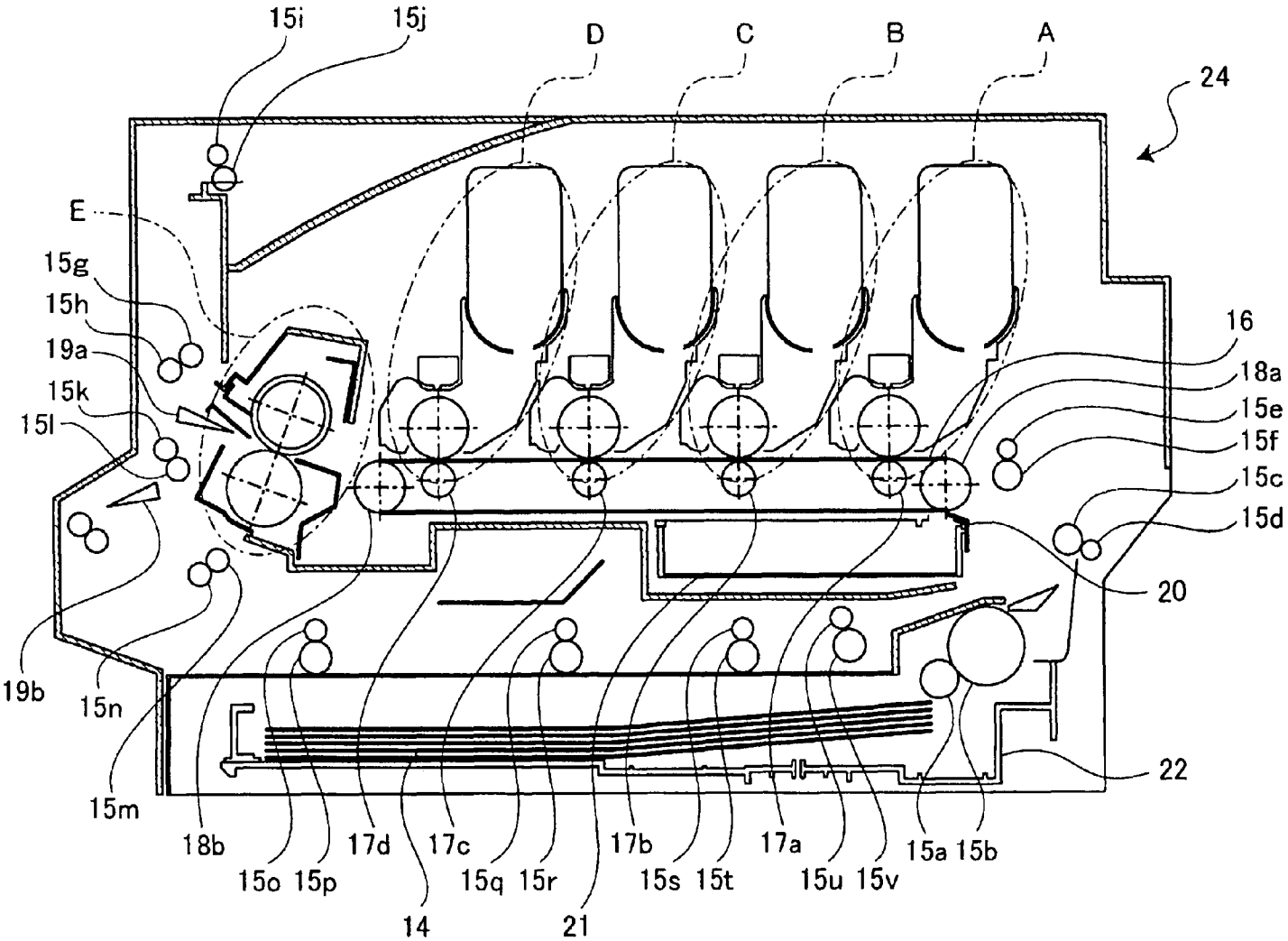
FIG. 1 is a schematic diagram illustrating an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

First Embodiment

Referring to FIG. 1, an image forming apparatus 24 according to a first embodiment of the present invention is illustrated. The image forming apparatus 24 includes development devices A, B, C and D, a recording sheet 14 as a printing medium, sheet conveyance rollers 15*a*, 15*b*, 15*c*, 15*d*, 15*e*, 15*f*, 15*g*, 15*h*, 15*i*, 15*j*, 15*k*, 15*l*, 15*m*, 15*n*, 15*o*, 15*p*, 15*q*, 15*r*, 15*s*, 15*t*, 15*u* and 15*v*, a transfer belt 16, transfer rollers 17*a*, 17*b*, 17*c* and 17*d*, drive rollers 18*a* and 18*b*, movable sheet traveling guides 19*a* and 19*b*, a belt cleaning blade 20, a disposal developer container 21, a sheet cassette 22 and a fixing device E.

The development devices A, B, C and D are substantially similar to one another except for the toner to be used. A description of the development devices A, B, C and D is given below with reference to FIG. 2 by using the development device A as representative of the development devices A, B, C and D.

Figure 2:
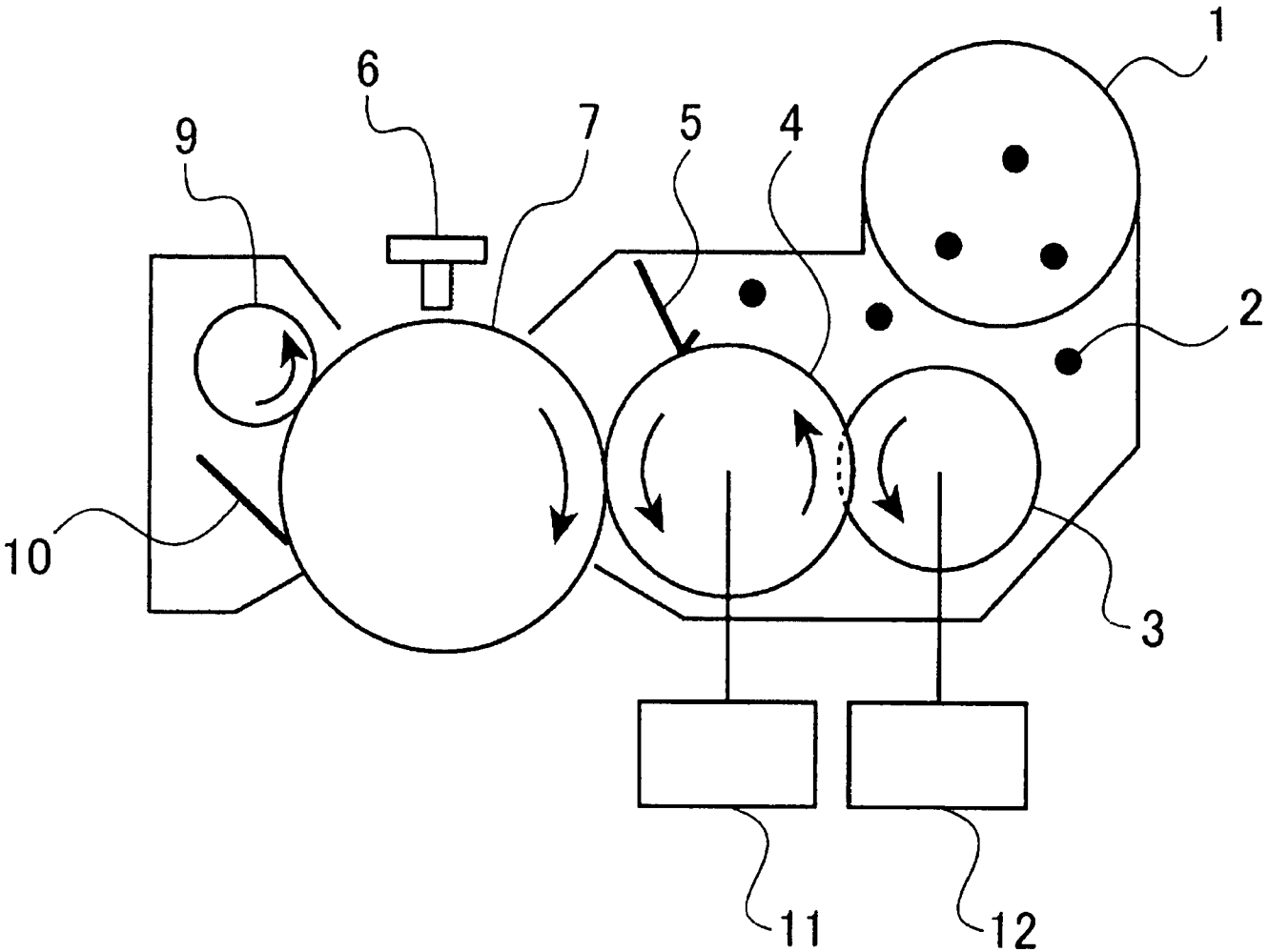
FIG. 2 is a schematic diagram illustrating a development device disposed in the image forming apparatus of FIG. 1.

Referring to FIG. 2, the development device A is enlarged and illustrated in a cross sectional view. The development device A includes a toner cartridge 1 serving as a developer supply mechanism, toner 2, a sponge roller 3 serving as a developer supplier, a development roller 4 serving as a developer carrier, a development blade 5, a light-emitting diode (LED) head 6 serving as an exposure mechanism, a photosensitive drum 7 serving as an image carrier, a charging roller 9, a cleaning blade 10, a development power source 11 applying a development bias voltage DB to the development roller 4, and a developer supply power source 12 applying a sponge bias voltage SB to the sponge roller 3. The development device A includes the developer supply mechanism including the developer supplier and the developer carrier.

Figure 3:
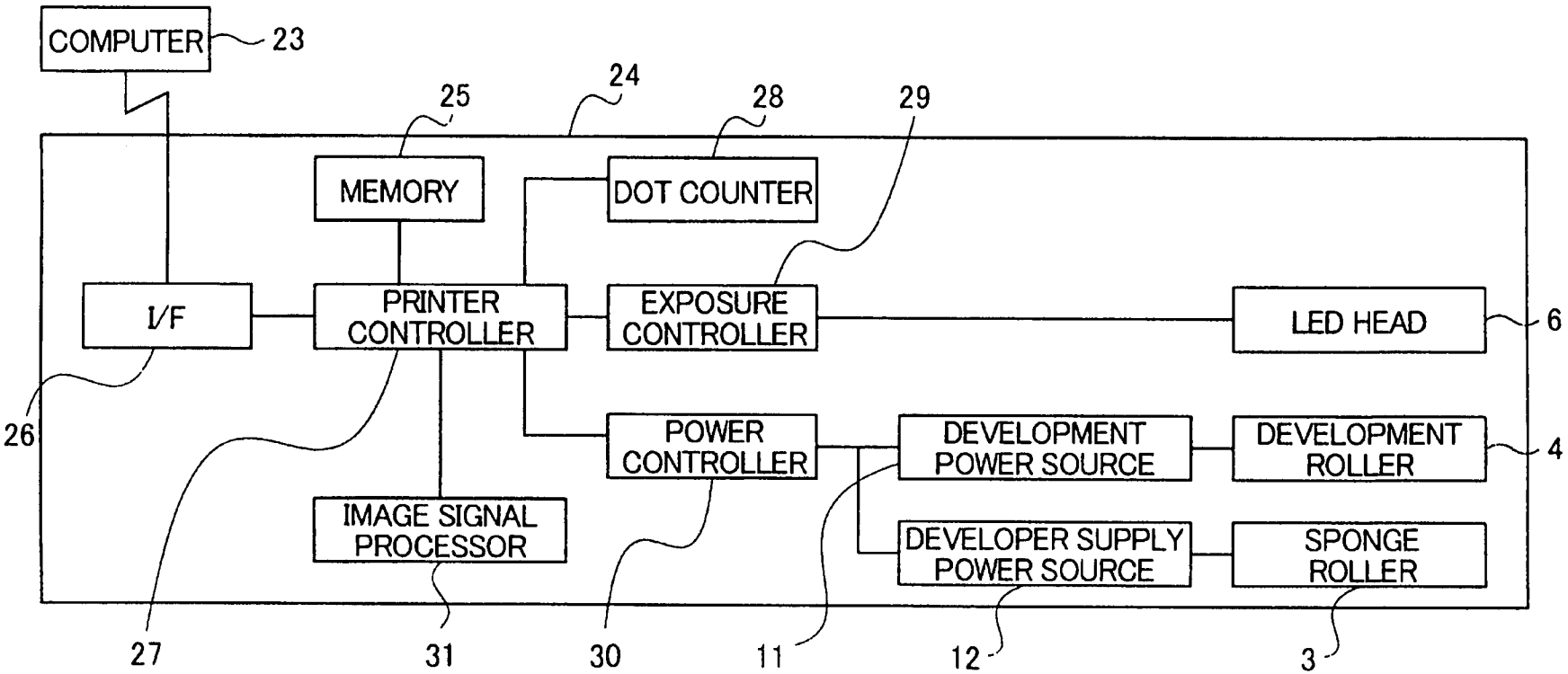
FIG. 3 is a block diagram illustrating the image forming apparatus of FIG. 1.

Referring to FIG. 3, the image forming apparatus 24 of the first embodiment is illustrated in a block diagram. The image forming apparatus 24 includes a memory 25 involving image data, an interface (I/F) 26 serving as a connection mechanism to connect to an external computer such as a personal computer 23, a printer controller 27, a dot counter 28, an exposure controller 29, a power controller 30, and an image signal processor 31. The image forming apparatus of 24 of FIG. 1 according to the first embodiment of the present invention is described in detail with FIGS. 2 and 3.

The photosensitive drum 7 rotates in a direction indicated by an arrow shown in FIG. 2, and forms an electrostatic latent image on a photoconductive insulation layer on a surface thereof. The photosensitive drum 7 includes an aluminum tube on which a photosensitive layer with an organic compound is formed, and has an external diameter of 29.95 mm.

The cleaning blade 10 removes remaining toner that remains on the photosensitive drum 7 without being transferred onto the recording sheet.

The charging roller 9 charges the photoconductive insulation layer on the surface of the photosensitive drum 7, and has a relatively high negative voltage being applied thereto.

The LED head 6 serving as the exposure mechanism includes a luminous element, for example, LED array. The LED head 6 emits the light that is controlled based on the exposure controller 29, thereby forming a line of the electrostatic latent image. In this regard, the electrostatic latent images are sequentially formed in response to the rotation of the photosensitive drum 7.

The image signal processor 31 serving as a data conversion mechanism converts image data into dot data referred to as printing data. The exposure controller 29 controls the LED head 6 based on the dot data converted by the image signal processor 31. The LED head 6 irradiates the surface of the photosensitive drum 7 with beams, so that the surface potential in the exposed area of the photosensitive drum 7 increases to zero voltage. Therefore, the photosensitive drum 7 forms the electrostatic latent image on the surface thereof according to the image data.

The dot counter 28 serving as an image density calculation mechanism calculates an image density D that is an index representing a percentage of the dots to be exposed to the beams irradiated by the LED head 6 in a stipulated region. The image density D is calculated as follows:

The image density $D(\%)$=(a number of dots to be exposed/a pixel number in a data region of a predetermined line number)×100

The development roller 4 develops the electrostatic latent image formed on the photoconductive insulation layer on the surface of the photosensitive drum 7 with adhesion of the toner. The development power source 11 applies the development bias voltage DB to the surface of the development roller 4, so that the voltage on the surface of the development roller 4 remains constant. The development roller 4 includes a core metal, an elastic layer and a surface layer. The core metal is made of steel whose surface is plated with nickel. The elastic layer is made of urethane rubber and is formed around the core metal. The surface layer is made of isocyanate and is formed on a surface of the elastic layer. The development roller 4 has an outside diameter of 19.6 mm.

The development blade 5 adjusts a thickness of a toner layer formed on the surface of the development roller 4. The development blade 5 includes two stainless plates that are overlain each other and folded with radius R of 0.275 mm. Each stainless plate (e.g., SUS304B-TA) has a thickness of 0.08 mm. The development blade 5 contacts the development roller 4 with a suitable amount of linear pressure, for example, between 40 and 70 gf/cm.

The sponge roller 3 supplies a developer to the development roller 4. The developer supply power source 12 applies the sponge bias voltage SB to the surface of the sponge roller 3, so that the voltage on the surface of the sponge roller 3 remains constant. The sponge roller 3 includes silicone foam rubber and a core metal. The silicone rubber has a cell diameter of 300 to 500 μm and is disposed around the core metal. The sponge roller 3 has outside diameters of 15.5 mm and 14.8 mm respectively at portions substantially at the middle and end thereof.

The image forming apparatus 24 includes a drum gear, a development gear, and a sponge gear that are not shown. These gears transmit driving forces to the photosensitive drum 7, the development roller 4 and the sponge roller 3. The charging roller 9 includes a charging gear. The development gear and the sponge gear have an idle gear therebetween. The development roller 4 has a rotation pitch (hereafter referred to as a DV pitch P) of 48.8 mm according to an arrangement of the gears and a diameter thereof.

The printer controller 27 controls the image forming apparatus 24 as a whole and includes a central processing unit (CPU), not shown. For example, the CPU serving as a determination mechanism determines whether the voltage to be applied to the developer supply mechanism is changed based on the image density D calculated by the dot counter 28, and provides an instruction to the power controller 30.

The power controller 30 controls the development power source 11 and developer supply power source 12 based on the instruction provided by the printer controller 27. Therefore, the power sources 11 and 12 apply the voltages to the development roller 4 and the sponge roller 3, respectively.

When the printer controller 27 instructs a printing operation, a motor (not shown) disposed in the image forming apparatus 24 begins to rotate. Upon the rotation of the motor, the drum gear is driven through gears (not shown) disposed in the image forming apparatus 24, so that the photosensitive drum 7 is rotated. The development roller 4 is rotated by transmission of the driving force from the drum gear to the development gear. The sponge roller 3 is rotated by transmission of the driving force transmitted from the development gear to the sponge gear through the idle gear. The charging roller 9 is rotated by transmission of the driving force from the drum gear to the charge gear.

The sponge roller 3, the development roller 4, the charging roller 9 and the photosensitive drum 7 during the developing process are rotated in directions, indicated by respective arrows shown in FIG. 2. The rotation of the motor disposed in the image forming apparatus 24 is transmitted to a member such as a roller for use in a transfer process and a fixing process through different system gears disposed in the image forming apparatus 24. Upon the beginning of the rotation of the motor, not shown, disposed in the image forming apparatus 24, a power supply disposed in the image forming apparatus 24 applies a predetermined voltage to each member for use in the development, transfer and the fixing processes.

The surface of the photosensitive drum 7 is uniformly charged by the rotation of the charging roller 9 and the voltage applied thereto. The LED head 6 irradiates the surface of the photosensitive drum 7 based on the printing data of the image transmitted to the exposure controller 29, so that the electrostatic latent image is formed on the surface of the photosensitive drum 7 when the charged area on the photosensitive drum 7 reaches a lower side of the LED head 6.

When the electrostatic latent image on the surface of the photosensitive drum 7 reaches the development roller 4, the thin layer of toner adjusted by the development blade 5 on the surface layer of the development roller 4 is transferred to the electrostatic latent image on the surface of the photosensitive drum 7 by a potential difference between the latent image on the photosensitive drum 7 and the development roller 4.

The toner on the photosensitive drum 7 transferred onto the recording sheet in the transfer process is subsequently fixed by heat and pressure in the fixing process, thereby forming a toner image. The cleaning blade 10 removes the remaining toner from the photosensitive drum 7. The disposal container 21 collects the remaining toner according to a sequence set with the printer controller 27 after the printing operation ends.

Figure 4:
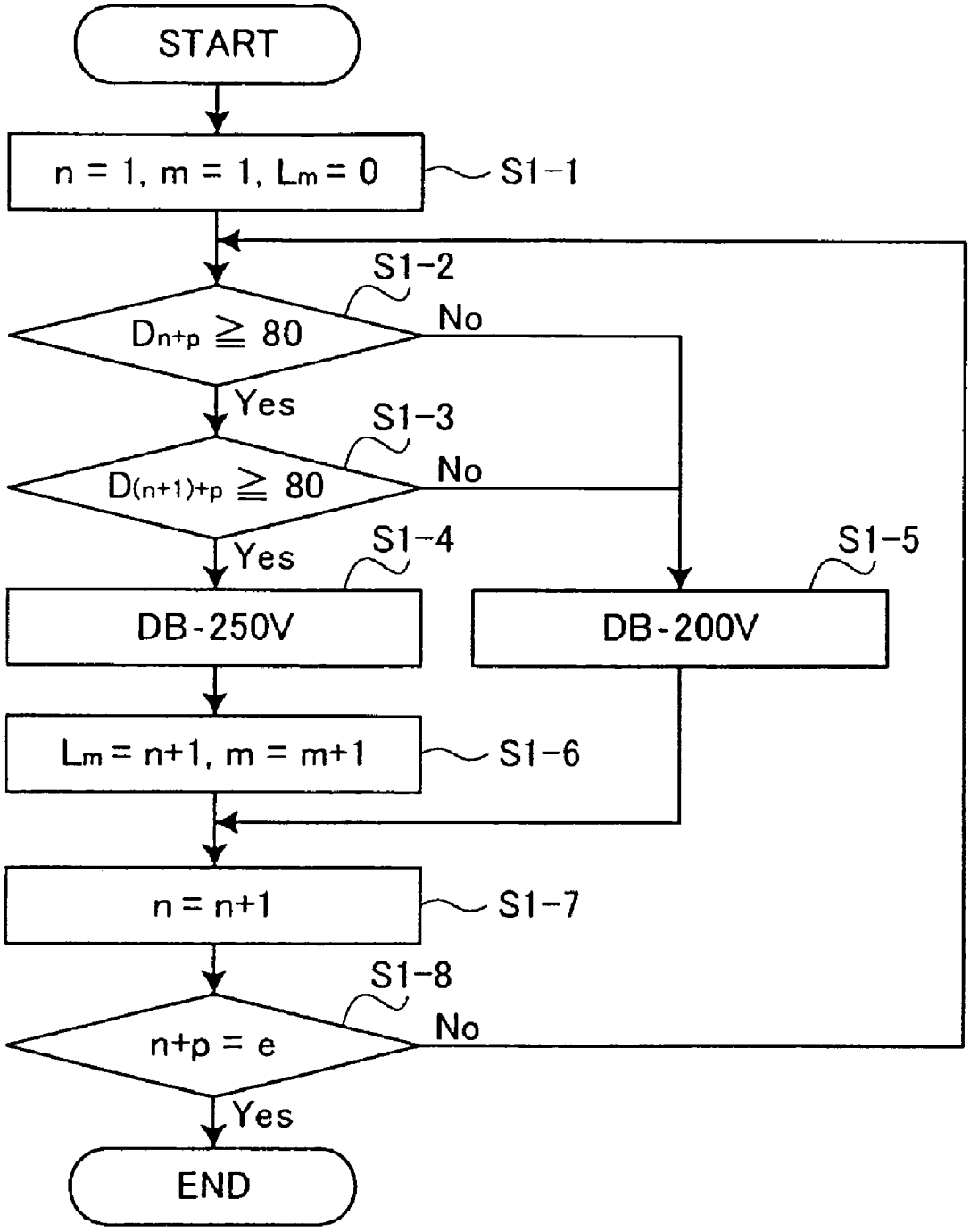
FIG. 4 is a flowchart illustrating an example procedure for calculating an image density and changing a development bias voltage according to the first embodiment of the present invention.

Referring to FIG. 4, an example procedure for calculating the image density D by the dot counter 28 and changing the voltage to be applied to the development roller 4 is illustrated. The development voltage DB has an initial voltage of −200V in the first embodiment of the present invention.

When the image data are transmitted from the personal computer 23 to the image forming apparatus 24 through the interface 26, the printer controller 27 changes the image data into the bitmap as the dot data in the memory 25. The printer controller 27 arranges a plurality of lines. For example, an image leading line is arranged within a region of the dot data as a line $g_1$, and lines $g_2$, $g_3$, . . . $g_n$, . . . $g_e$ are arranged at a certain line interval. The printer controller 27 arranges the lines $g_n$ and $g_e$ in which n represents a number of optional lines and e represents an end line.

Instep S1-1, where the arranged lines form a stipulated data region within a printing data region, the printer controller 27 inputs zero in a variable Lm and 1 in a variable m. The variable Lm represents a number of lines corresponding to a length of the image in which the values of the image densities D exceed eighty (80) in succession. The variable m represents a situation in which the values of the image densities D successively exceed eighty (80) one after another for at least twice.

Next, in step S1-2, the printer controller 27 instructs the dot counter 28 to calculate an image density $D_{1+p}$ for the line $g_1$. A lower-case letter p of the image density $D_{1+p}$ represents a number of lines for a region of the DV pitch P. The image density $D_{1+p}$ represents the image density of a region from the line $g_1$ to a line $g_{1+p}$. In other words, the line $g_{1+p}$ is positioned at which the region of the DV pitch P is added to the line $g_1$. Where the image density $D_{n+p}$ is smaller than eighty (80) percent (No in step S1-2), flow proceeds to step S1-5. In step S1-5, the development voltage DB remains at −200V and is not changed.

Where the image density $D_{n+P}$ is greater than or equal to eighty (80) percent (Yes in step S1-2), flow proceeds to step S1-3. In step S1-3, the dot counter 28 calculates an image density $D_{(n+1)+p}$. The image density $D_{(n+1)+p}$ is the image density of an area shifted by one line toward a tailing edge in a sheet conveyance direction.

Where the image density $D_{(n+1)+p}$ is greater than or equal to eighty (80) percent (Yes in step S1-3), flow proceeds to step S1-4. The printer controller 27 instructs the power controller 30 to change the development voltage to −250V in step S1-4. Where the image density $D_{(n+1)+p}$ is smaller than eighty (80) percent (No in step S1-3), flow proceeds to step S1-5. The development voltage DB remains at −200V and is not changed in step S1-5.

In step S1-6, the printer controller 27 inputs n+1 in the variable Lm and m+1 in the variable m. Here, the Lm represents a number of lines in an area in which the image density D is greater than eighty (80). In step S1-7, the printer controller 27 counts the number of line n, and flow proceeds to step S1-8. The printer controller 27 continues to calculate the image density until the line number (n+p) reaches e in step S1-8. The change of the development voltage DB is explained below with reference to FIGS. 5 and 6.

As illustrated in FIG. 5, Where the values of the image densities of a predetermined number of lines in the image successively exceed eighty (80) one after another, the development voltage DB is changed from the initial amount of −200V to −250V based on the conditions 1 and 2.

Figure 6:
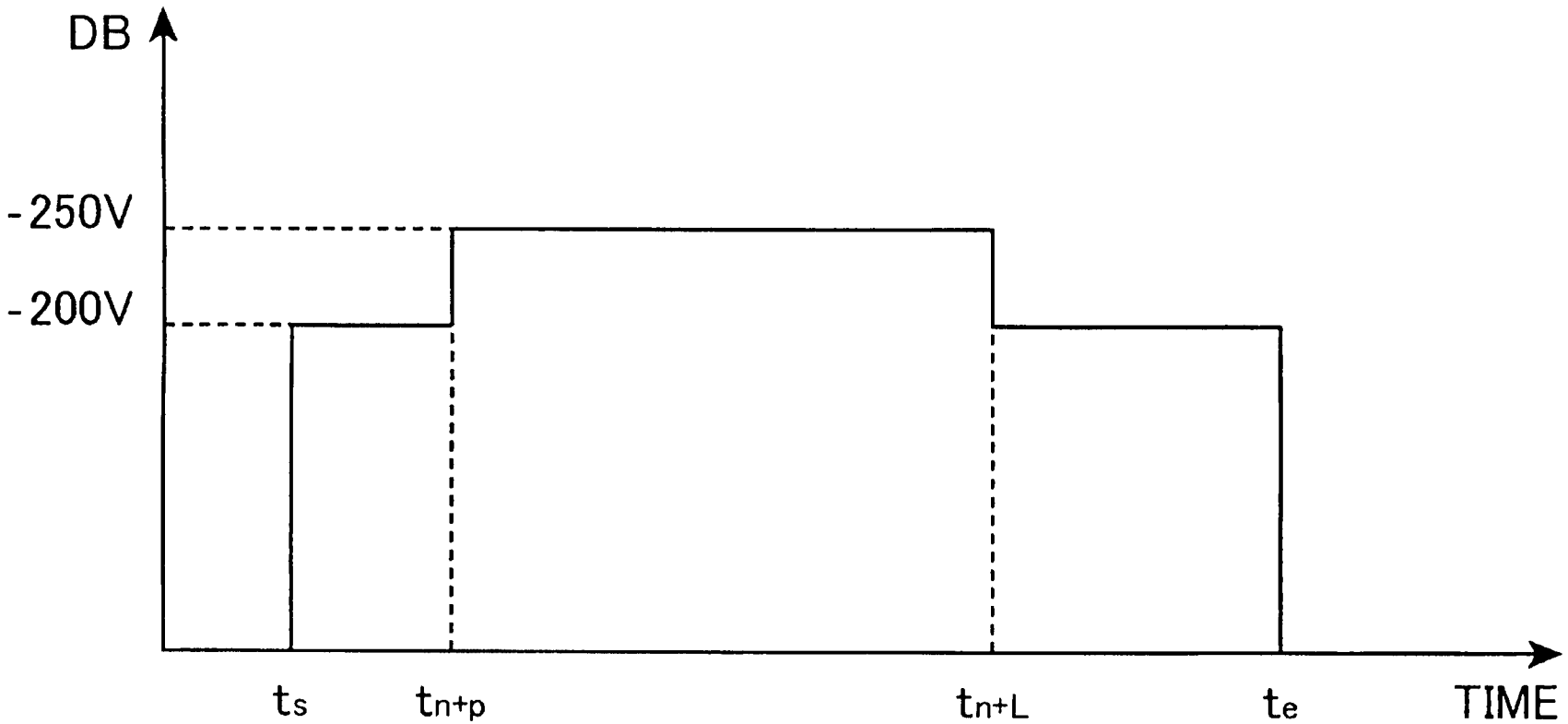
FIG. 6 is a timing diagram illustrating output change of the development bias voltage according to the first embodiment.

Referring to FIG. 6, a timing diagram for changing the output of the development voltage DB is illustrated. A vertical axis and a horizontal axis in FIG. 6 represent the output of the development voltage DB and time, respectively. The higher the position in the vertical axis, the greater the absolute value of the development voltage DB. The time axis includes timings as follows:

$t_s$: The beginning of the printing.

$t_e$: The end of the printing.

$t_{n+p}$: A timing at which the printer controller 27 instructs the power controller 30 to increase the output of the development voltage DB (e.g., DB=−250V).

$t_{n+L}$: A timing at which the printer controller 27 instructs the power controller 30 to re-change the output of the development voltage DB to the initial amount (e.g., DB=−200V).

Referring to FIGS. 7A through 7E, examples of printing images and patterns of the development voltage DB are illustrated. Throughout the FIGS. 7A to 7E, each black region indicates an image area having the image density of at least eighty (80) percent, and each shaded region indicates an image area having the image density of zero percent. Each arrow indicates a length of respective black region throughout the FIGS. 7A to 7E, and each length is compared to a length of the number of lines p for the region of the DV pitch P.

Figure 7A:
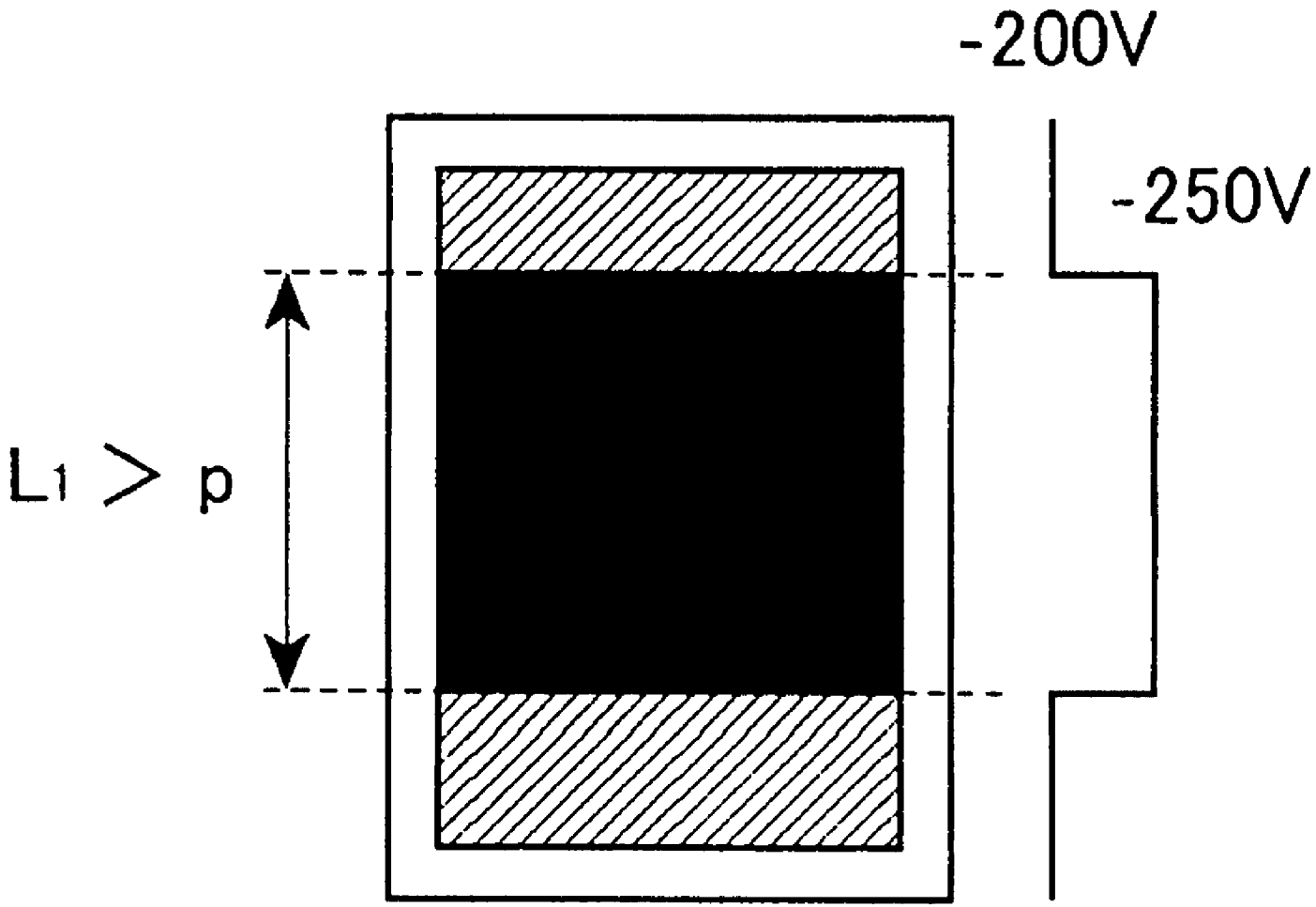
FIGS. 7A through 7E illustrate examples of printing images and patterns of the development bias voltage.

FIG. 7A illustrates a first example of the printing image. As shown in FIG. 7A, the printing image has two shaded regions and one black region. The two shaded regions are referred to as first and second shaded regions for the sake of simplification, and the first shaded region is disposed at the top of the printing image of FIG. 7A. The black region is disposed between the two shaded regions. A reference numeral $L_1$ represents a length of the black region in FIG. 7A. The length $L_1$ of the black region is longer than that of the number of lines p for the DV pitch P. The output amount of the development voltage DB is −200V at a leading area of the image density with the zero percent (e.g., the first shaded region). The development voltage DB is changed to −250V at the black region having the image density of at least eighty (80) percent, and is re-changed to −200V at the second shaded area.

Such output pattern of the development voltage DB is substantially similar to the timing diagram of FIG. 6. Therefore, the development voltage DB remains at −200V from the timing $t_s$ to the timing $t_{n+p}$ of FIG. 6. The development voltage DB is changed to −250V at the timing $t_{n+p}$ and remains at −250V until the timing $t_{n+L}$ of FIG. 6. In other words, the development voltage DB is −250V from the beginning of the image density having at least eighty (80) percent at the timing $t_{n+p}$ to the end thereof at the timing $t_{n+L}$. The development voltage DB is re-changed to and remains at −200V from the timing $t_{n+L}$ to the end of printing $t_e$.

Figure 7B:
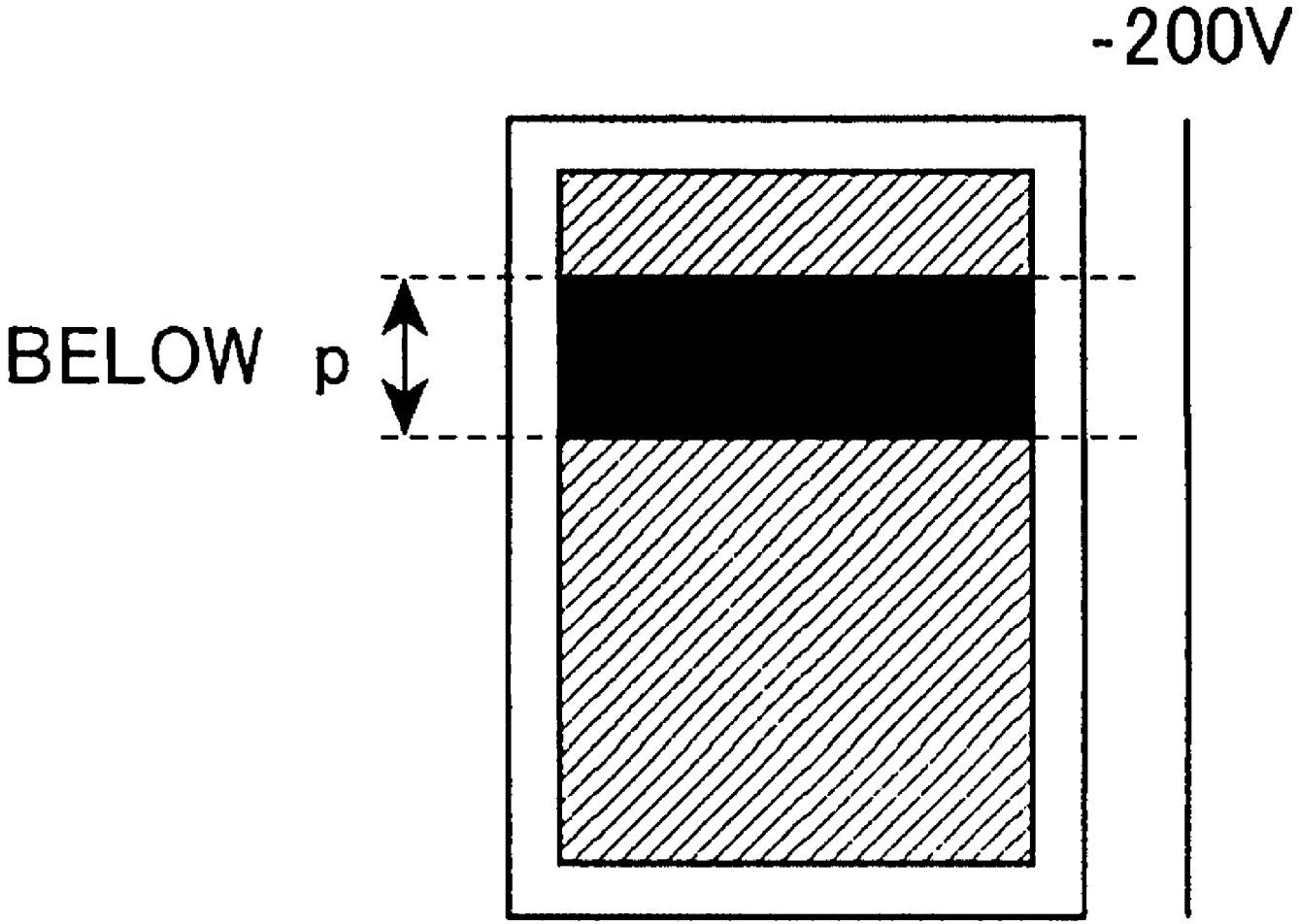

Referring to FIG. 7B, a second example of the printing image is illustrated. The printing image has two shaded regions and one black region. The two shaded regions are referred to as first and second shaded regions for the sake of simplification. The first shaded region is disposed at the top of the printing image of FIG. 7B. The black region is disposed between the two shaded regions. The length of the black region is shorter than that of the number of lines p for the DV pitch P in FIG. 7B. The output amount of the development voltage DB for such printing image is −200V from the beginning to the end of the printing.

Figure 7C:
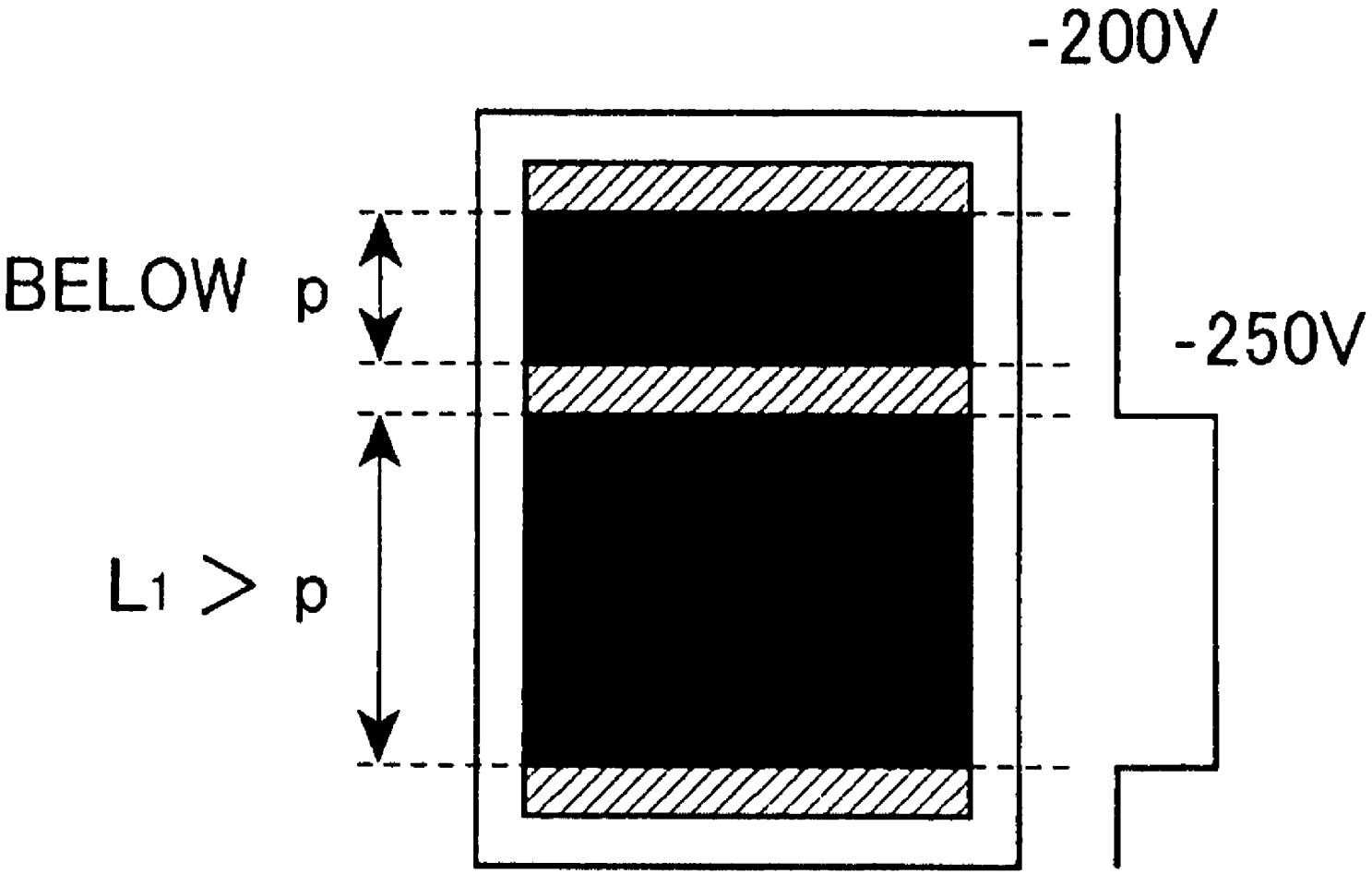

Referring to FIG. 7C, a third example of the printing image is illustrated. The printing image has three shaded regions and two black regions as shown in FIG. 7C. From the top of the printing image of FIG. 7C, a first shaded region, a first black region, a second shaded region, a second black region, and a third shaded region are disposed. A reference numeral $L_1$ represents a length of the second black region. The first black region with the image density of at least eighty (80) percent is disposed between the first and second shaded regions, and the length thereof is shorter than that of the number of lines p for the DV pitch P. The second black region is disposed between the second and third shaded regions as illustrated in FIG. 7C. The length $L_1$ of the second black region is longer than that of the number of lines p for of the DV pitch P. The output amount of the development voltage DB for the third example of the printing image is −200V from the beginning of the first shaded region to the end of the second shaded area, is changed to −250V at the beginning of the second black region, and is re-changed to −200V at the third shaded area.

Figure 7D:
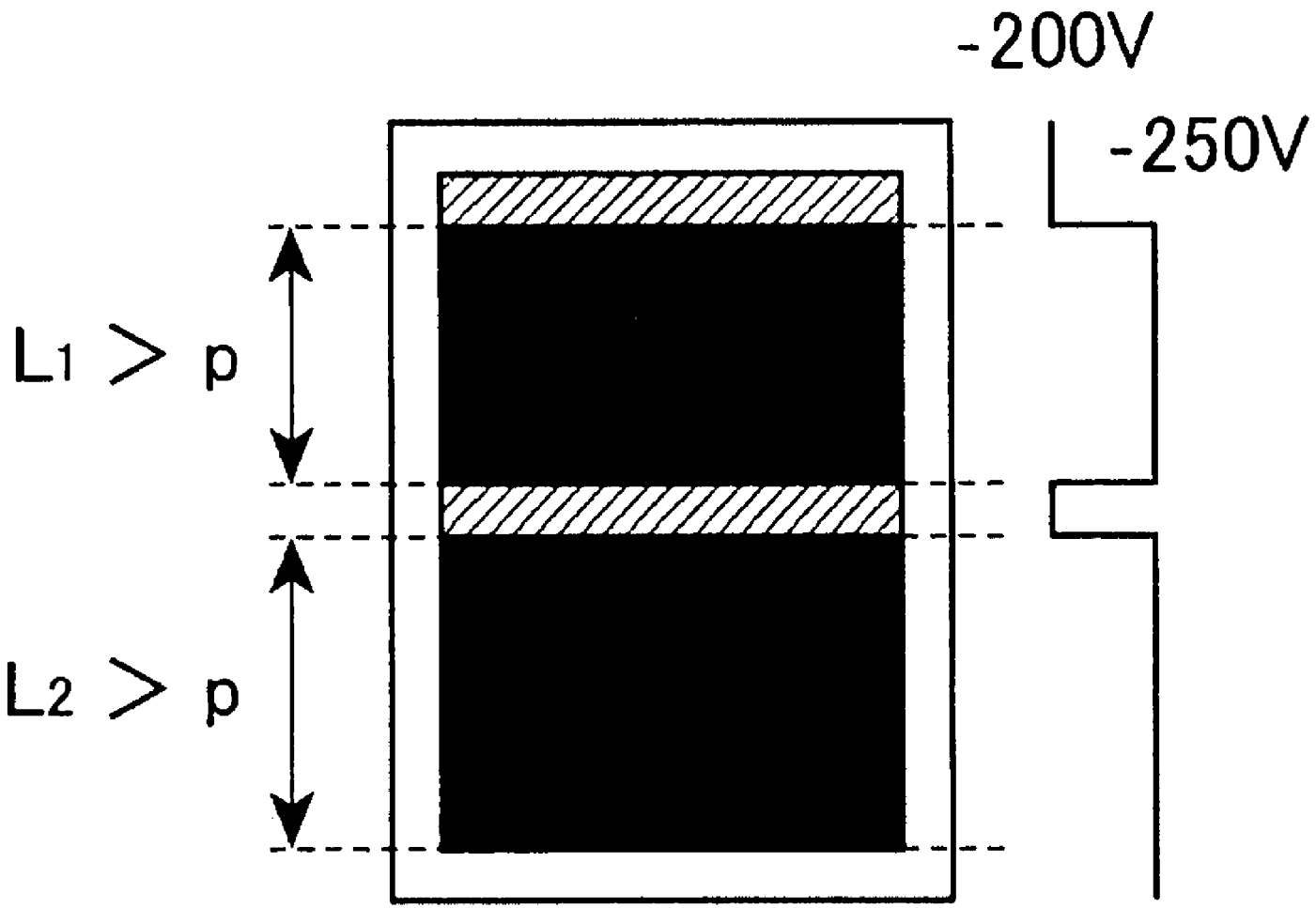

Referring to FIG. 7D, a fourth example of the printing image is illustrated. The printing image in FIG. 7D has two shaded regions including first and second shaded regions and two black regions including first and second black regions for the sake of simplification. From the top of the printing image in FIG. 7D, the first shaded region, the first black region, the second shaded region, and the second black region are disposed. Reference numerals $L_1$ and $L_2$ represent lengths of the first and second black regions respectively. The first black region is disposed between the first and second shaded regions, and the length $L_1$ thereof is longer than that of the number of lines p for the DV pitch P. The length $L_2$ of the second black region is longer than that of the number of lines p for the DV pitch P. The output amounts of the development voltage DB are −200V, −250V, −200V and −250V at the first shaded region, the first black region, the second shaded region, and the second black region respectively in the fourth example of the printing image.

Figure 7E:
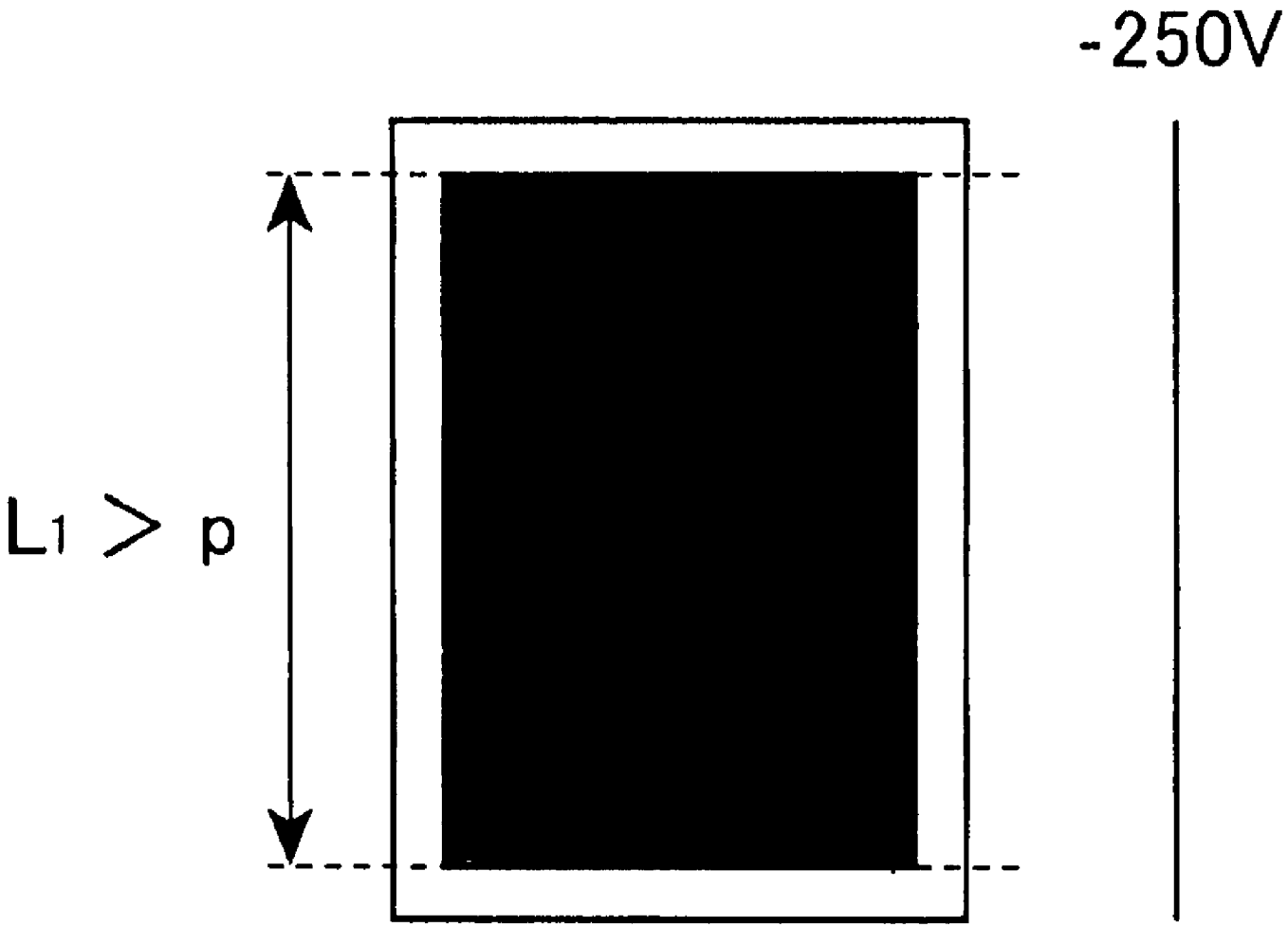

Referring to FIG. 7E, a fifth example of the printing image is illustrated. The printing image in FIG. 7E has the image density of at least eighty (80) percent across the entire thereof. The output amount of the development voltage DB remains at −250V. A reference numeral $L_1$ represents a length of the printing image in FIG. 7E.

Now, printing images were formed by the image forming apparatus 24 capable of controlling the change of the development voltage DB based on the image density, and a printing density of each printing image was measured by a spectral densitometer X-Rite 528. Specifically, each printing image was formed on an A4-sized sheet in a portrait orientation with the density of 100 percent across the entire thereof, and a leading end and a tailing end of the printing densities relative to a printing direction were measured. The measurement results are explained with reference to FIG. 17.

As shown in a section of the first embodiment in FIG. 17, the densitormeter X-Rite 528 measured an example image 1-1 and a comparative example image 111 as the printing images. The example image 1-1 was formed according to the first embodiment of the present invention, and the comparative example image 111 was formed without controlling the development voltage DB.

As shown in FIG. 17, the example image 1-1 reduced the decrease in the printing densities relative to the leading end and tailing end thereof compared to the comparative example image 111. In other words, the comparative example image 111 had a blur occurrence from the leading end toward the tailing end, and the example image 1-1 had substantially no blur.

Therefore, the image forming apparatus 24 of the first embodiment can change the voltage to be applied to the development roller 4 by the printer controller 27 based on the image density calculated by the dot counter 28. Therefore, the image forming apparatus 24 forms a good image without the blur occurrence.

In general, an image forming apparatus such as a printer employing an electrophotographic method tends to increase a potential difference between an exposed area on a surface of a photosensitive drum and a development voltage such as the development voltage DB so as to increase the image density.

According to the image forming apparatus 24 of the first embodiment, when the exposed area on the photosensitive drum 7 has an electric potential of zero voltage, the development voltage DB without control is −200V and the voltage DB with control is −250V. Therefore, the toner having a negative charge becomes easier to be transferred to the exposed area on the photosensitive drum 7. In this regard, an absolute amount of the toner adhering to the photosensitive drum 7 increases, thereby increasing the image density.

Second Embodiment

A second embodiment of the present invention is similar to the first embodiment described above with reference to FIGS. 1 through 3. A description of elements that are already described with reference to FIGS. 1 through 3 is omitted. According to the second embodiment, the printer controller 27 controls the change of the sponge voltage SB while unchanging the development voltage DB.

Figure 8:
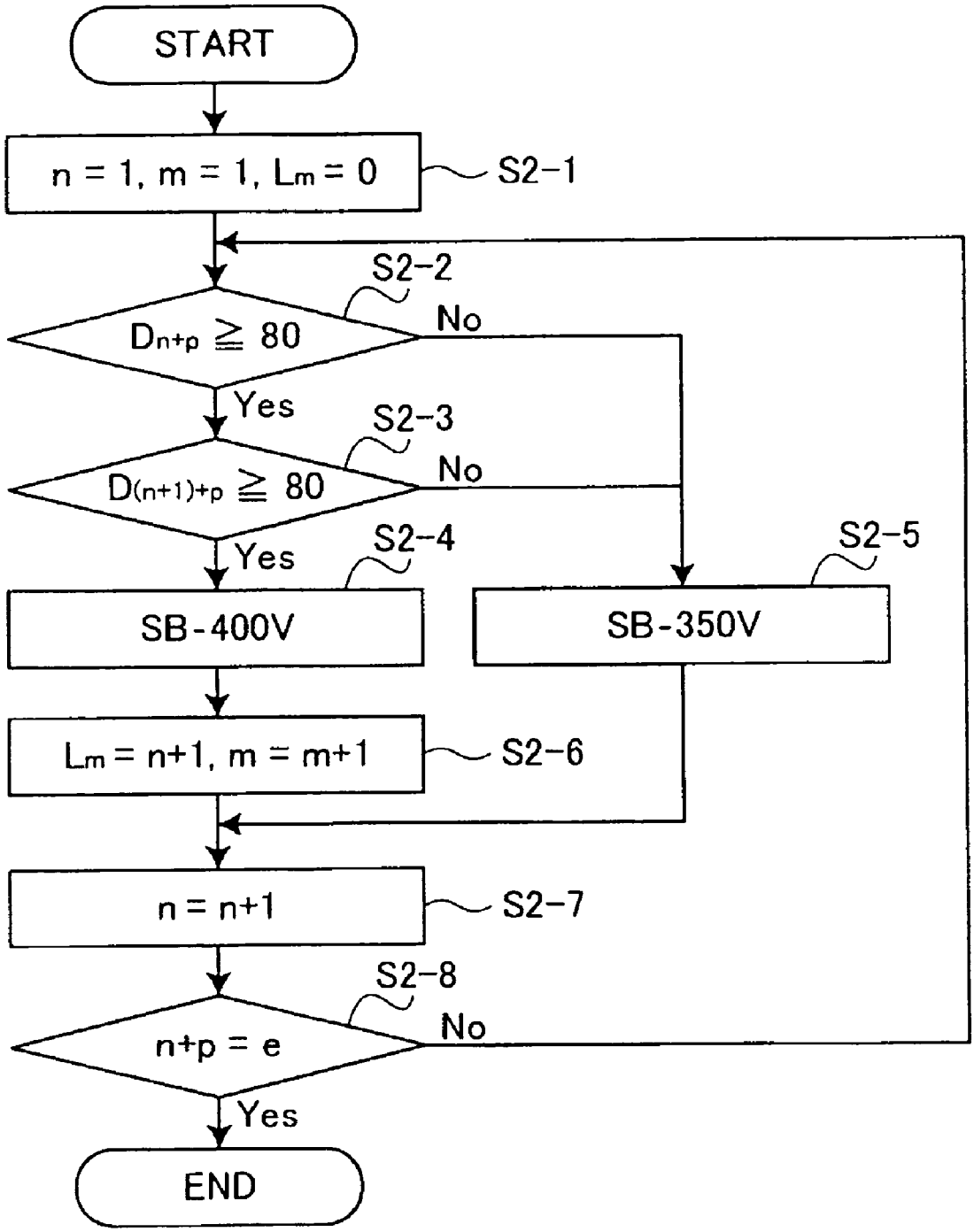
FIG. 8 is another flowchart illustrating an example procedure for calculating an image density and changing a sponge bias voltage according to a second embodiment of the present invention.

Referring to FIG. 8, another example procedure for calculating the image density D by the dot counter 28 and changing the voltage applied to the sponge roller 3 is illustrated. The flowchart of FIG. 8 is similar to that of FIG. 4 except for steps S2-4 and S2-5 with respect to the amounts of the sponge voltage SB. Only steps that differ from those of the above embodiment are described, and like elements are given the same reference numerals as above and descriptions thereof are omitted. The development voltage DB is changed according to the first embodiment. However, the voltage DB remains at −200V according to the second embodiment.

In step S2-4, where the image density $D_{n+P}$ is greater than or equal to eighty (80) percent (Yes in step S2-2), and the image density $D_{(n+1)+p}$ is greater than or equal to eighty (80) percent (Yes in step S2-3), the printer controller 27 instructs the power controller 30 to increase the sponge voltage SB to −400V.

On the other hand, where the image density $D_{n+P}$ is smaller than eighty (80) percent (No in step S2-2) and the image density $D_{(n+1)+p}$ is smaller than eighty (80) percent (No in step S2-3), the flow proceeds to step S2-5. In step S2-5, the sponge voltage SB remains at −350V without change of the output amount. The change of the sponge voltage SB is explained below with reference to FIGS. 9 and 10.

As illustrated in FIG. 9, where the values of the image densities of a predetermined number of lines in the image successively exceed eighty (80) one after another, the output amount of the sponge voltage SB is changed from the initial amount of −350V to −400V based on the conditions 1 and 2 shown in FIG. 9.

Figure 10:
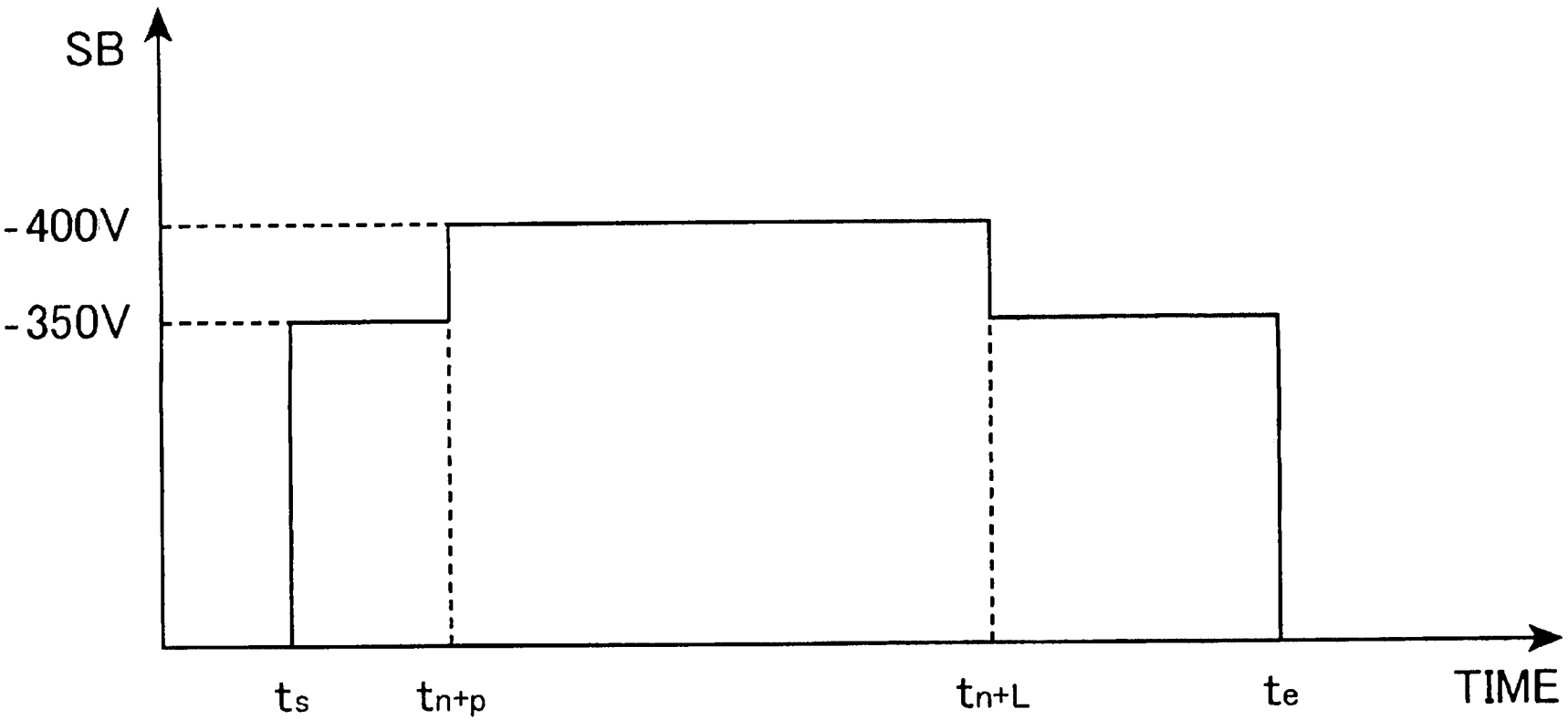
FIG. 10 is a timing diagram illustrating the output change of the sponge bias voltage according to the second embodiment.

Referring to FIG. 10, a timing diagram for changing the output of the sponge voltage SB is illustrated. A vertical axis and a horizontal axis in FIG. 10 represent the output of the sponge voltage SB and time, respectively. The higher the position in the vertical axis, the greater the absolute value of the sponge voltage SB. The time axis in FIG. 10 includes timings as follows:

$t_s$: The beginning of the printing.

$t_e$: The end of the printing.

$t_{n+p}$: A timing at which the printer controller 27 instructs the power controller 30 to increase the output of the sponge voltage SB (e.g., SB=−400V).

$t_{n+L}$: A timing at which the printer controller 27 instructs the power controller 30 to re-change the output of the sponge voltage SB to the initial amount (e.g., SB=−350V).

The sponge voltage SB remains at −350V from the timing $t_s$ to the timing $t_{n+p}$. The output amount of the sponge voltage SB is changed to −400V upon reaching the region having the image density of eighty (80) percent until the end thereof. In other words, the sponge voltage SB remains at −400V from the timing $t_{n+p}$ to the timing $t_{n+L}$. The sponge voltage SB is changed to −350V at the timing $t_{n+L}$ and remains constant from the timing $t_{n+L}$ to the timing $t_e$.

Here, printing images were formed by the image forming apparatus 24 capable of controlling the change of the sponge voltage SB based on the image density, and a printing density of each printing image was measured by the spectral densitometer X-Rite 528. Specifically, each printing image was formed on an A4-sized sheet in a portrait orientation with the density of 100 percent across the entire thereof, and a leading end and a tailing end of the printing densities relative to a printing direction were measured. The measurement results are explained with reference to FIG. 17.

As shown in a section of the second embodiment in FIG. 17, the X-Rite 528 measured an example image 2-1 and a comparative example image 222 as the printing images. Example image 2-1 was formed according to the second embodiment of the present invention, and the comparative example image 222 was formed without controlling the sponge voltage SB.

As shown in FIG. 17, example image 2-1 reduced the decrease in the printing densities relative to the leading end and the tailing end thereof compared to the comparative example image 222. In other words, the comparative example image 222 had a blur occurrence from the leading end toward the tailing end while example image 2-1 had substantially no blur.

Therefore, the image forming apparatus 24 of the second embodiment can change the voltage to be applied to the sponge roller 3 by the printer controller 27 based on the image density calculated by the dot counter 28. Consequently, the image forming apparatus 24 forms a good image without the blur occurrence.

An image forming apparatus such as a printer employing an electrophotographic method tends to increase a potential difference between an exposed area on a surface of a photosensitive drum and a sponge voltage such as the sponge voltage SB so as to increase the image density. According to the image forming apparatus 24 of the second embodiment, the sponge voltage SB without control is −350V and the voltage SB with control is −400V when the exposed area on the photosensitive drum 7 has an electric potential of zero voltage. Therefore, the toner having a negative charge becomes easier to transfer to the exposed area on the photosensitive drum 7. In this regard, an absolute amount of the toner adhering to the photosensitive drum 7 increases, thereby increasing the image density.

Third Embodiment

A third embodiment of the present invention is similar to the first and second embodiments described above with reference to FIGS. 1 through 3. A description of elements that are already described with reference to FIGS. 1 through 3 is omitted. According to the third embodiment, the printer controller 27 controls the change of an absolute value of a potential difference between the development voltage DB and the sponge voltage SB. Such absolute value is hereafter referred to as an absolute value DS.

Figure 11:
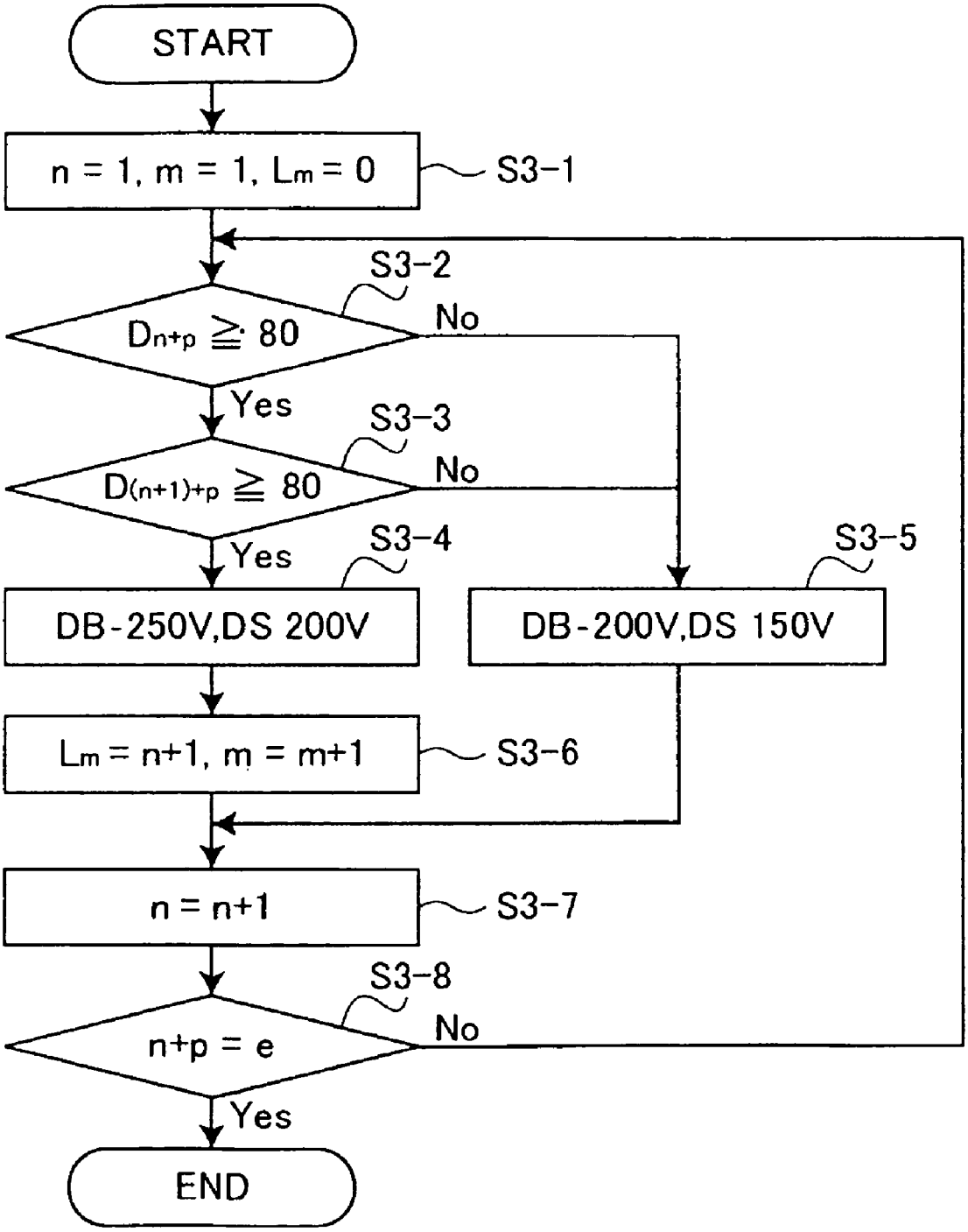
FIG. 11 is a flowchart illustrating an example procedure for calculating an image density and changing voltages to be applied according to a third embodiment of the present invention.

Referring to FIG. 11, an example procedure for calculating the image density D and changing the voltages is illustrated according to the third embodiment. The flowchart of FIG. 11 is similar to that of FIG. 8 except for steps S3-4 and S3-5. Only steps that differ from those of the above embodiment are described, and like elements are given the same reference numerals as above and descriptions thereof are omitted.

According to the third embodiment of the present invention, the development voltage DB and the sponge voltage SB are changed. For example, in step S3-4, where the image density $D_{n+P}$ is greater than or equal to eighty (80) percent (Yes in step S3-2), and the image density $D_{(n+1)+p}$ is greater than or equal to eighty (80) percent (Yes in step S3-3), the printer controller 27 simultaneously instructs the power controller 30 to increase the development voltage DB and the sponge voltage SB from −200V to −250V and from −350V to −450V, respectively. In this regard, the absolute value DS is changed from 150V to 200V.

On the other hand, where the image density $D_{n+P}$ is smaller than eighty (80) percent (No in step S3-2) and the image density $D_{(n+1)+p}$ is smaller than eighty (80) percent (No in step S3-3), the flow proceeds to step S3-5. In step S3-5, the absolute value DS remains at 150V. The changes of the development voltage DB, the sponge voltage SB and the absolute value DS are explained below with reference to FIGS. 12, 13A and 13B.

As illustrated in FIG. 12, where the values of the image densities of a predetermined number of lines in the image successively exceed eighty (80) one after another, the absolute value DS is changed from the initial value of 150V to 200V.

Figure 13A:
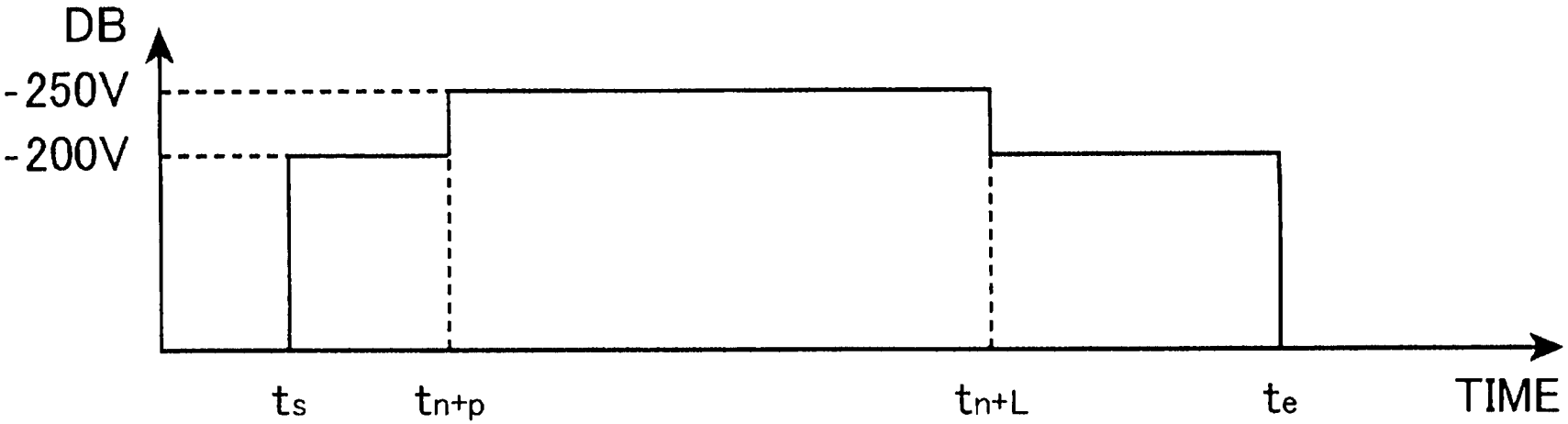
FIG. 13A is a timing diagram illustrating the output change of the development bias voltages according to the third embodiment.
Figure 13B:
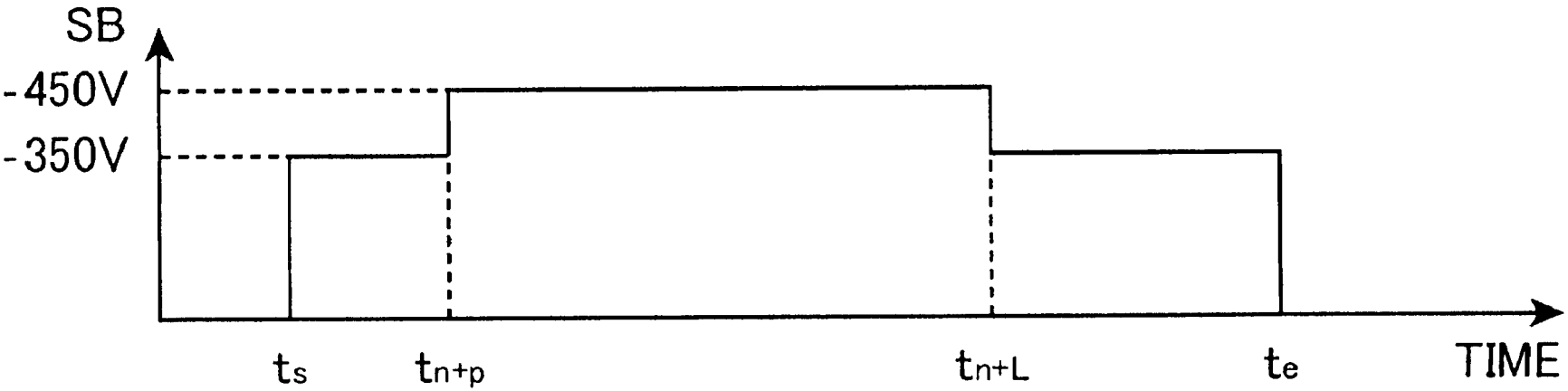
FIG. 13B is a timing diagram illustrating the output change of the sponge bias voltages according to the third embodiment.

Referring to FIGS. 13A and 13B, the output changes of the development bias DB and the sponge bias voltages SB are illustrated respectively in timing diagrams according to the third embodiment. In other words, the timing diagrams in FIGS. 13A and 13B illustrate the output change of the absolute value DS based on the change of the development voltage DB and the sponge voltage SB. The vertical axes in FIGS. 13A and 13B represent the output of the development voltage DB and sponge voltage SB respectively. The higher the positions in the vertical axes in FIGS. 13A and 13B, the greater the absolute values of the development voltage DB and the sponge voltage SB, respectively. The horizontal axes in FIGS. 13A and 13B represent time including timings as follows:

$t_s$: The beginning of the printing.

$t_e$: The end of the printing.

$t_{n+p}$: A timing at which the printer controller 27 instructs the power controller 30 to increase the output of the absolute value DS (e.g., DS=200V).

$t_{n+L}$: A timing at which the printer controller 27 instructs the power controller 30 to re-change the output of the absolute value DS to the initial level (e.g., DS=150V).

As shown in FIGS. 13A and 13B, the development voltage DB and the sponge voltage SB are −200V and −350V respectively from the timing $t_s$ to the timing $t_{n+p}$. The output amounts of the development voltage DB and the sponge voltage SB are changed to and remain at −250V and −450V respectively upon reaching the region having the image density of eighty (80) percent until the ending thereof. In other words, the development voltage DB and the sponge voltage SB remain at −250V and −450V respectively from the timing $t_{n+p}$ to the timing $t_{n+L}$. The development voltage DB and sponge voltage SB are re-changed to and remain at −200V and −350V respectively from the timing $t_{n+L}$ to the timing $t_e$.

Now, printing images were formed by the image forming apparatus 24 capable of controlling the change of the absolute value DS based on the image density, and a printing density of each printing image was measured by the spectral densitometer X-Rite 528. Specifically, each printing image was formed on an A4-sized sheet in a portrait orientation with the density of 100 percent across the entire thereof, and a leading end and a tailing end of the printing densities relative to a printing direction were measured. The measurement results are explained with reference to FIG. 17.

As shown in a section of the third embodiment in FIG. 17, the X-Rite 528 measured example image 3-1 and a comparative example image 333 as the printing images. Example image 3-1 was formed according to the first example procedure of the third embodiment of the present invention, and the comparative example image 333 was formed without controlling the voltage. As shown in FIG. 17, example image 3-1 reduced the decrease in printing densities relative to the leading end and tailing end thereof compared to the comparative example image 333. Therefore, the comparative example image 333 had a blur occurrence from the leading end toward the tailing end while example image 3-1 had substantially no blur.

Fourth Embodiment

A fourth embodiment of the present invention is similar to the first example procedure of the third embodiment described above with reference to FIGS. 1 through 3. A description of elements that are already described with reference to FIGS. 1 through 3 is omitted. Similar to the third embodiment, the printer controller 27 controls the change of the absolute value DS of the potential difference between the development voltage DB and the sponge voltage SB according to the fourth embodiment.

Figure 14:
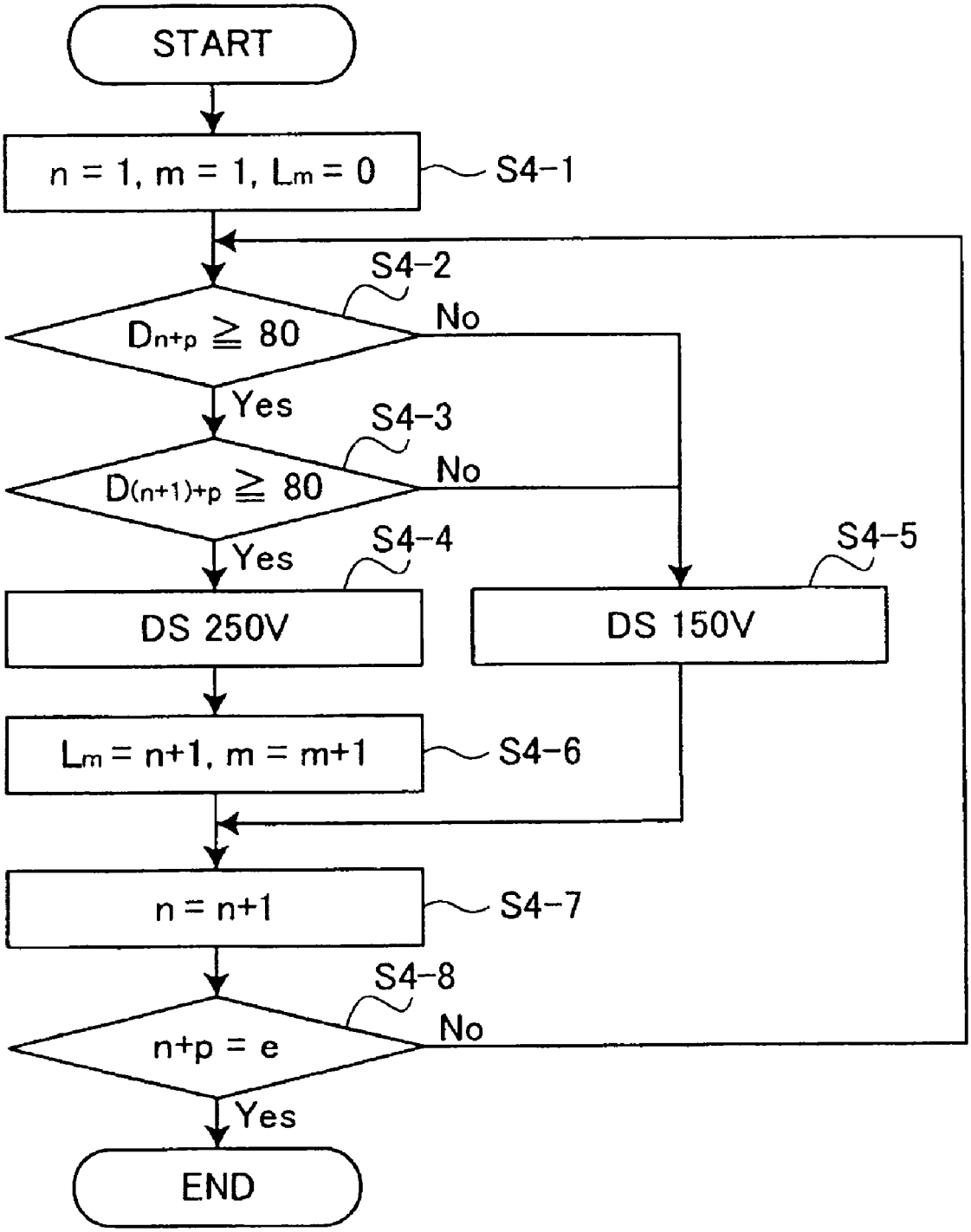
FIG. 14 is another flowchart illustrating an example procedure for calculating an image density and changing voltages to be applied according to a fourth embodiment of the present invention.

Referring to FIG. 14, an example procedure for calculating the image density D and changing the voltages is illustrated according to the fourth embodiment. The flowchart of FIG. 14 is similar to that of FIG. 11 except for step S4-4 that is described in detail later. Like elements are given the same reference numerals as above embodiment and descriptions thereof are omitted.

Similar to the third embodiment, the development voltage DB and the sponge voltage SB are changed according to the fourth embodiment of the present invention. However, in step S4-4, where the image density $D_{n+P}$ is greater than or equal to eighty (80) percent (Yes in step S4-2), and the image density $D_{(n+1)+p}$ is greater than or equal to eighty (80) percent (Yes in step S4-3), the printer controller 27 simultaneously instructs the power controller 30 to decrease the development voltage DB from −200V to −175V while increasing the sponge voltage SB from −350V to −425V. Therefore, the absolute value DS is changed from 150V to 250V.

Similar to the third embodiment, where the image density $D_{n+P}$ is smaller than eighty (80) percent (No in step S4-2), and the image density $D_{(n+1)+p}$ is smaller than eighty (80) percent (No in step S4-3), the flow proceeds to step S4-5. In step S4-5, the absolute value DS remains at 150V, and the output thereof is not changed. The change of the development voltage DB, the sponge voltage SB and the absolute value DS are explained below with reference to FIGS. 15, 16A and 16B.

As illustrated in FIG. 15, where the values of the image densities of a predetermined number of lines in the image successively exceed eighty (80) one after another, the absolute value DS is changed from the initial value of 150V to 250V.

Figure 16A:
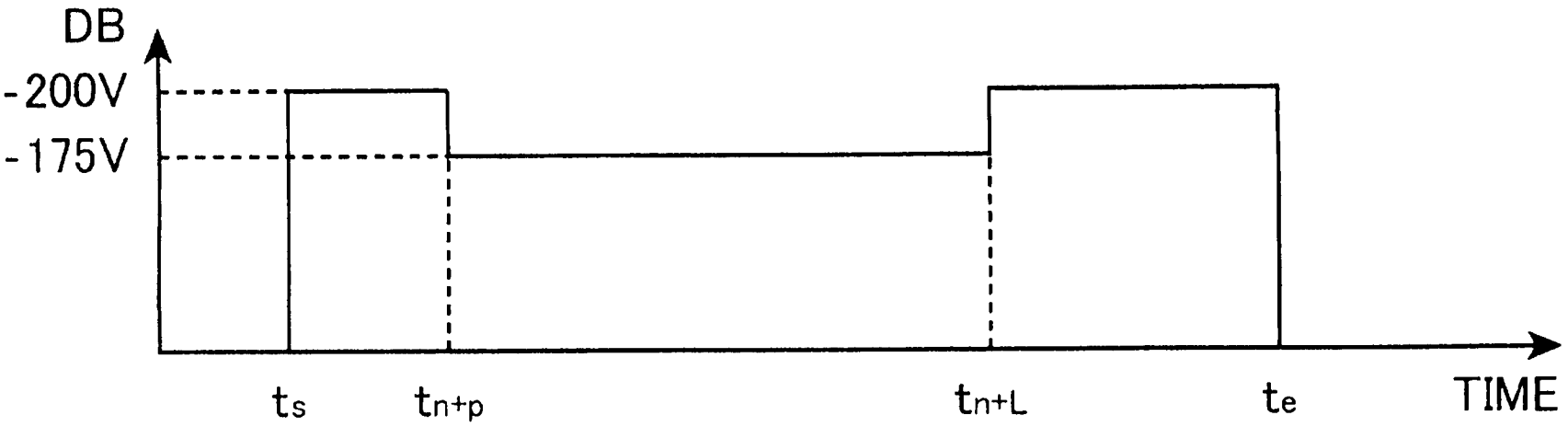
FIG. 16A is a timing diagram illustrating the output change of the development bias voltages according to the fourth embodiment.
Figure 16B:
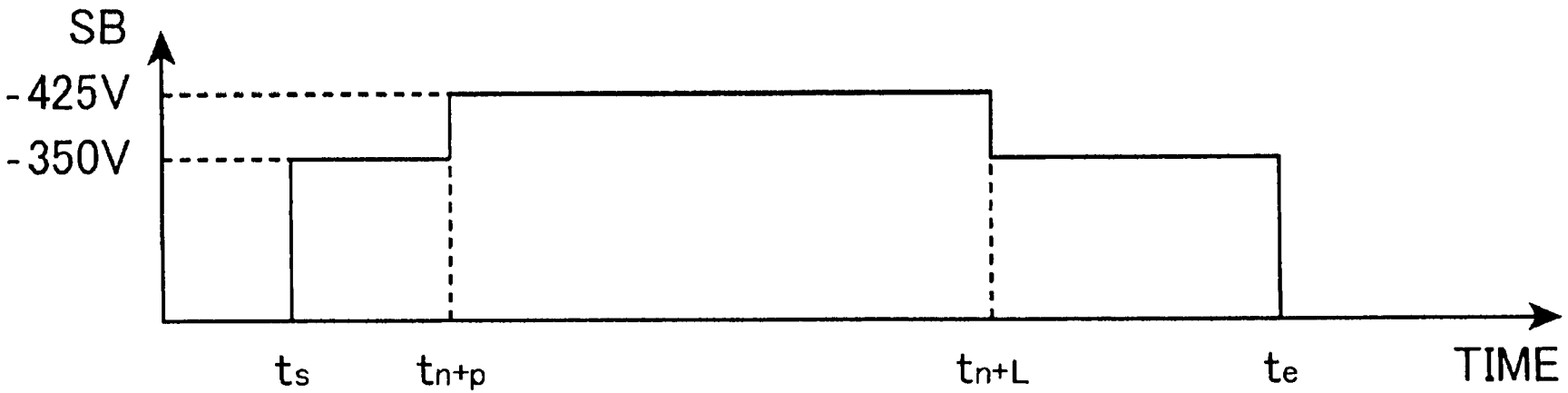
FIG. 16B is a timing diagram illustrating the output change of the sponge bias voltages according to the fourth embodiment.

Referring to FIGS. 16A and 16B, the output changes of the development voltage DB and the sponge voltages SB are illustrated respectively in timing diagrams according to the fourth embodiment. In other words, the timing diagrams in FIGS. 16A and 16B illustrate the output change of the absolute value DS based on the changes of the development voltage DB and the sponge voltage SB. The vertical axes in FIGS. 16*a* and 16B represent the output of the development voltage DB and sponge voltage SB, respectively. The higher the positions in the vertical axes in FIGS. 16A and 16B, the greater the absolute values of the development voltage DB and the sponge voltage SB, respectively. The horizontal axes in FIGS. 13A and 13B represent time including timings as follows:

$t_s$: The beginning of the printing.

$t_e$: The end of the printing.

$t_{n+p}$: A timing at which the printer controller 27 instructs the power controller 30 to increase the output of the absolute value DS (e.g., DS=250V).

$t_{n+L}$: A timing at which the printer controller 27 instructs the power controller 30 to re-change the output of the absolute value DS to the initial level (e.g., DS=150V).

As shown in FIGS. 16A and 16B, the development voltage DB and the sponge voltage SB are −200V and −350V respectively from the timing $t_s$ to the timing $t_{n+p}$. The output amounts of the development voltage DB and the sponge voltage SB are changed to and remain at −175V and −425V respectively upon reaching the region having the image density of eighty (80) percent until the end thereof. In other words, the development voltage DB and the sponge voltage SB remain at −175V and −452V respectively from the timing $t_{n+p}$ to the timing $t_{n+L}$. The development voltage DB and sponge voltage SB are changed to and remain at −200V and −350V respectively from the timing $t_{n+L}$ to the timing $t_e$.

Now, printing images were formed by the image forming apparatus 24 capable of controlling the change of the absolute value DS based on the image density, and a printing density of each printing image was measured by the spectral densitometer X-Rite 528. Specifically, each printing image was formed on an A4-sized sheet in a portrait orientation with the density of 100 percent across the entire thereof, and a leading end and a tailing end of the printing densities relative to a printing direction were measured. The measurement results are explained with reference to FIG. 17.

As shown in a section of the fourth embodiment in FIG. 17, the X-Rite 528 measured example image 4-1 and a comparative example image 444 as the printing images. Example image 4-1 was formed according to the fourth embodiment of the present invention, and the comparative example image 444 was formed without controlling the voltage.

As shown in FIG. 17, the printing density of the leading end of example image 4-1 is lower than that of the comparative example 44 due to a decrease in the output of the development voltage DB. Such decrease in the development voltage DB may causes a reduction of a total amount of the toner to be transferred from the development roller 4 to the photosensitive drum 7. However, example image 4-1 had a smaller difference in the printing densities between the leading end and the tailing end thereof compared to the comparative example image 444. Therefore, the comparative example image 444 had a blur occurrence from the leading end toward the tailing end while example image 4-1 had substantially no blur.

According to the first, second, third and fourth embodiments described above, the voltages to be applied to the developer supply mechanism such as the development roller 4 is immediately changed where the image density is greater than or equal to eighty (80) percent. However, according to fifth, sixth, seventh and eights embodiments described later, the voltages to be applied to the development supply mechanism are changed after rotating the development roller for one rotation (i.e., a amount of the DV pitch P) where the image density is greater than or equal to eighty (80) percent. In other words, the voltages to be applied to the developer supply mechanism are not immediately changed where the image density is greater than or equal to eighty (80) percent according to the fifth, sixth, seventh and eights embodiments.

Fifth Embodiment

A fifth embodiment of the present invention is similar to the first through fourth embodiments described above with reference to the image forming apparatus, development device and block diagram in FIGS. 1 through 3. A description of elements that are already described with reference to FIGS. 1 through 3 is omitted.

According to the fifth embodiment, a change of the development bias voltage DB as the development voltage is controlled. In the fifth embodiment, an image region of the bitmap changed based on the image data in the memory 25 is equally divided by a total number of lines e into a predetermined width of the image region. An image density from a line number x to a line number aa (i.e., an image density with a number of lines aa) is an image density Dx. The number of lines aa is a width of the region to calculate the image density Dx and is a fixed value.

In addition, according to the fifth embodiment, variables v and w are applied to define a change timing of the development voltage DB, where the variable v and w are integers of zero or greater. In other words, the variable v is counted when an image region of the image density Dx is changed from smaller than eighty (80) percent to greater than or equal to eighty (80) percent. The variable v corresponds to a width (a number of lines) from a leading end of the image region having the image density Dx of eighty (80) percent or above. The variable v counted from zero (v=0) to a point at which the variable v is p (v=p) represents the width of the DV pitch P. Therefore, the point becomes a timing for the output amount of the development voltage DB to be decreased from −200V to −250V (i.e., change timing). On the other hand, the variable w is counted when an image region of the image density Dx is changed from greater than or equal to eighty (80) percent to smaller than eighty (80) percent by extending from a boundary disposed between the image regions having the image density of greater than eighty (80) percent and smaller than eighty (80) percent. The variable w corresponds to a width (a number of lines) extending from the boundary. The variable w counted from zero (w=0) to a point at which the variable w is aa (w=aa) represents the width of the image density Dx. Therefore, the point becomes timing for the output amount of the development voltage DB to be increased from −250V to −200V (i.e., change timing). Moreover, according to the fifth embodiment, the output amount of the development voltage DB to be applied with respect to each line number x is stored in an arrangement DB(x).

Figure 18:
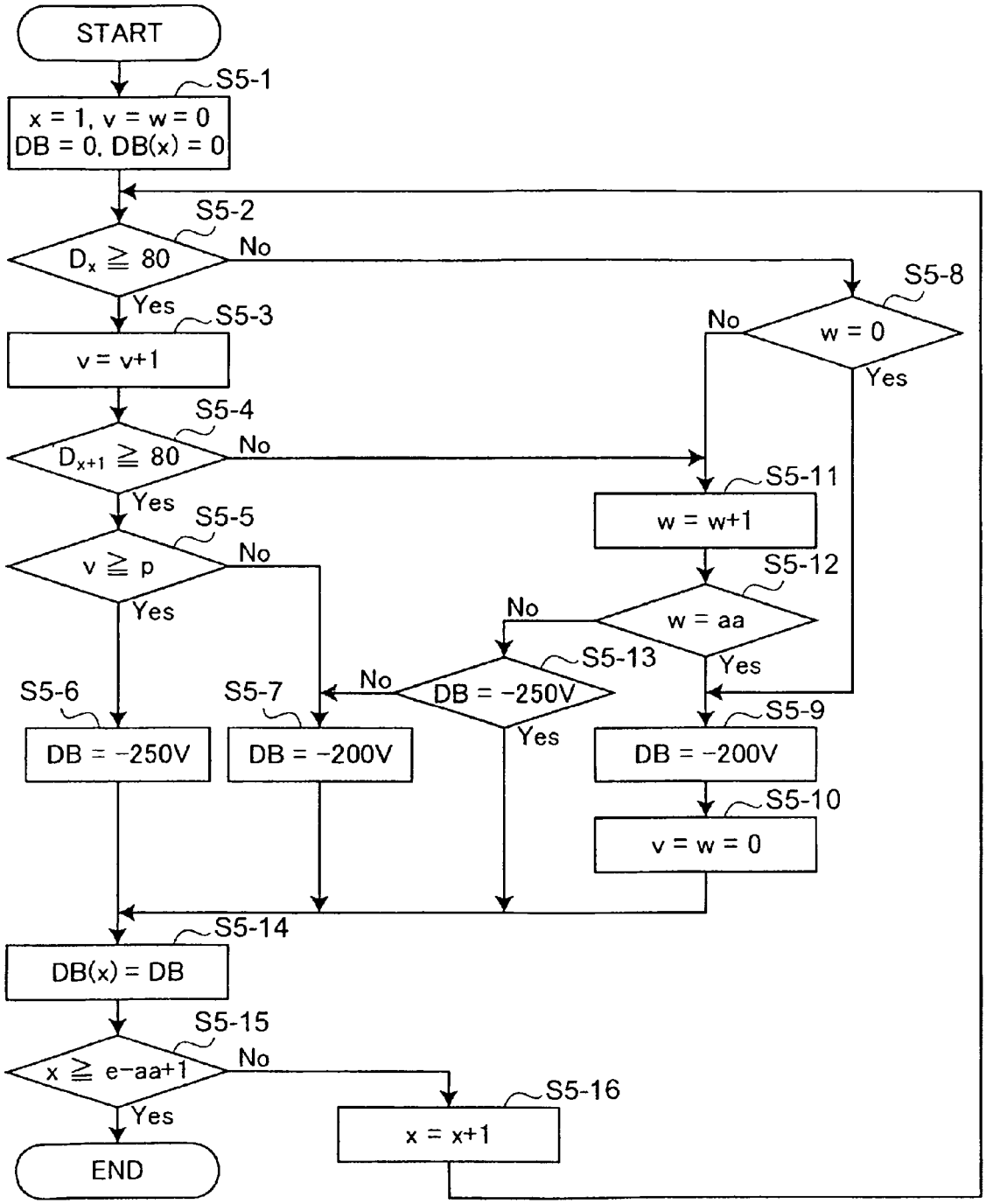
FIG. 18 is a flowchart illustrating an example procedure for calculating an image density and changing the development bias voltage according to a fifth embodiment of the present invention.

Referring to FIG. 18, an example procedure for calculating the image density D and changing the voltages is illustrated according to the fifth embodiment. When the image data are transmitted from the personal computer 23 to the image forming apparatus 24 through the interface 26, the printer controller 27 changes the image data into the bitmap as the dot data in the memory 25. Subsequently, the printer controller 27 initializes the variables v and w, the development voltage DB and the arrangement DB(x), and instructs the dot counter 28 to calculate the image density Dx (step S5-1).

Where the image density Dx is greater than or equal to eighty (80) percent (Yes in step S5-2), flow proceeds to step S5-3. In step S5-3, the printer controller 27 increments the variable v by one (1) and instructs the dot counter 28 to calculates the image density $D_{x+1}$ for a following line number x+1.

Where the image density $D_{x+1}$ is greater than or equal to eighty (80) percent (Yes in step S5-4), flow proceeds to step S5-5 in which the printer controller 27 determines whether or not the variable v is greater than or equal to the number of lines p of the DV pitch P. Where the variable v is greater than or equal to the number of lines p (Yes in step S5-5), flow proceeds to step S5-6 in which the printer controller 27 determines the output amount of the development voltage DB to be −250V. On the other hand, where the variable v is smaller than the number of lines p (No in step S5-5), flow proceeds to step S5-7 in which the printer controller 27 determines the output amount of the development voltage DB to be −200V.

Where the image density Dx is smaller than eighty (80) percent (No in step S5-2), flow proceeds to step S5-8 in which the printer controller 27 determines whether or not the variable w is zero. Where the variable w is zero (Yes in step S5-8), the printer controller 27 determines the output amount of the development voltage DB to be −200V (step S5-9) and sets the variables v and w to be zero (step S5-10).

On the other hand, where the variable w is not zero (No in step S5-8), and the image density $D_{x+1}$ is smaller than eighty (80) percent (No in step S5-4), the printer controller 27 increments the variable w by one (1) in step S5-11 and determines whether or not the incremented value of variable w is consistent with the width aa in step S5-12. Where the variable w is consistent with the width aa (Yes in step S5-12), the printer controller 27 determines the output amount of the development voltage DB to be −200V (step S5-9) and sets the variables v and w to be zero (step S5-10).

On the other hand, where the variable w is not consistent with the width aa (No in step S5-12), the printer controller 27 determines whether or not the output amount of a current development voltage DB is −250V (Step S5-13). Where the output amount of the current development voltage DB is not −250V (No in step S5-13), flow proceeds to step S5-7 in which the printer controller 27 determines the output amount of the development voltage DB to be −200V.

Where the output amount of the current development voltage DB is −250V (Yes in step S5-13), where the output amount of the voltage DB is determined to be −250V (step S5-6), where the output amount of the voltage DB is determined to be −200V (step S5-7), or where the output amount of the voltage DB is determined to be −200 in step S5-9 with setting of the variables v and w to be zero in step S5-10, flow proceeds to step S5-14. In step S5-14, the printer controller 27 stores the output amounts of the development voltage DB determined by respective steps described above to the arrangement DB(x) storing the output amounts of the voltage DB to be applied to each line number x, and instructs the power controller 30 in such a manner that the output amounts of development voltage DB become respective output amounts stored in the arrangement DB(x). Upon receiving the instruction, the power controller 30 controls the development power source 11 so as to change the output amount of the development voltage DB at a predetermined timing.

Subsequently, in step S5-15, the printer controller 27 determines whether or not the line number x is greater than e−aa+1. Where the line number x is greater than or equal to e−aa+1

(Yes in step S5-15), the process by the printer controller 27 ends. On the other hand, where the line number x is smaller than e−aa+1 (No in step S5-15), flow proceeds to step S5-16 in which the printer controller 27 increments the number x by one (1). Then, the printer controller 27 repeats a series of processes from step S5-2.

Referring to FIG. 19, the output amount of the development voltage DB in each condition is summarized. As illustrated in FIG. 19, Where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 to change the output amount of the development voltage DB from a default value of −200V to −250V.

Figure 20:
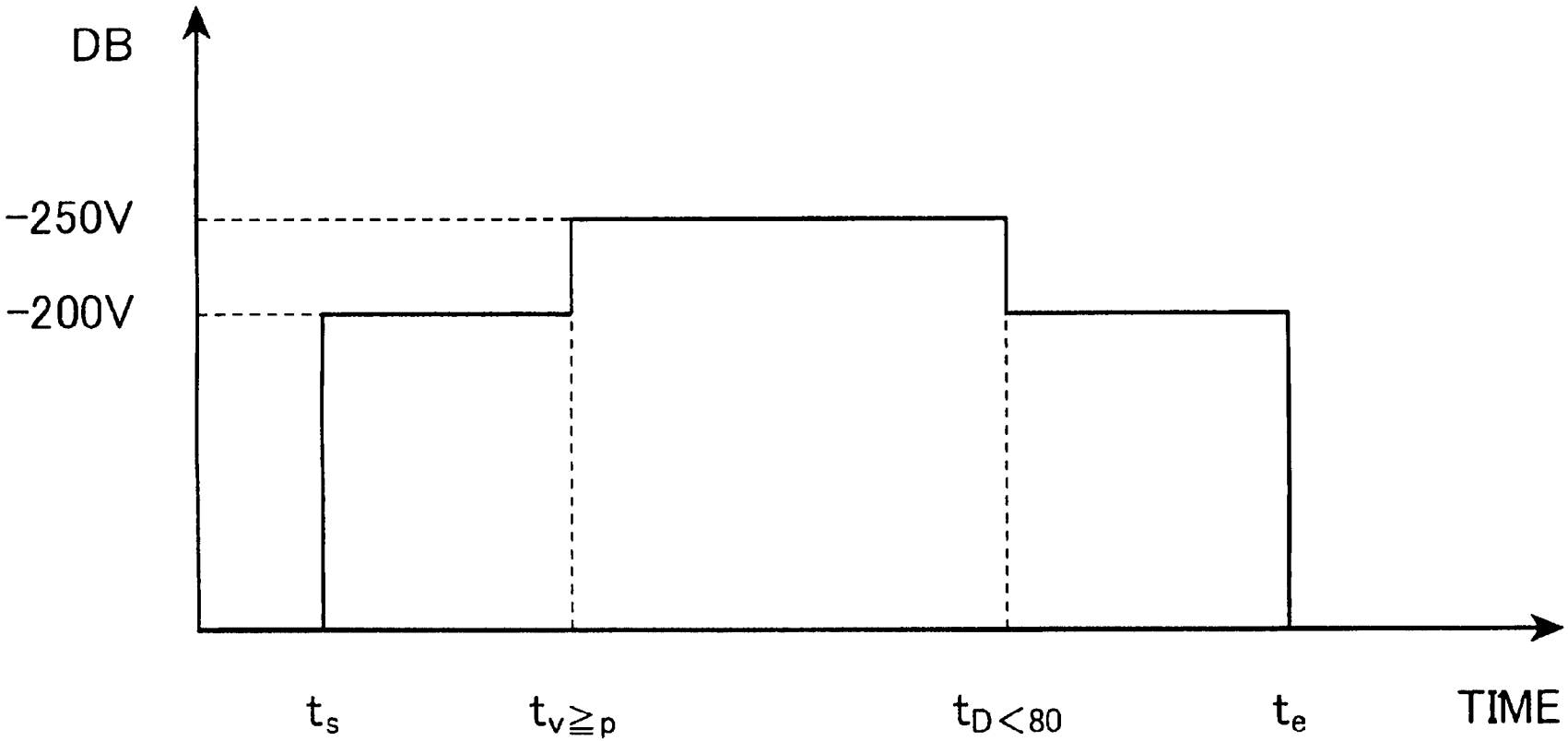
FIG. 20 is a timing diagram illustrating output change of the development bias voltage according to the fifth embodiment.

Referring to FIG. 20, a timing diagram for changing the output amount of the development voltage DB is illustrated. A vertical axis and a horizontal axis in FIG. 20 represent the output amount of the development voltage DB and time, respectively. The higher the position in the vertical axis, the greater the absolute value of the development voltage DB. The time axis includes a timing $t_s$ representing the beginning of the printing, and a timing $t_e$ representing the end of the printing. As described above with reference to FIG. 19, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 in such a manner to change the output amount of the development voltage DB to be −250V at a timing $t_{v \geqq p}$. Moreover, where the image density Dx calculated by the dot counter 28 (condition 1) or the following image density $D_{x+1}$ (condition 2) is smaller than eighty (80) percent, the printer controller 27 instructs the power controller 30 in such a manner to change the output amount of the development voltage DB back to the default value of −200V at a timing $t_{D<80}$ based on the steps S5-8 through step S5-13 in the flowchart of FIG. 18. Upon receiving the instruction, the power controller 30 controls the development power source 11 so as to change the output amount of the development voltage DB.

Referring to FIG. 21A through 21E, examples of printing images and patterns of the development voltage DB according to the fifth embodiment of the present invention are illustrated. Throughout the FIGS. 21A to 21E, each shaded region has the image density of zero percent, and each black region has the image density of at least eighty (80) percent. Each of the images in FIG. 21A through 21E is printed from the top toward the bottom thereof (i.e., the top of the image is a leading end in a printing direction, and the bottom of the image is a tailing end in the printing direction.) A graph illustrated at a right hand side of the printing image represents the output amount of the development voltage DB in a course of printing.

Figure 21A:
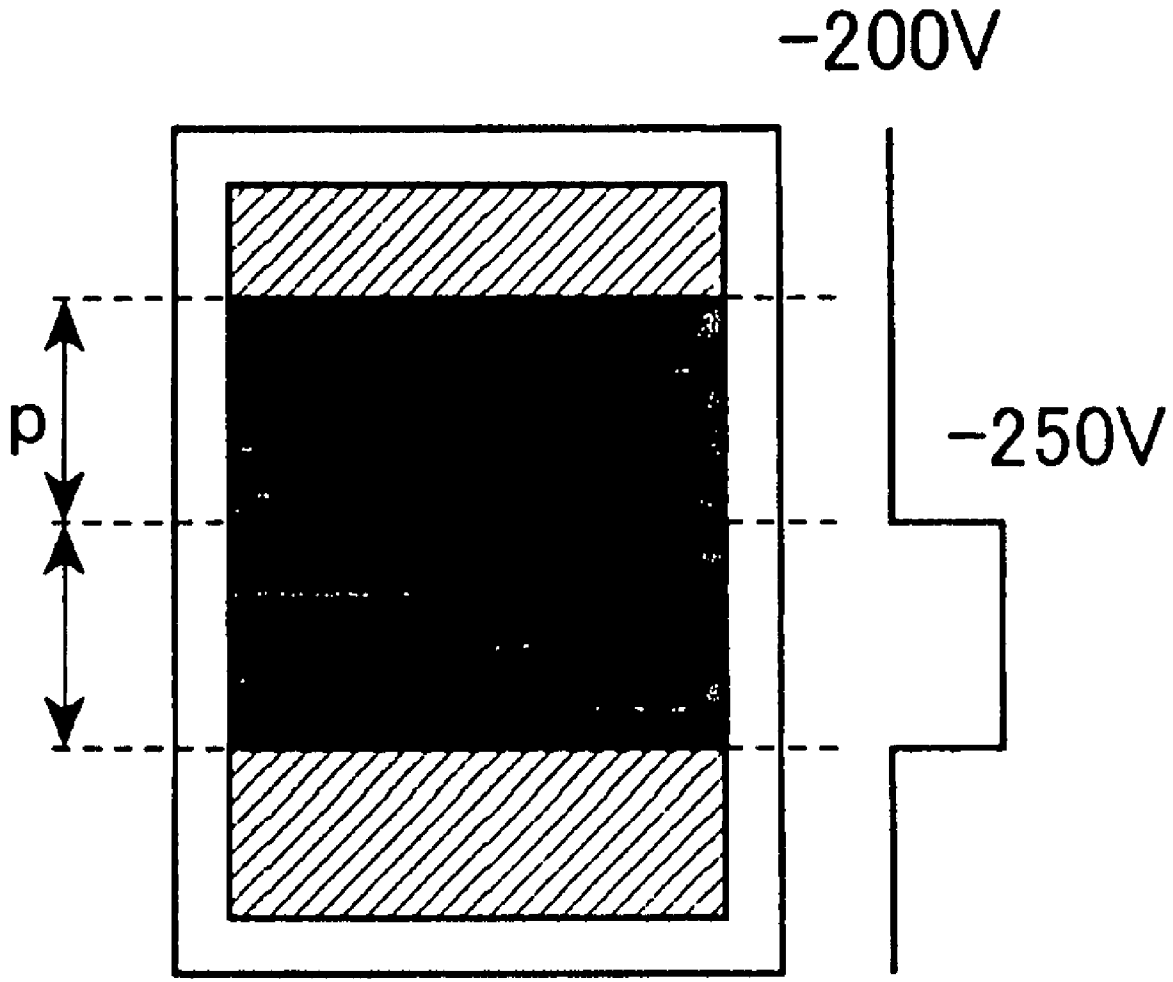
FIGS. 21A through 21E illustrate examples of printing images and patterns of the development bias voltage.

FIG. 21A illustrates a first example of the printing image and pattern of the development voltage DB according to the fifth embodiment. As shown in FIG. 21A, the printing image has two shaded regions and one black region. The two shaded regions are referred to as first and second shaded regions for the sake of simplification, and the first shaded region is disposed at the top of the printing image of FIG. 21A. The black region having the image density of eighty (80) percent is disposed between the two shaded regions each of which has the image density of zero percent, and a length of the black region is longer than that of the number of lines p. Here, the output amount of the development voltage DB is −200V from a leading end of the first shaded region to a position in which a number of lines from a leading end of the black region exceeds the number of lines p within the black region relative to the printing direction. The output amount of the development voltage DB is −250V from the position to a tailing end of the black region having the image density of eighty (80) percent. The output amount of the development voltage DB is changed back to −200V at the second shaded region having the image density of zero percent. The pattern of the output amount of the development voltage DB in FIG. 21A is similar to the table illustrated in FIG. 20.

Figure 21B:
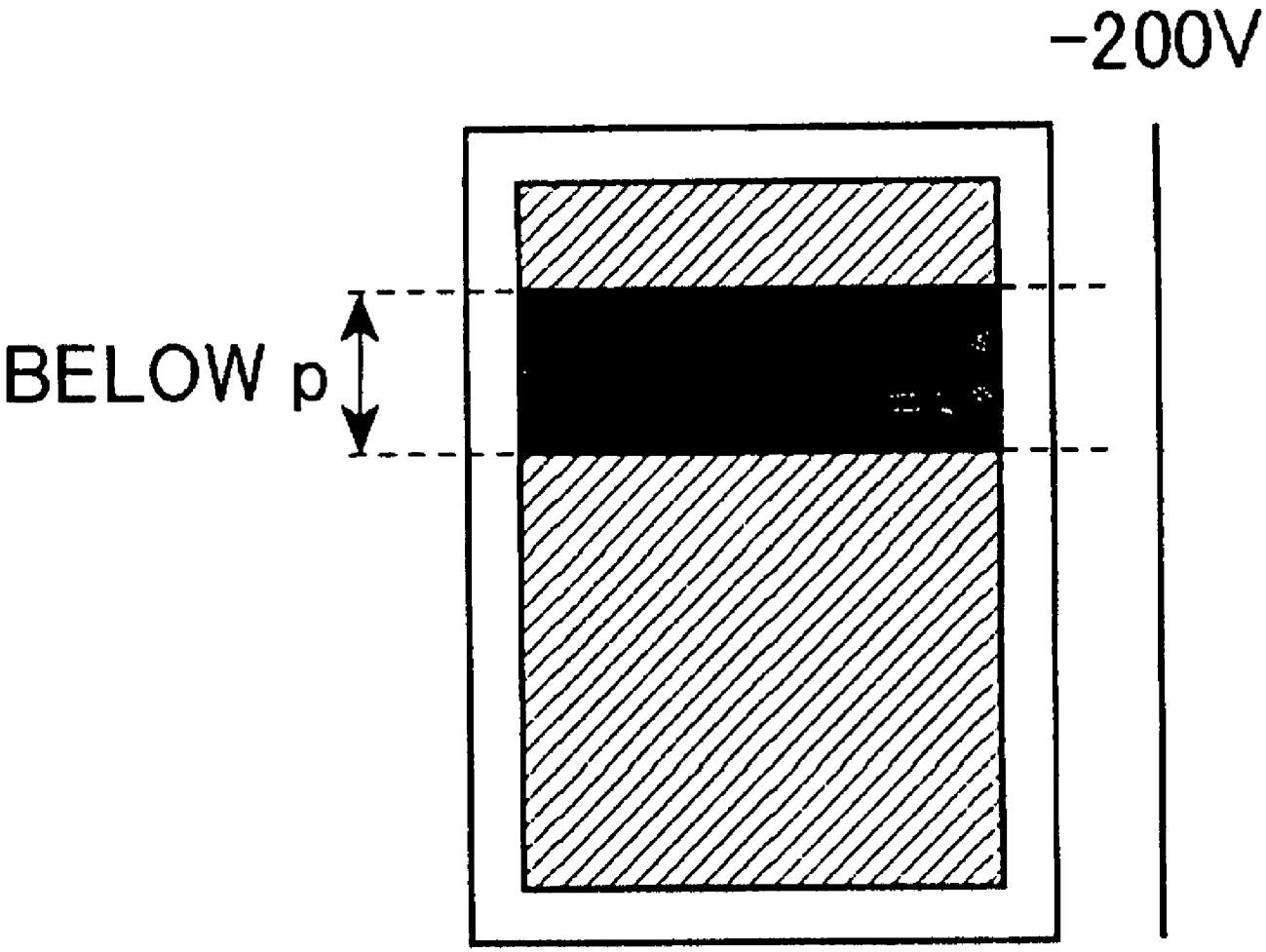

FIG. 21B illustrates a second example of the printing image and pattern of the development voltage DB according to the fifth embodiment. As shown in FIG. 21B, the printing image has two shaded regions and one black region. The two shaded regions are referred to as first and second shaded regions for the sake of simplification, and the first shaded region is disposed at the top of the printing image of FIG. 21B. The black region having the image density of eighty (80) percent is disposed between the two shaded regions each of which has the image density of zero percent, and a length of the black region is shorter than that of the number of lines p. In other words, a number of lines in the black region is smaller than the number of lines p. In such an image, the output amount of the development voltage DB is not changed and remains at −200V from the beginning to the end of the printing.

Figure 21C:
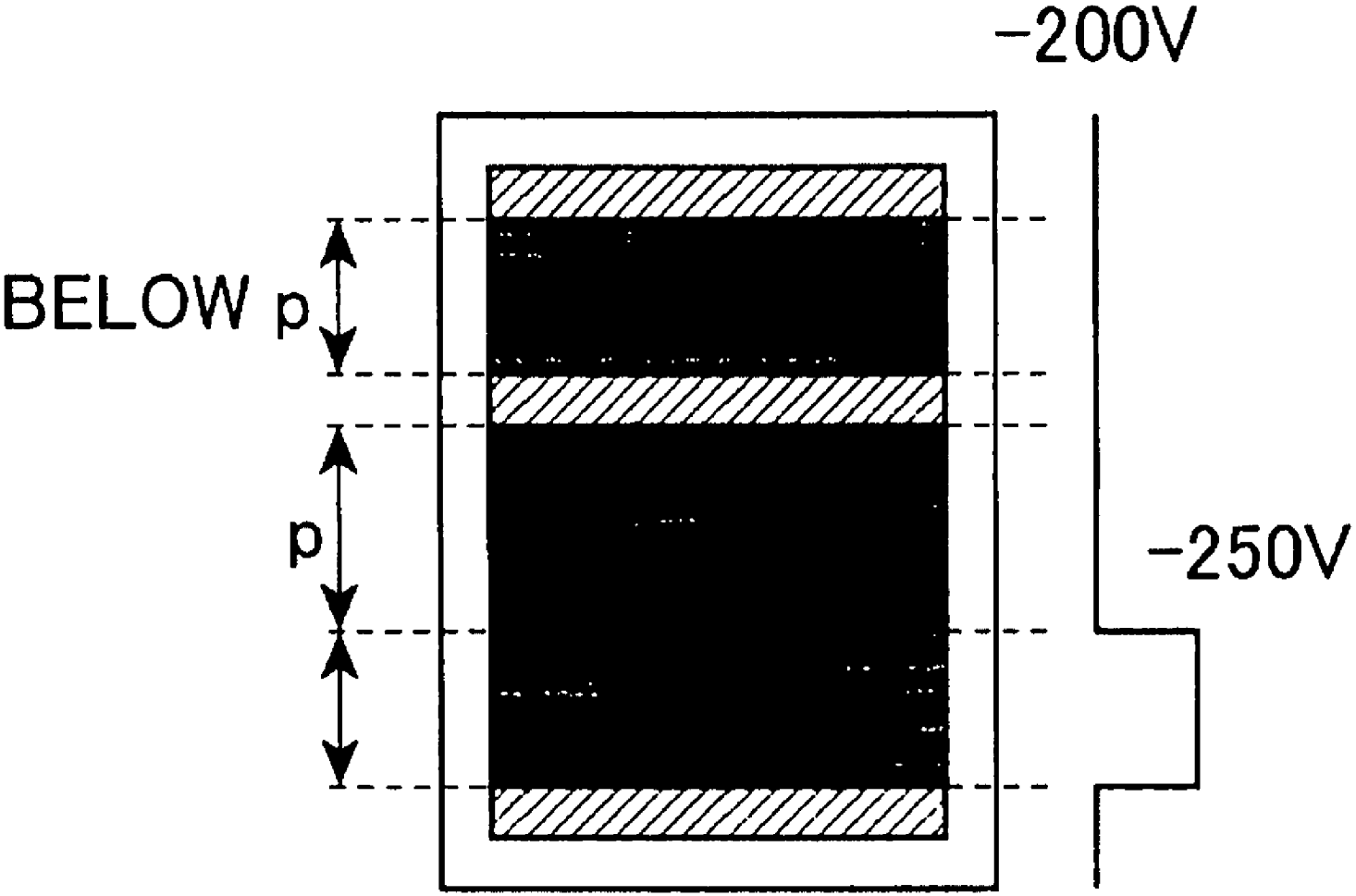

FIG. 21C illustrates a third example of the printing image and pattern of the development voltage DB according to the fifth embodiment. As shown in FIG. 21C, the printing image has three shaded regions and two black regions. The three shaded regions are referred to as first, second and third shaded regions, and the two black regions are referred to as first and second black regions for the sake of simplification. From the top of the printing image of FIG. 21C, the first shaded, first black, second shaded, second black, and third shaded regions are disposed. The first black region having the image density of eighty (80) percent is disposed between the first and second shaded regions each of which has the image density of zero percent, and a length of the first black region is shorter than that of the number of lines p. In other words, a number of lines in the first black region is smaller than the number of lines p. The second black region having the image density of eighty (80) percent is disposed between the second and third shaded regions each of which has the image density of zero percent, and a length of the second black region is longer than that of the number of lines p. In other words, a number of lines in the second black region is larger than the number of lines p. In such an image, the output amount of the development voltage DB is −200V from a leading end of the first shaded region to a position in which a number of lines from a leading end of the second black region exceeds the number of lines p therewithin. Then, the output amount of the voltage DB remains at −250V until the end of the second black region having the image density of eighty (80) percent, and is changed back to −200V at the third shaded region.

Figure 21D:
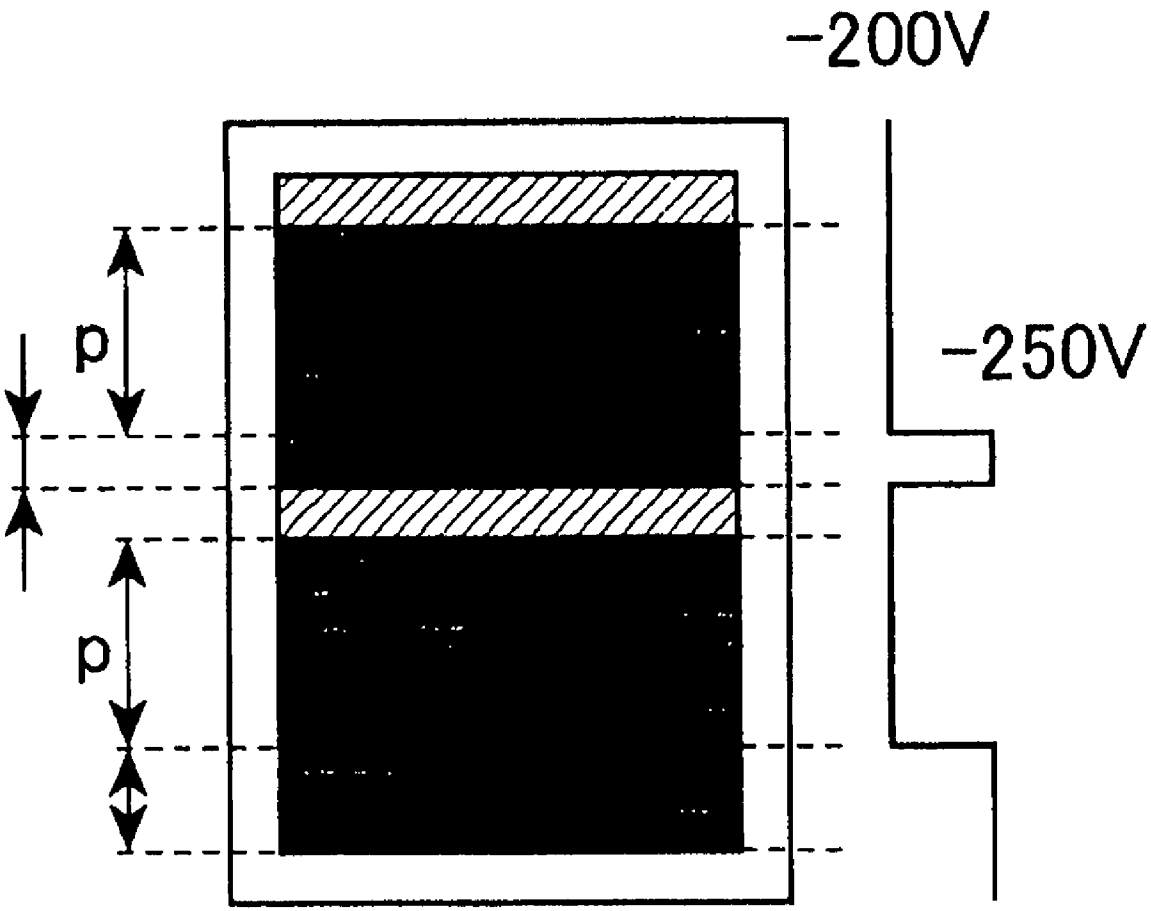

FIG. 21D illustrates a fourth example of printing image and pattern of the development voltage DB according to the fifth embodiment. As shown in FIG. 21D, the printing image has two shaded regions and two black regions. The two shaded regions are referred to as first and second shaded regions, and the two black regions are referred to as first and second black regions for the sake of simplification. From the top of the printing image illustrated in FIG. 21D, the first shaded, first black, second shaded, and second black regions are disposed. The first black region having the image density of eighty (80)

percent is disposed between the two shaded regions each of which has the image density of zero percent, and a length of the first black region is longer than that of the number of lines p. A length of the second black region is longer than that of the number of lines p. In other words, a number of lines from a leading end of each of the black regions is larger than the number of line p. In such an image, the output amount of the development voltage DB is −200V from the leading end of the first shaded region to a position in which a number of lines from the leading end of the first black region exceeds the number of lines p therewithin. The output amount of the development voltage DB is changed to −250V at the position within the first black region, and remains at −250V until the end of the first black region. The output amount of the development voltage DB is changed to −200V at the second shaded region and remains at −200V until reaching another position in which a number of lines from the leading end of the second black region exceeds the number of lines p therewithin. Then, the output amount of the voltage DB is changed to −250 at the position and remains at −250V until the end of the second black region having the image density of eighty (80) percent.

Figure 21E:
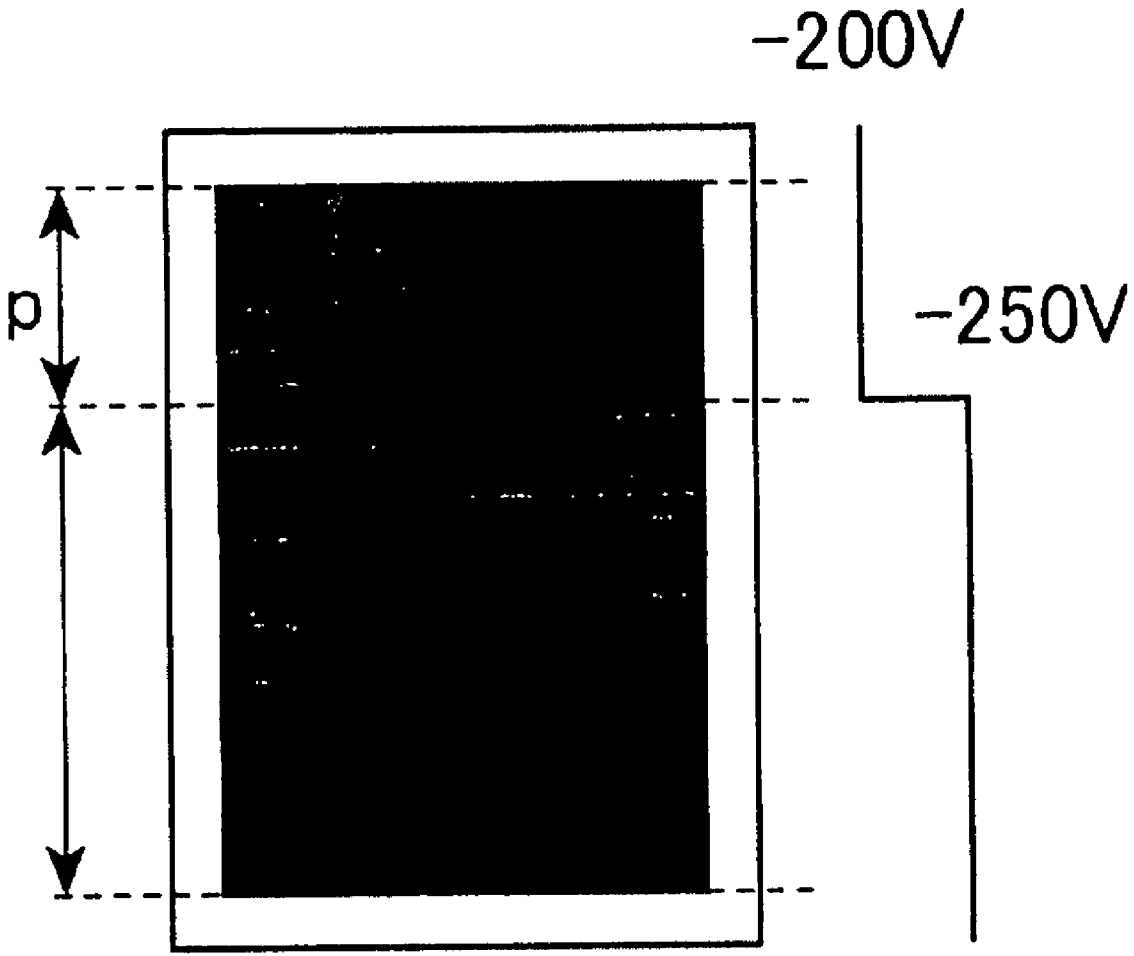

FIG. 21E illustrates a fifth example of printing image and pattern of the development voltage DB according to the fifth embodiment. The printing image has a black region having the image density of eighty (80) percent entire thereof. In such an image, the output amount of the development voltage DB is −200V from the beginning of the printing to a position in which a number of lines from a leading end of the black region exceeds the number of lines p. The output amount of the development voltage DB is changed to −250V at the position, and remains at −250V until the end of the printing.

Now, the image forming apparatus 24 capable of controlling the printing according to the fifth embodiment of the present invention was used to form a printing image such as an example image 5-1 on the A4-sized sheet (297 mm, margin 10 mm) in a portrait orientation with the density of 100 percent across the entire sheet. Similarly, another printing image such as a comparative example image 555 was formed on the A4-sized sheet with the density of 100 percent across the entire sheet in the portrait orientation by the image forming apparatus 24 without using the printing control. A leading end and a tailing end of the printing densities of each of the printing images relative to the printing direction were measured by the spectral densitometer X-Rite 528. The measurement results are explained with reference to FIG. 31.

As shown in a section of the fifth embodiment in FIG. 31, the example image 5-1 reduces or eliminates an occurrence of decreasing the printing densities relative to the leading end and tailing end of the A4-sized sheet. On the other hand, the comparative example image 555 had a blur occurrence. Therefore, the example image 5-1 had substantially no blur.

As described above, the image forming apparatus 24 according to the fifth embodiment of the present invention forms a good image without any blur by changing the voltage to be applied to the development roller 4 by the printer controller 27 based on the image density calculated by the dot counter 28.

In general, an image forming apparatus such as a printer employing an electrophotographic method tends to increase a potential difference between a potential of an exposed area on a surface of a photosensitive drum and the development voltage DB so as to increase the image density. According to the fifth embodiment, where all the exposed areas on the photosensitive drum 7 have the potential of zero, the development voltage DB without control is −200V while the development voltage DB with control according to the fifth embodiment is −250V. Therefore, the toner having a negative charge becomes easier to be transferred to all the exposed areas on the photosensitive drum 7. Consequently, an absolute amount of the toner adhering to the photosensitive drum 7 increases, thereby increasing the image density.

Sixth Embodiment

A sixth embodiment of the present invention is similar to the fifth embodiment described above with reference to the image forming apparatus, development device and block diagram in FIGS. 1 through 3. A description of elements that is already described is omitted. Compared to the fifth embodiment, the development bias voltage DB is fixed while a change of the sponge bias voltage SB is controlled according to the sixth embodiment.

Similar to the fifth embodiment, variables v and w are used to define a change timing of the sponge voltage SB. The variables v and w are integers of zero or greater. In other words, the variable v is counted when an image region of the image density Dx is changed from smaller than eighty (80) percent to greater than or equal to eighty (80) percent. The variable v corresponds to a width (a number of lines) from a leading end of the image region having the image density Dx of eighty (80) percent or above. The variable v counted from zero (v=0) to a point at which the variable v is p (v=p) represents the width of the DV pitch P. Therefore, the point becomes a timing for the output amount of the sponge voltage SB to be decreased from −350V to −400V (i.e., change timing). On the other hand, the variable w is counted when an image region of the image density Dx is changed from greater than or equal to eighty (80) percent to smaller than eighty (80) percent by extending from a boundary disposed between the image regions having the image density of greater than eighty (80) percent and smaller than eighty (80) percent. The variable w corresponds to a width (a number of lines) extending from the boundary. The variable w counted from zero (w=0) to a point at which the variable w is aa (w=aa) represents the width of the image density Dx. Therefore, the point becomes a timing for the output amount of the sponge voltage SB to be increased from −400V to −350V. According to the sixth embodiment, the output amount of the sponge voltage SB to be applied with respect to each line number x is stored in an arrangement SB(x).

Figure 22:
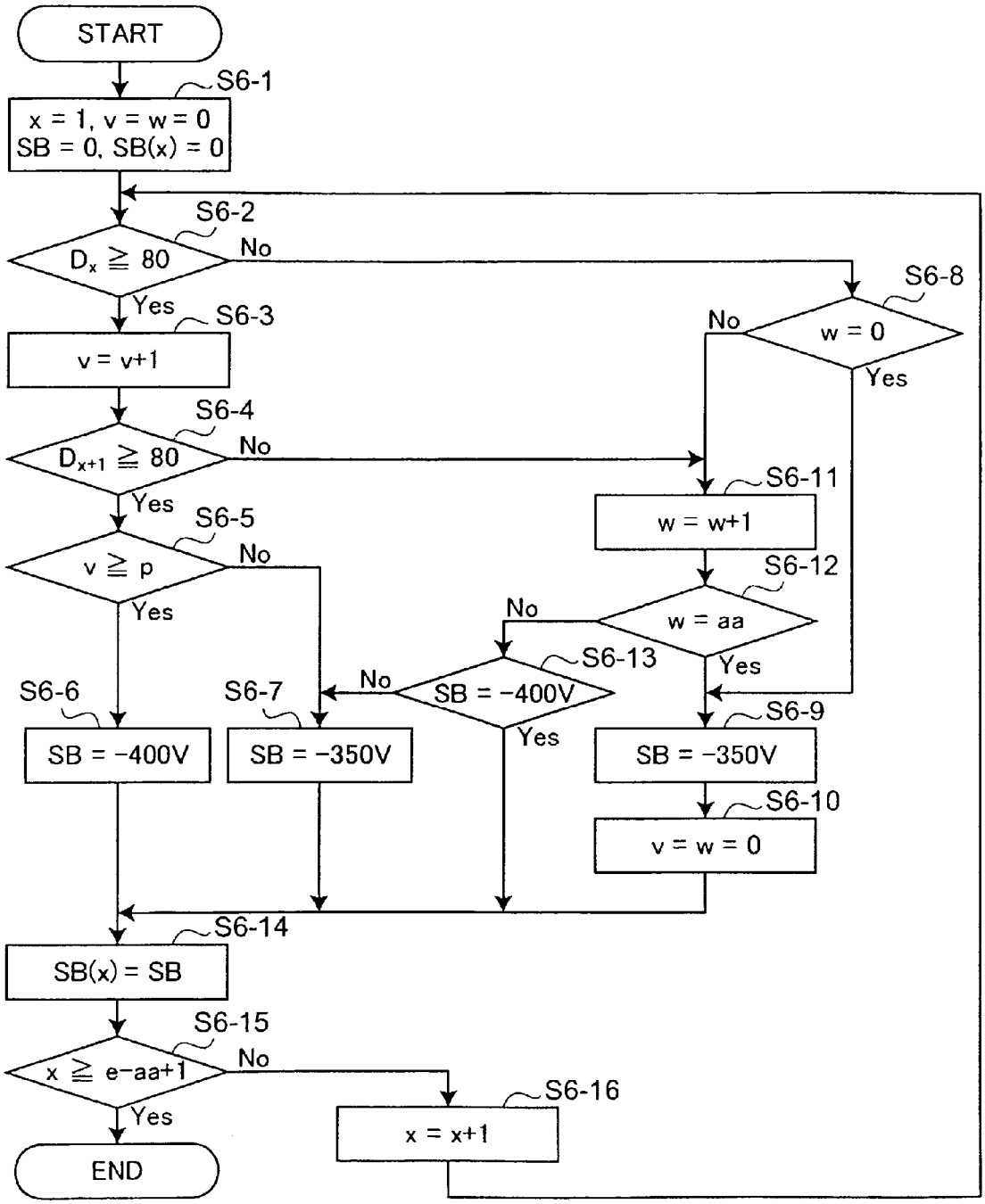
FIG. 22 is another flowchart illustrating an example procedure for calculating an image density and changing the sponge bias voltage according to a sixth embodiment of the present invention.

Referring to FIG. 22, an example procedure for calculating an image density and changing the sponge bias voltage SB according to the sixth embodiment of the present invention is illustrated. The example procedure illustrated in the flowchart of FIG. 22 is similar to that of FIG. 18 except for the output amounts of the sponge voltage SB in steps S6-6, S6-7, S6-9 and S6-13.

When the image data are transmitted from the personal computer 23 to the image forming apparatus 24 through the interface 26, the printer controller 27 changes the image data into the bitmap as the dot data in the memory 25. Subsequently, the printer controller 27 initializes the variables v and w, the sponge voltage SB and the arrangement SB(x), and instructs the dot counter 28 to calculate the image density Dx (step S6-1).

Where the image density is greater than or equal to eighty (80) percent (Yes in step S6-2), flow proceeds to step S6-3. In step S6-3, the printer controller 27 increments the variable v by one (1) and instructs the dot counter 28 to calculate the image density $D_{x+1}$ for a following line number X+1.

Where the image density $D_{x+1}$ is greater than or equal to eighty (80) percent (Yes in step S6-4), flow proceeds to step S6-5 in which the printer controller 27 determines whether or not the variable v is greater than or equal to the number of lines p. Where the variable v is greater than or equal to the number of lines p (Yes in step S6-5), flow proceeds to step S6-6 in which the printer controller 27 determines the output amount of the sponge voltage SB to be −400V. On the other hand, where the variable v is smaller than the number of lines p (No in step S6-5), flow proceeds to step S6-7 in which the printer controller 27 determines the output amount of the sponge voltage SB to be −350V.

Where the image density Dx is smaller than eighty (80) percent (No in step S6-2), flow proceeds to step S6-8 in which the printer controller 27 determines whether or not the variable w is zero. Where the variable w is zero (Yes in step S6-8), the printer controller 27 determines the output amount of the sponge voltage SB to be −350V (step S6-9) and sets the variables v and w to be zero (step S6-10).

On the other hand, where the variable w is not zero (No in step S6-8), and the image density $D_{x+1}$ is smaller than eighty (80) percent (No in step S6-4), the printer controller 27 increments the variable w by one (1) in step S6-11 and determines whether or not the incremented value of variable w is consistent with the width aa in step S6-12. Where the variable w is consistent with the width aa (Yes in step S6-12), the printer controller 27 determines the output amount of the sponge voltage SB to be −350V (step S6-9) and sets the variables v and w to be zero (step S6-10).

On the other hand, where the variable w is not consistent with the width aa (No in step S6-12), the printer controller 27 determines whether or not the output amount of a current sponge voltage DB is −400V (Step S6-13). Where the output amount of the current sponge voltage SB is not −400V (No in step S6-13), flow proceeds to step S6-7 in which the printer controller 27 determines the output amount of the sponge voltage SB to be −350V.

Where the output amount of the current sponge voltage SB is −400V (Yes in step S6-13), where the output amount of the sponge voltage SB is determined to be −400V (step S6-6), where the output amount of the sponge voltage SB is determined to be −350V (step S6-7), or where the output amount of the voltage SB is determined to be −350V (step S6-9) with setting of the variables v and w to be zero (step S6-10), flow proceeds to step S6-14. In step S6-14, the printer controller 27 stores the output amounts of the sponge voltage SB determined by respective steps described above to the arrangement SB(x) storing the output amounts of the sponge voltage SB to be applied to each line number x, and instructs the power controller 30 in such a manner that the output amounts of sponge voltage SB become respective output amounts stored in the arrangement SB(x). Upon receiving the instruction, the power controller 30 controls the developer supply power source 12 so as to change the output amount of the sponge voltage SB at a predetermined timing.

Subsequently, in step S6-15, the printer controller 27 determines whether or not the line number x is greater than e−aa+1. Where the line number x is greater than or equal to e−aa+1 (Yes in step S6-15), the process by the printer controller 27 ends. On the other hand, where the line number x is smaller than e−aa+1 (No in step S6-15), flow proceeds to step S6-16 in which the printer controller 27 increments the number x by one (1). Then, the printer controller 27 repeats a series of processes from step S6-2.

Referring to FIG. 23, the change of the sponge voltage SB according to the sixth embodiment is summarized. As illustrated in FIG. 23, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 to change the output amount of the sponge voltage SB from a default value of −350V to −400V.

Figure 24:
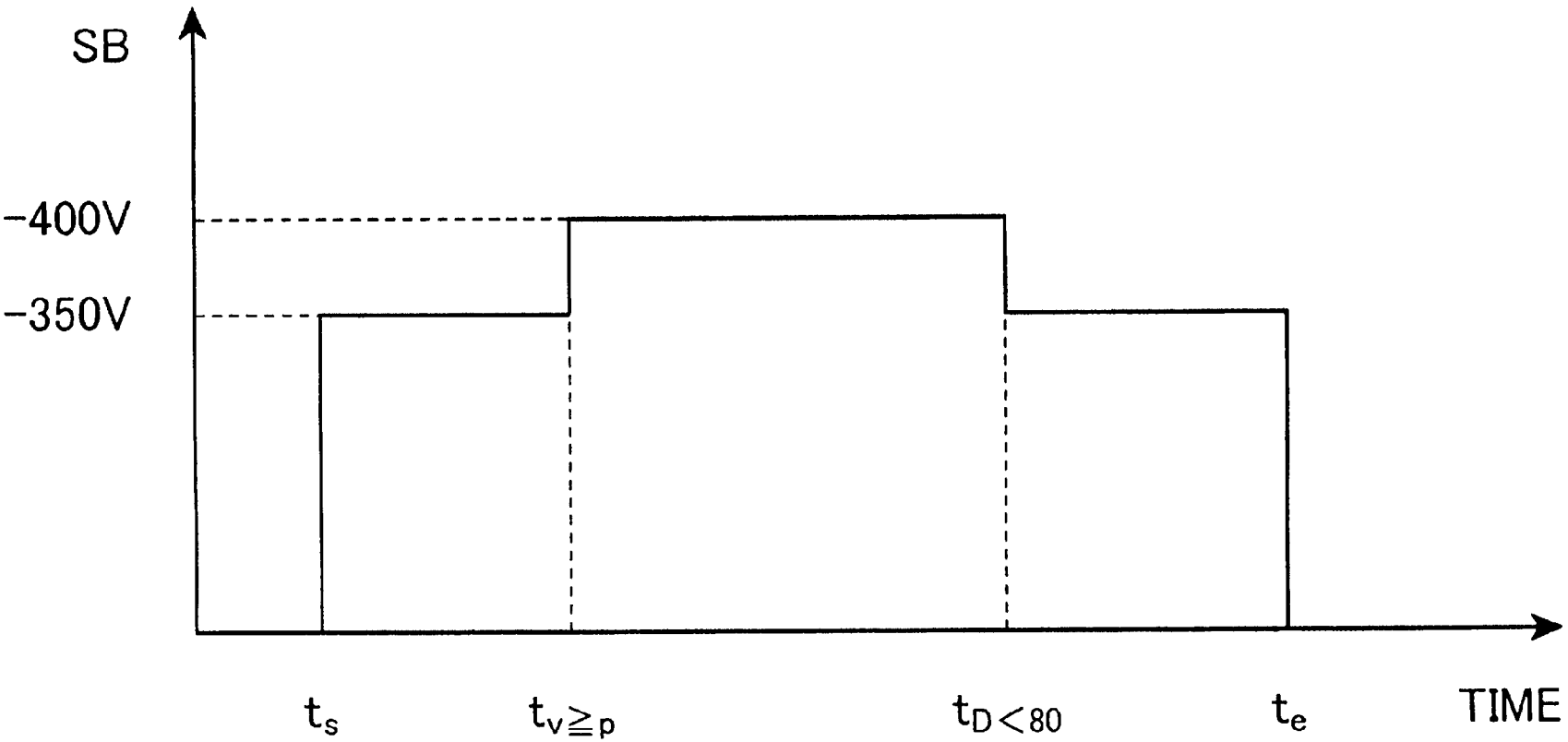
FIG. 24 is a timing diagram illustrating the output change of the sponge bias voltage according to the sixth embodiment.

Referring to FIG. 24, a timing diagram for changing the output amount of the sponge voltage SB is illustrated. A vertical axis and a horizontal axis in FIG. 24 represent the output amount of the sponge voltage SB and time, respectively. The higher the position in the vertical axis, the greater the absolute value of the sponge voltage SB. The time axis includes a timing $t_s$ representing the beginning of the printing, and a timing $t_e$ representing the end of the printing. As described above with reference to FIG. 23, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 in such a manner to change the output amount of the sponge voltage SB to be −400V at a timing $t_{v \geqq p}$. Moreover, where the image density Dx calculated by the dot counter 28 (condition 1) or the following image density $D_{x+1}$ (condition 2) is smaller than eighty (80) percent, the printer controller 27 instructs the power controller 30 in such a manner to change the output amount of the sponge voltage SB back to the default value of −350V at a timing $t_{D<80}$ based on the steps S6-8 through step S6-13 in the flowchart of FIG. 22. Upon receiving the instruction, the power controller 30 controls the developer supply power source 12 so as to change the output amount of the sponge voltage SB.

Now, the image forming apparatus 24 capable of controlling the printing according to the sixth embodiment of the present invention was used to form a printing image such as an example image 6-1 on the A4-sized sheet (297 mm, margin 10 mm) in a portrait orientation with the density of 100 percent across the entire sheet. Similarly, another printing image such as a comparative example image 666 was formed on the A4-sized sheet with the density of 100 percent across the entire sheet in the portrait orientation by the image forming apparatus 24 without using the printing control. A leading end and a tailing end of the printing densities of each of the printing images relative to the printing direction were measured by the spectral densitometer X-Rite 528. The measurement results are explained with reference to FIG. 31.

As shown in a section of the sixth embodiment in FIG. 31, the example image 6-1 reduces or eliminates an occurrence of decreasing the printing densities relative to the leading end and tailing end of the A4-sized sheet. On the other hand, the comparative example image 666 had a blur occurrence. Therefore, the example image 6-1 had substantially no blur.

Therefore, the image forming apparatus 24 according to the sixth embodiment of the present invention forms a good image without any blur by changing the voltage to be applied to the sponge roller 3 by the printer controller 27 based on the image density calculated by the dot counter 28.

In general, an image forming apparatus such as a printer employing an electrophotographic method tends to increase a potential difference between a potential of an exposed area on a surface of a photosensitive drum and the sponge voltage SB so as to increase the image density. According to the sixth embodiment, where all the exposed areas on the photosensitive drum 7 have the potential of zero, the sponge voltage SB without control is −350V while the sponge voltage SB with control according to the sixth embodiment is −400V. Therefore, the toner having a negative charge becomes easier to be transferred to all the exposed areas on the photosensitive drum 7. Consequently, an absolute amount of the toner adhering to the photosensitive drum 7 increases, thereby increasing the image density.

Seventh Embodiment

A seventh embodiment of the present invention is similar to the fifth and sixth embodiments described above with reference to the image forming apparatus, development device and block diagram in FIGS. 1 through 3. A description of elements that is already described is omitted. Compared to the fifth and sixth embodiments, according to the seventh embodiment, each of the development bias voltage DB and the sponge bias voltage SB is changed, and an absolute value of a potential difference (hereafter referred to as an absolute value DS) between the development voltage DB and the sponge voltage SB is controlled. In the seventh embodiment, the development voltage DB has a default value of −200V and an output amount of −250 after being changed thereof. The sponge voltage SB has a default value of −350V and an output amount of −450V after being changed thereof. Therefore, the absolute value DS has a default value of 150V and an output amount of 200V after the development and sponge voltages DB and SB are changed.

Similar to the fifth and sixth embodiments, variables v and w are used to define a change timing of the absolute value DS in the seventh embodiment. The variables v and w are integers of zero or greater. In other words, the variable v is counted when an image region of the image density Dx is changed from smaller than eighty (80) percent to greater than or equal to eighty (80) percent. The variable v corresponds to a width (a number of lines) from a leading end of the image region having the image density Dx of eighty (80) percent or above. The variable v counted from zero (v=0) to a point at which the variable v is p (v=p) represents the width of the DV pitch P. Therefore, the point becomes a timing for the output amount of the absolute value DS to be increased from 150V to 200V. On the other hand, the variable w is counted when an image region of the image density Dx is changed from greater than or equal to eighty (80) percent to smaller than eighty (80) percent by extending from a boundary disposed between the image regions having the image density of greater than eighty (80) percent and smaller than eighty (80) percent. The variable w corresponds to a width (a number of lines) extending from the boundary. The variable w counted from zero (w=0) to a point at which the variable w is aa (w=aa) represents the width of the image density Dx. Therefore, the point becomes a timing for the output amount of the absolute value DS to be decreased from 200V to 150V. According to the seventh embodiment, the output amounts of the development and sponge voltages DB and SB to be applied with respect to each line number x are stored in a two-dimensional arrangement DS(x) that is represented as the two-dimensional arrangement DS(x)=(DB, DS)

Figure 25:
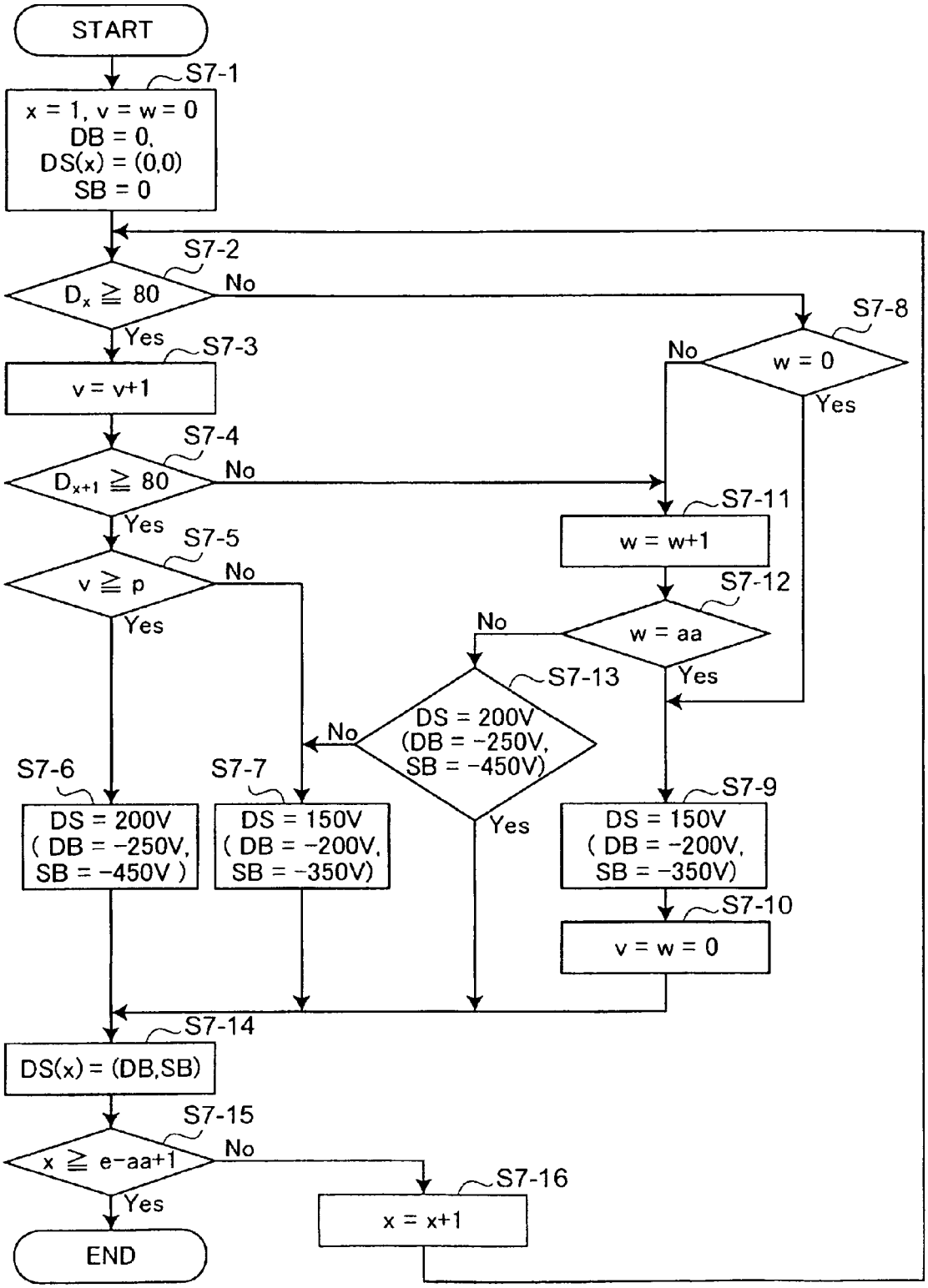
FIG. 25 is a flowchart illustrating an example procedure for calculating an image density and changing voltages to be applied according to a seventh embodiment of the present invention.

Referring to FIG. 25, an example procedure for calculating an image density and changing the voltages to be applied according to the seventh embodiment of the present invention is illustrated. The example procedure illustrated in the flowchart of FIG. 25 is similar to that of FIG. 22 except for the output amounts of the absolute value DS in steps S7-6, S7-7, S7-9 and S7-13.

When the image data are transmitted from the personal computer 23 to the image forming apparatus 24 through the interface 26, the printer controller 27 changes the image data into the bitmap as the dot data in the memory 25. Subsequently, the printer controller 27 initializes the variables v and w, the development voltage DB, the sponge voltage SB and the arrangement DS(x), and instructs the dot counter 28 to calculate the image density Dx (step S7-1).

Where the image density is greater than or equal to eighty (80) percent (Yes in step S7-2), flow proceeds to step S7-3. In step S7-3, the printer controller 27 increments the variable v by one (1) and instructs the dot counter 28 to calculate the image density $D_{x+1}$ for a following line number x+1.

Where the image density $D_{x+1}$ is greater than or equal to eighty (80) percent (Yes in step S7-4), flow proceeds to step S7-5 in which the printer controller 27 determines whether or not the variable v is greater than or equal to the number of lines p. Where the variable v is greater than or equal to the number of lines p (Yes in step S7-5), flow proceeds to step S7-6 in which the printer controller 27 determines the output amount of the absolute value DS to be 200V. On the other hand, where the variable v is smaller than the number of lines p (No in step S7-5), flow proceeds to step S7-7 in which the printer controller 27 determines the output amount of the absolute value DS to be 150V.

Where the image density Dx is smaller than eighty (80) percent (No in step S7-2), flow proceeds to step S7-8 in which the printer controller 27 determines whether or not the variable w is zero. Where the variable w is zero (Yes in step S7-8), the printer controller 27 determines the output amount of the absolute value DS to be 150V (step S7-9) and sets the variables v and w to be zero (step S7-10).

On the other hand, where the variable w is not zero (No in step S7-8), and the image density $D_{x+1}$ is smaller than eighty (80) percent (No in step S7-4), the printer controller 27 increments the variable w by one (1) in step S7-11 and determines whether or not the incremented value of variable w is consistent with the width aa in step S7-12. Where the variable w is consistent with the width aa (Yes in step S7-12), the printer controller 27 determines the output amount of the absolute value DS to be 150V (step S7-9) and sets the variables v and w to be zero (step S7-10).

On the other hand, where the variable w is not consistent with the width aa (No in step S7-12), the printer controller 27 determines whether or not the output amount of a current absolute value DS is 200V (Step S7-13). Where the output amount of the current absolute value DS is not 200V (No in step S7-13), flow proceeds to step S7-7 in which the printer controller 27 determines the output amount of the absolute value DS to be 150V.

Where the output amount of the current absolute value DS is 200V (Yes in step S7-13), where the output amount of the absolute value DS is determined to be 200V (step S7-6), where the output amount of the absolute value DS is determined to be 150V (step S7-7), or where the output amount of the absolute value DS is determined to be 150V (step S7-9) with setting of the variables v and w to be zero (step S7-10), flow proceeds to step S7-14. In step S7-14, the printer controller 27 stores the output amounts of the development and sponge voltages DB and SB of the absolute values DS determined by respective steps described above to the arrangement DS(x) storing the output amounts of the development and the sponge voltages DB and SB of the absolute values DS to be applied to each line number x. The power controller 27 also instructs the power controller 30 in such a manner that the output amounts of the development and sponge voltages DB and SB of the absolute values DS become respective output amounts stored in the arrangement DS(x). Upon receiving the instruction, the power controller 30 controls the development power source 11 and the developer supply power source 12 so as to change the output amount of the absolute value DS at a predetermined timing.

Subsequently, in step S7-15, the printer controller 27 determines whether or not the line number x is greater than e−aa+1. Where the line number x is greater than or equal to e−aa+1 (Yes in step S7-15), the process by the printer controller 27 ends. On the other hand, where the line number x is smaller than e−aa+1 (No in step S7-15), flow proceeds to step S7-16 in which the printer controller 27 increments the number x by one (1). Then, the printer controller 27 repeats a series of processes from step S7-2.

Referring to FIG. 26, process conditions for changing the output amount of absolute value DS 150V to the value of −200V according to the seventh embodiment are summarized. As illustrated in FIG. 26, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 to change the output amount of the absolute value DS from the default value of 150V to the post-changing value of 200V.

Figure 27A:
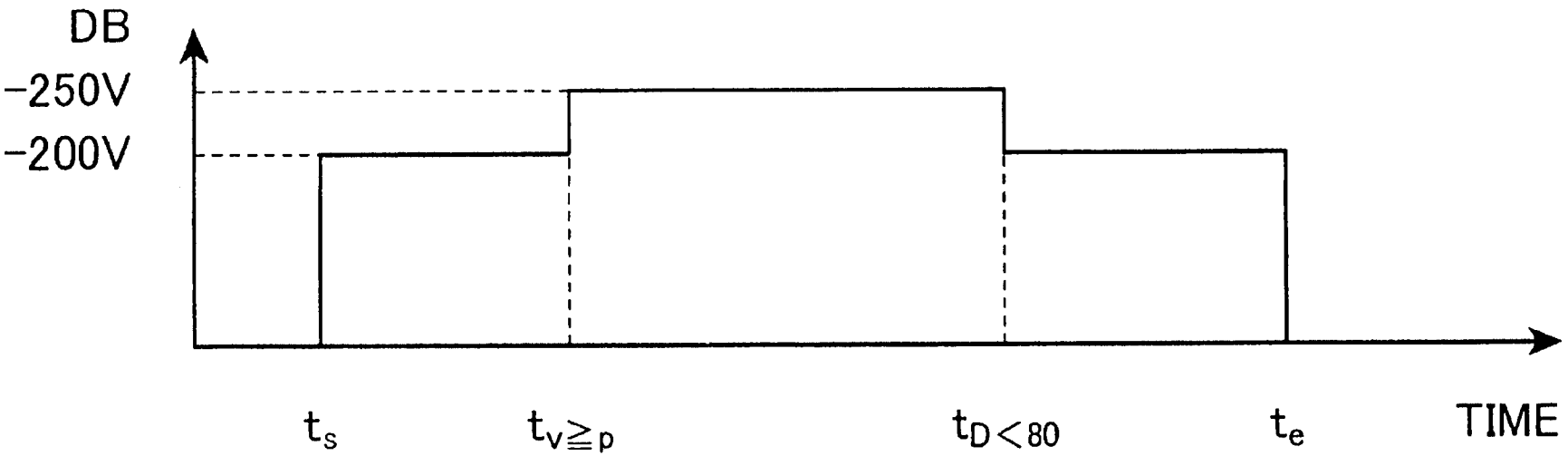
FIG. 27A is a timing diagram illustrating the output change of the development bias voltages according to the seventh embodiment.
Figure 27B:
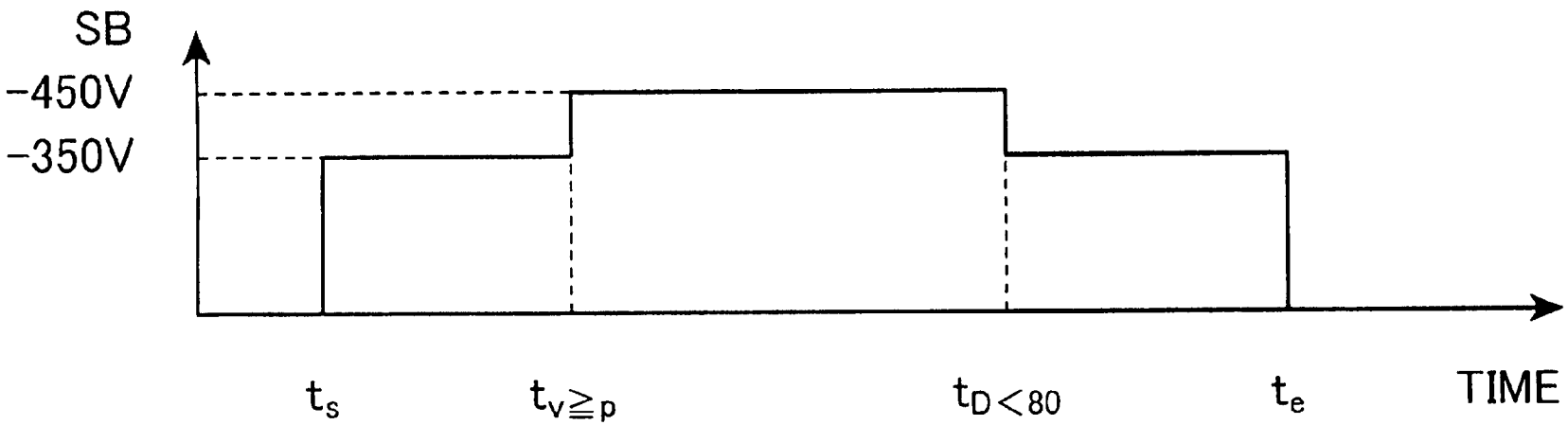
FIG. 27B is a timing diagram illustrating the output change of the sponge bias voltages according to the seventh embodiment.

Referring to FIG. 27A and 27B, the output changes of the development voltage DB and the sponge voltage SB are respectively illustrated in timing diagrams to explain the change of the output amount of the absolute value DS according to the seventh embodiment of the present invention. In other words, the timing diagrams in FIGS. 27A and 27B illustrate the output change of the absolute value DS based on the change of the development voltage DB and the sponge voltage SB. The vertical axes in FIGS. 27A and 27B represent the output of the development voltage DB and sponge voltage SB, respectively. The higher the positions in the vertical axes in FIGS. 27A and 27B, the greater the absolute values of the development voltage DB and the sponge voltage SB, respectively. Each horizontal axis in FIGS. 27A and 27B represents time that includes a timing $t_s$ representing the beginning of the printing and a timing $t_e$ representing the end of the printing. As described above with reference to FIG. 26, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 in such a manner to change the output amount of the absolute value DS to be 200V at a timing $t_{v \geqq p}$. Moreover, where the image density Dx calculated by the dot counter 28 (condition 1) or the following image density $D_{x+1}$ (condition 2) is smaller than eighty (80) percent, the printer controller 27 instructs the power controller 30 in such a manner to change the output amount of the absolute value DS back to the default value of 150V at a timing $t_{D<80}$ based on the steps S7-8 through step S7-13 in the flowchart of FIG. 25. Upon receiving the instruction, the power controller 30 controls the development power source 11 and developer supply power source 12 so as to change the output amount of the absolute value DS.

Now, the image forming apparatus 24 capable of controlling the printing according to the seventh embodiment of the present invention was used to form a printing image such as an example image 7-1 on the A4-sized sheet (297 mm, margin 10 mm) in a portrait orientation with the density of 100 percent across the entire sheet. Similarly, another printing image such as a comparative example image 777 was formed on the A4-sized sheet with the density of 100 percent across the entire sheet in the portrait orientation by the image forming apparatus 24 without using the printing control. A leading end and a tailing end of the printing densities of each of the printing images relative to the printing direction were measured by the spectral densitometer X-Rite 528. The measurement results are explained with reference to FIG. 31.

As shown in a section of the seventh embodiment in FIG. 31, the example image 7-1 reduces or eliminates an occurrence of decreasing the printing densities relative to the leading end and tailing end of the A4-sized sheet. On the other hand, the comparative example image 777 had a blur occurrence. Therefore, the example image 7-1 had substantially no blur.

Eighth Embodiment

An eighth embodiment of the present invention is similar to the seventh embodiment described above with reference to the image forming apparatus, development device and block diagram in FIGS. 1 through 3. A description of elements that is already described is omitted. Similar to the seventh embodiment, each of the development bias voltage DB and the sponge bias voltage SB is changed, and an absolute value of a potential difference (hereafter referred to as an absolute value DS) between the development voltage DB and the sponge voltage SB is controlled in the eighth embodiment. However, according to the eighth embodiment, the development voltage DB has a default value of −200V and an output amount of −175V after being changed thereof. The sponge voltage SB has a default value of −350V and an output amount of −425V after being changed thereof. Therefore, the absolute value DS has a default value of 150V and an output amount of 250V after changing the development and sponge voltages DB and SB.

In the eighth embodiment, variables v and w are used to define a change timing of the absolute value DS as similar to the seventh embodiment. The variables v and w are integers of zero or greater. In other words, the variable v is counted when an image region of the image density Dx is changed from smaller than eighty (80) percent to greater than or equal to eighty (80) percent. The variable v corresponds to a width (a number of lines) from a leading end of the image region having the image density Dx of eighty (80) percent or above. The variable v counted from zero (v=0) to a point at which the variable v is p (v=p) represents the width of the DV pitch P. Therefore, the point becomes a timing for the output amount of the absolute value DS to be increased from 150V to 200V. On the other hand, the variable w is counted when an image region of the image density Dx is changed from greater than or equal to eighty (80) percent to smaller than eighty (80) percent by extending from a boundary disposed between the image regions having the image density of greater than eighty (80) percent and smaller than eighty (80) percent. The variable w corresponds to a width (a number of lines) extending from the boundary. The variable w counted from zero (w=0) to a point at which the variable w is aa (w=aa) represents the width of the image density Dx. Therefore, the point becomes a timing for the output amount of the absolute value DS to be decreased from 250V to 150V. According to the eighth embodiment, the output amounts of the development and sponge voltages DB and SB to be applied with respect to each line number x are stored in a two-dimensional arrangement DS(x) that is represented as the two-dimensional arrangement DS(x)=(DB, DS).

Figure 28:
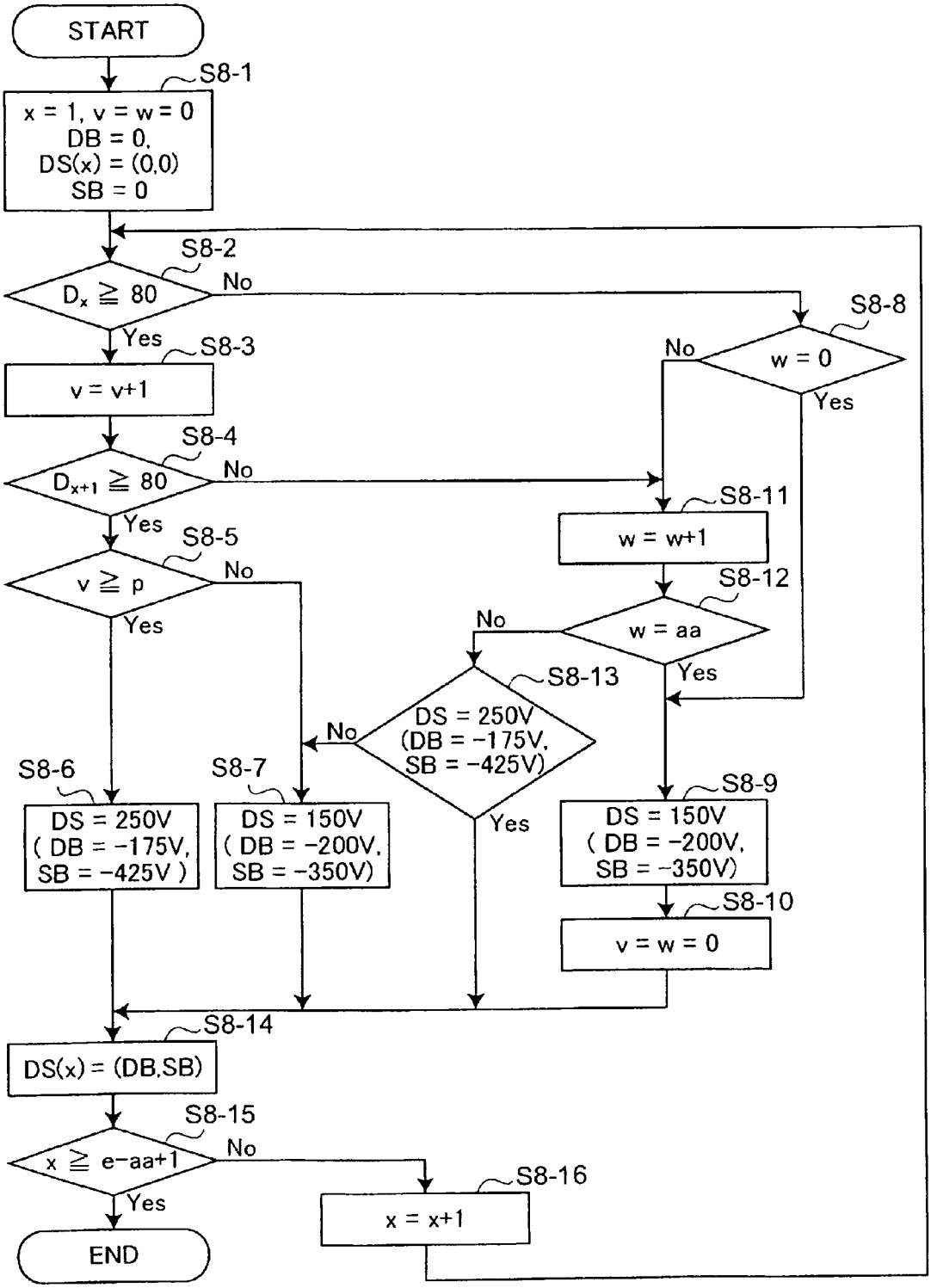
FIG. 28 is another flowchart illustrating an example procedure for calculating an image density and changing voltages to be applied according to an eighth embodiment of the present invention.

Referring to FIG. 28, an example procedure for calculating an image density and changing the voltages to be applied according to the eighth embodiment of the present invention is illustrated. The example procedure illustrated in the flowchart of FIG. 28 is similar to that of FIG. 25 except for the output amounts of the absolute value DS in steps S8-6 and S8-13.

When the image data are transmitted from the personal computer 23 to the image forming apparatus 24 through the interface 26, the printer controller 27 changes the image data into the bitmap as the dot data in the memory 25. Subsequently, the printer controller 27 initializes the variables v and w, the development voltage DB, the sponge voltage SB and the arrangement DS(x), and instructs the dot counter 28 to calculate the image density Dx (step S8-1).

Where the image density is greater than or equal to eighty (80) percent (Yes in step S8-2), flow proceeds to step S8-3. In step S8-3, the printer controller 27 increments the variable v by one (1) and instructs the dot counter 28 to calculate the image density $D_{x+1}$ for a following line number x+1.

Where the image density $D_{x+1}$ is greater than or equal to eighty (80) percent (Yes in step S8-4), flow proceeds to step S8-5 in which the printer controller 27 determines whether or not the variable v is greater than or equal to the number of lines p. Where the variable v is greater than or equal to the number of lines p (Yes in step S8-5), flow proceeds to step S8-6 in which the printer controller 27 determines the output amount of the absolute value DS to be 250V. On the other hand, where the variable v is smaller than the number of lines p (No in step S8-5), flow proceeds to step S8-7 in which the printer controller 27 determines the output amount of the absolute value DS to be 150V.

Where the image density Dx is smaller than eighty (80) percent (No in step S8-2), flow proceeds to step S8-8 in which the printer controller 27 determines whether or not the variable w is zero. Where the variable w is zero (Yes in step S8-8), the printer controller 27 determines the output amount of the absolute value DS to be 150V (step S8-9) and sets the variables v and w to be zero (step S7-10).

On the other hand, where the variable w is not zero (No in step S8-8), and the image density $D_{x+1}$ is smaller than eighty (80) percent (No in step S8-4), the printer controller 27 increments the variable w by one (1) in step S8-11 and determines whether or not the incremented value of variable w is consistent with the width aa in step S8-12. Where the variable w is consistent with the width aa (Yes in step S8-12), the printer controller 27 determines the output amount of the absolute value DS to be 150V (step S8-9) and sets the variables v and w to be zero (step S8-10).

On the other hand, where the variable w is not consistent with the width aa (No in step S8-12), the printer controller 27 determines whether or not the output amount of a current absolute value DS is 250V (Step S8-13). Where the output amount of the current absolute value DS is not 250V (No in step S8-13), flow proceeds to step S8-7 in which the printer controller 27 determines the output amount of the absolute value DS to be 150V.

Where the output amount of the current absolute value DS is 250V (Yes in step S8-13), where the output amount of the absolute value DS is determined to be 250V (step S8-6), where the output amount of the absolute value DS is determined to be 150V (step S8-7), or where the output amount of the absolute value DS is determined to be 150V (step S8-9) with setting of the variables v and w to be zero (step S8-10), flow proceeds to step S8-14. In step S8-14, the printer controller 27 stores the output amounts of the development and sponge voltages DB and SB of the absolute values DS determined by respective steps described above to the arrangement DS(x) storing the output amounts of the development and the sponge voltages DB and SB of the absolute values DS to be applied to each line number x. The power controller 27 also instructs the power controller 30 in such a manner that the output amounts of the development and sponge voltages DB and SB of the absolute values DS become respective output amounts stored in the arrangement DS(x). Upon receiving the instruction, the power controller 30 controls the development power source 11 and the developer supply power source 12 so as to change the output amount of the absolute value DS at a predetermined timing.

Subsequently, in step S8-15, the printer controller 27 determines whether or not the line number x is greater than e−aa+1. Where the line number x is greater than or equal to e−aa+1 (Yes in step S8-15), the process by the printer controller 27 ends. On the other hand, where the line number x is smaller than e−aa+1 (No in step S8-15), flow proceeds to step S8-16 in which the printer controller 27 increments the number x by one (1). Then, the printer controller 27 repeats a series of processes from step S8-2.

Referring to FIG. 29, process conditions for changing the output amount of absolute value DS from the default value of 150V to the post-changing value of 250V according to the eighth embodiment are summarized. As illustrated in FIG. 29, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 to change the output amount of the absolute value DS from the default value of 150V to the post-changing value of 250V.

Figure 30A:
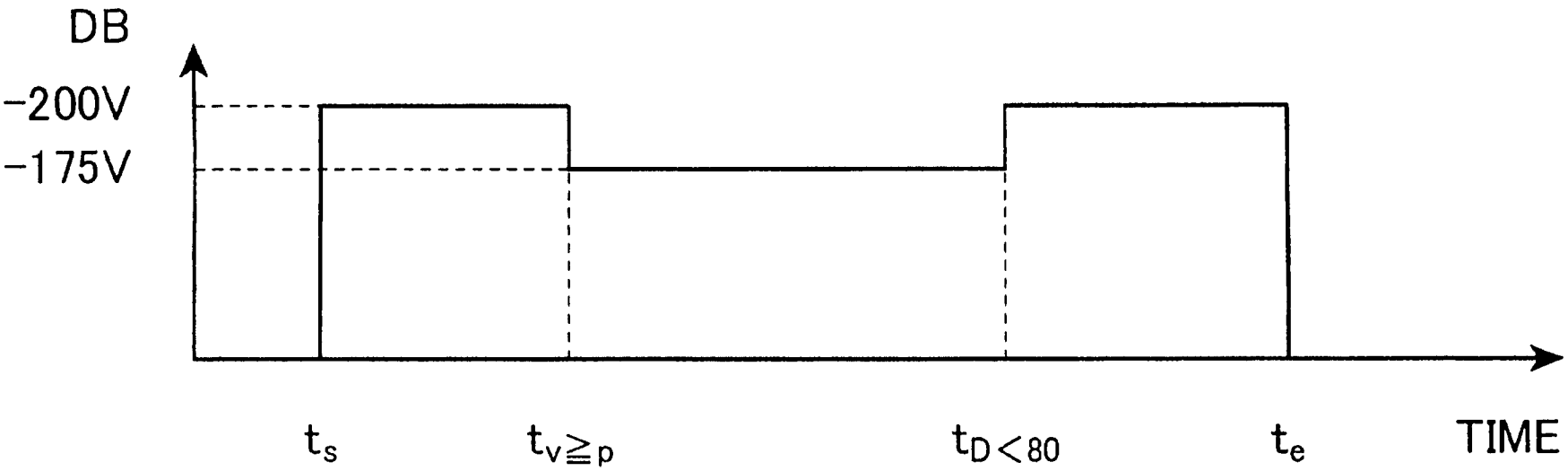
FIG. 30A is a timing diagram illustrating the output change of the development bias voltages according to the eighth embodiment.
Figure 30B:
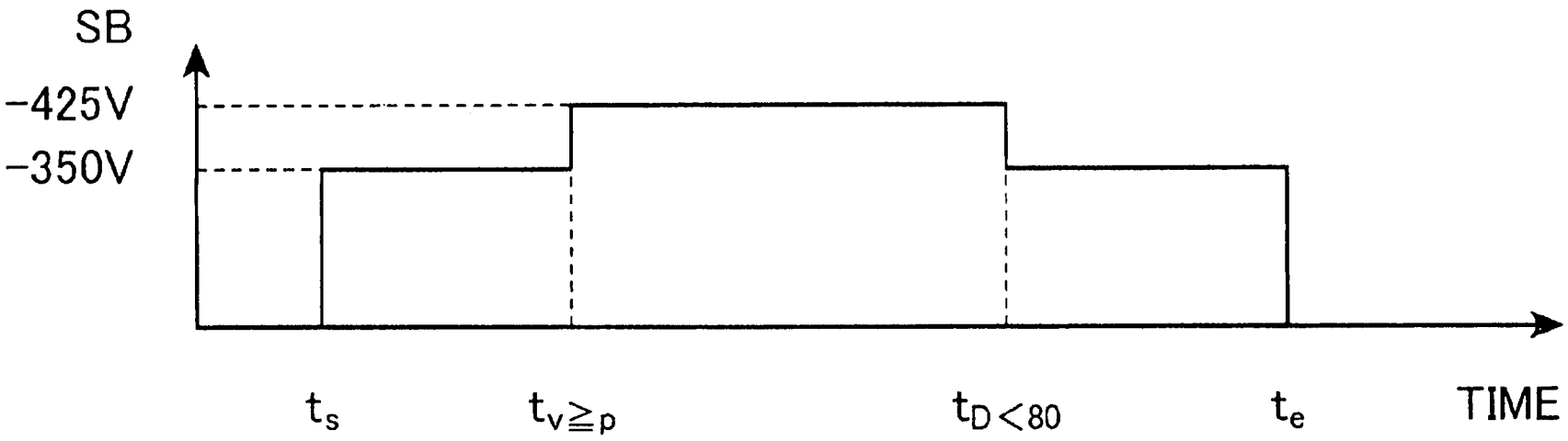
FIG. 30B is a timing diagram illustrating the output change of the sponge bias voltages according to the eighth embodiment.

Referring to FIG. 30A and 30B, the output changes of the development voltage DB and the sponge voltage SB are respectively illustrated in timing diagrams to explain the change of the output amount of the absolute value DS according to the eighth embodiment of the present invention. In other words, the timing diagrams in FIGS. 30A and 30B illustrate the output change of the absolute value DS based on the change of the development voltage DB and the sponge voltage SB. The vertical axes in FIGS. 30A and 30B represent the output of the development voltage DB and sponge voltage SB, respectively. The higher the positions in the vertical axes in FIGS. 30A and 30B, the greater the absolute values of the development voltage DB and the sponge voltage SB, respectively. Each horizontal axis in FIGS. 30A and 30B represents time that includes a timing $t_s$ representing the beginning of the printing and a timing $t_e$ representing the end of the printing. As described above with reference to FIG. 29, where the image density Dx calculated by the dot counter 28 is greater than or equal to eighty (80) percent (condition 1), the following image density $D_{x+1}$ is greater than or equal to eighty (80) percent (condition 2), and the variable v is greater than or equal to the number of lines p (condition 3), the printer controller 27 instructs the power controller 30 in such a manner to change the output amount of the absolute value DS to be 250V at a timing $t_{v \geqq p}$. Moreover, where the image density Dx calculated by the dot counter 28 (condition 1) or the following image density $D_{x+1}$ (condition 2) is smaller than eighty (80) percent, the printer controller 27 instructs the power controller 30 in such a manner to change the output amount of the absolute value DS back to the default value of 150V at a timing $t_{D<80}$ based on the steps S8-8 through step S8-13 in the flowchart of FIG. 28. Upon receiving the instruction, the power controller 30 controls the development power source 11 and developer supply power source 12 so as to change the output amount of the absolute value DS.

Now, the image forming apparatus 24 capable of controlling the printing according to the eighth embodiment of the present invention was used to form a printing image such as an example image 8-1 on the A4-sized sheet (297 mm, margin 10 mm) in a portrait orientation with the density of 100 percent across the entire sheet. Similarly, another printing image such as a comparative example image 888 was formed on the A-4 sized sheet with the density of 100 percent across the entire sheet in the portrait orientation by the image forming apparatus 24 without using the printing control. A leading end and a tailing end of the printing densities of each of the printing images relative to the printing direction were measured by the spectral densitometer X-Rite 528. The measurement results are explained with reference to FIG. 31.

As shown in a section of the eighth embodiment in FIG. 31, the example image 8-1 reduces or eliminates an occurrence of decreasing the printing densities relative to the leading end and tailing end of the A4-sized sheet. On the other hand, the comparative example image 888 had a blur occurrence. Therefore, the example image 8-1 had substantially no blur.

Therefore, the image forming apparatus 24 according to the eighth embodiment of the present invention forms a good image without any blur by changing the voltages to be applied to the development roller 4 and the sponge roller 3 by the printer controller 27 based on the image density calculated by the dot counter 28.

In general, an image forming apparatus such as a printer employing an electrophotographic method tends to increase the absolute value DS so as to increase the image density. According to the eighth embodiment, the absolute value DS with the printing control is greater than that of without the printing control. Therefore, the toner having a negative charge becomes easier to be transferred from the sponge roller 3 to the development roller 4. Consequently, an absolute amount of the toner adhering to the development roller 4 increases, thereby increasing the image density.

Figure 32:
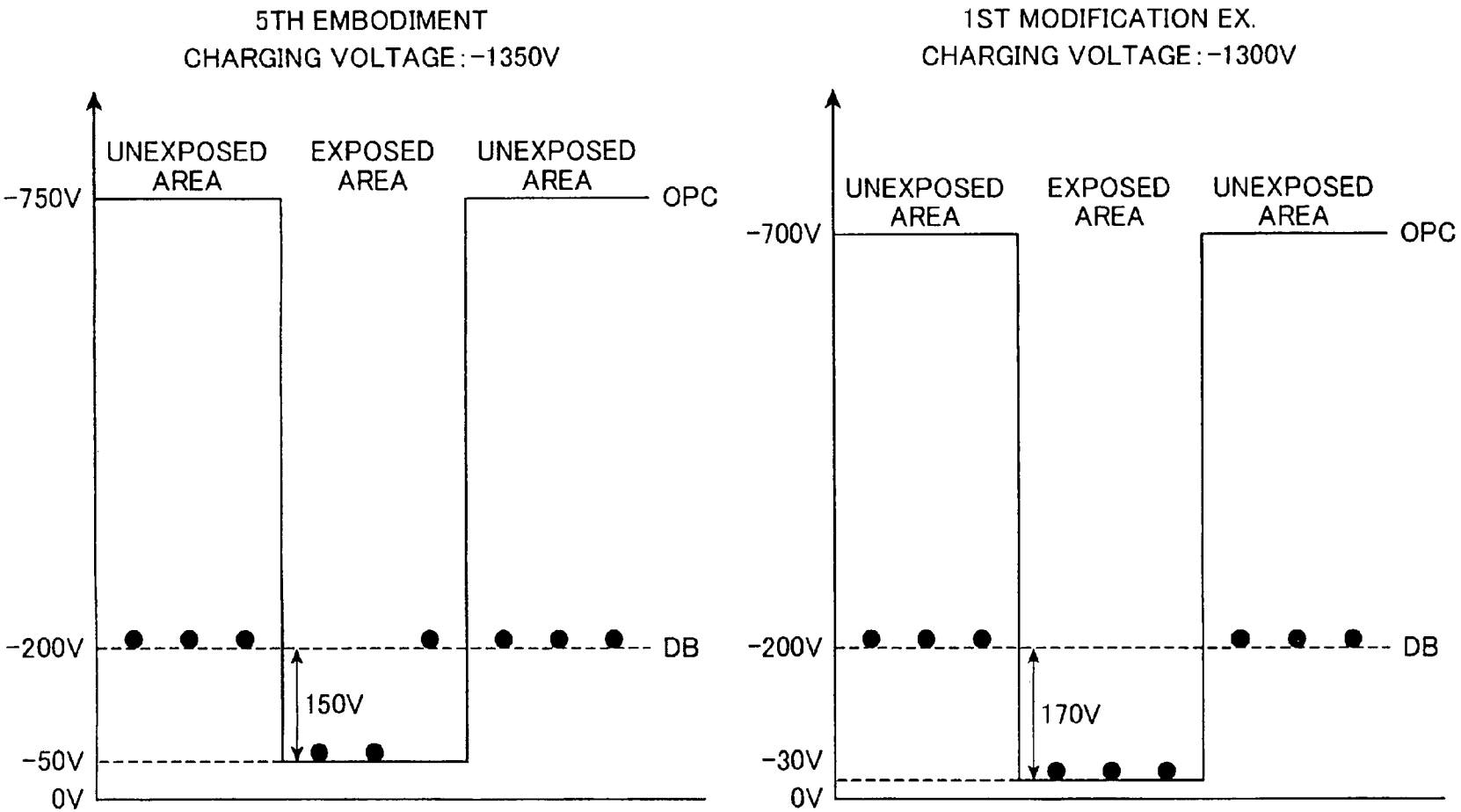
FIG. 32 is a diagram illustrating a first modification example of the fifth embodiment of the present invention.
Figure 33:
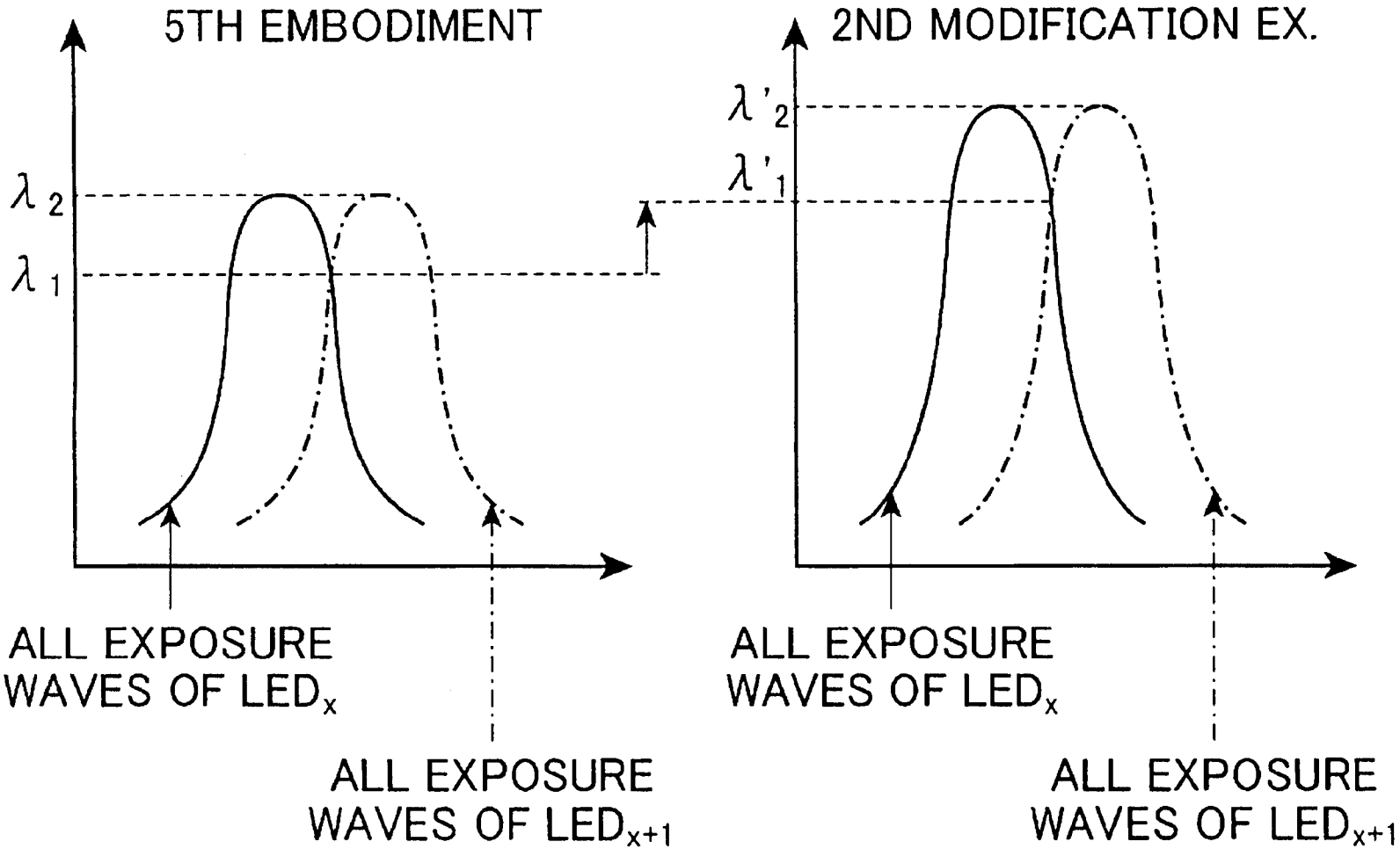
FIG. 33 is a diagram illustrating a second modification example of the fifth embodiment of the present invention.

According to the fifth through eighth embodiments, where the image density Dx is greater than or equal to eighty (80) percent, the following image density $D_{x+1}$ is greater than or equal to eighty (80) percent, and the variable v is greater than or equal to the number of lines p, at least one of the output amounts of the development voltage DB, sponge voltage SB or absolute value DS is changed. However, the embodiments of the present invention are not limited thereto. The voltage to be applied to the developer supply mechanism such as the development roller 4 is changed in the embodiments described above. Alternatively, for example, the voltage to be applied to the charging roller 9 may be changed to −1300V from −1350V as illustrated in a first modification example in FIG. 32, or a wavelength of the light output from the LED head 6 may be extended to decrease the exposure energy as illustrated in a second modification example 2 in FIG. 33, thereby increasing an amount of the toner adhering to the exposed area on the photosensitive drum 7.

The toner is adhered to the exposed area on the surface of the photosensitive drum 7 by the development roller 4. In this regard, the charge potential on the surface of the photosensitive drum 7 needs to be reduced before reaching a surface of the development roller 4 in order that the surface of the photosensitive drum 7 having a reduced charge potential thereon reaches the surface of the development roller 4 at a predetermined timing. A timing of reducing the charge potential on the surface of the photosensitive drum 7 is described with reference to FIGS. 34 and 35.

Figure 34:
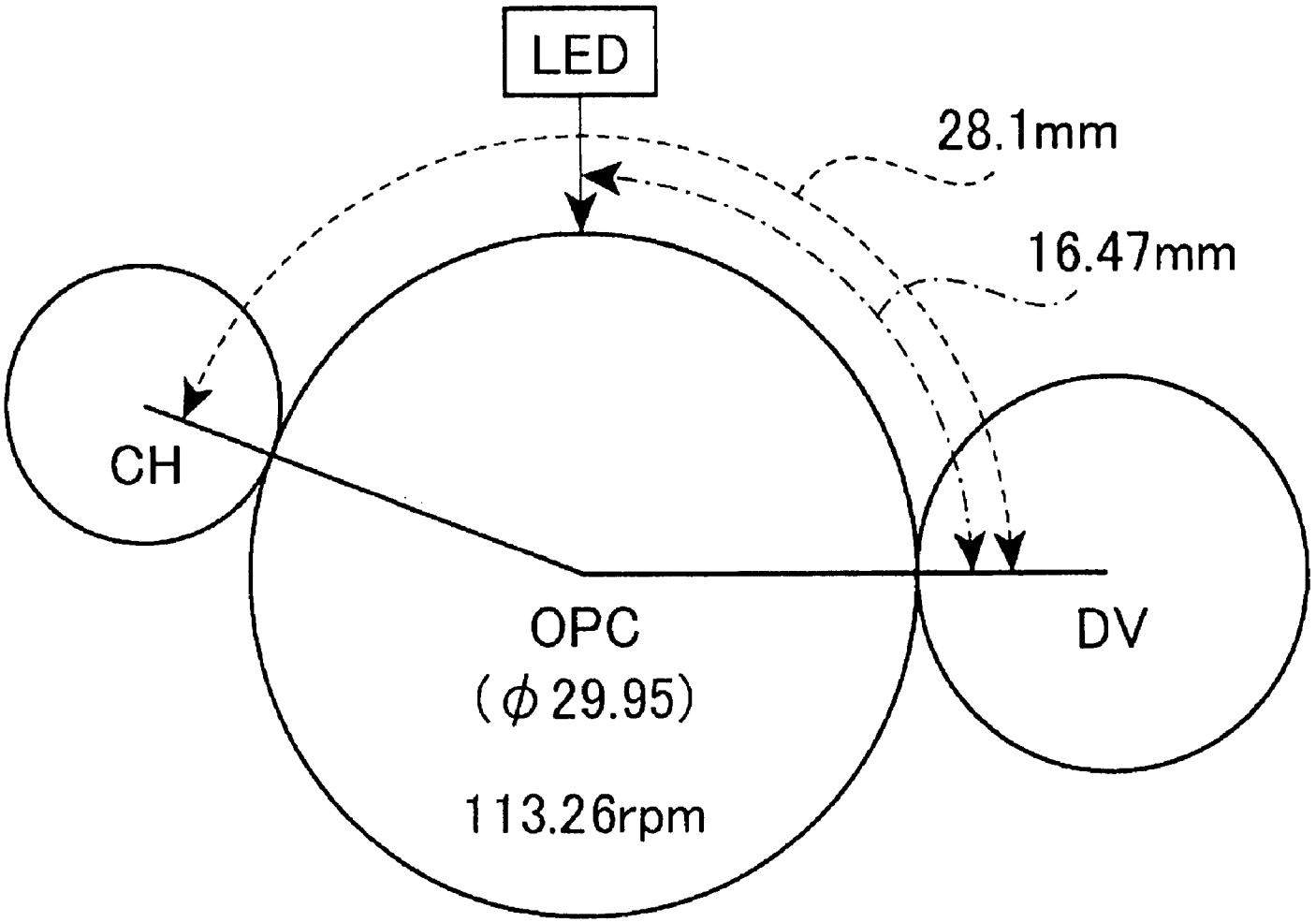
FIG. 34 is a diagram illustrating a relationship among a photosensitive drum, a charging roller and a development roller according to the first modification example of the fifth embodiment of the present invention.

Referring to FIG. 34, a disposition relationship among the photosensitive drum 7 having a diameter of 29.95 mm, the charging roller 9 and the development roller 4 are illustrated. The photosensitive drum 7, the charging roller 9 and the development roller 4 are referred to as OPC, CH and DV respectively in FIG. 34. For example, where the photosensitive drum 7 is rotated at 113.26 rpm (rad/min), and a distance from the charging roller 9 to the development roller 4 is 28.1 mm (represented in a dashed line in FIG. 34), an amount of rotation time required for the surface of the photosensitive drum 7 contacting the surface of the charging roller 9 to contact the surface of development roller 4 can be expressed as follows:

$$\text{Rotation time required}=(28.1\text{ mm})/\{(29.95\text{ mm}/2)\times 113.2\text{ rpm}/60\}=0.994\text{ sec.}$$

Similarly, where a distance from the LED head 6 to the development roller 4 is 16.47 mm (represented in a chain line in FIG. 34), a rotation time required can be expressed as follows:

$$\text{Rotation time required}=(16.47\text{ mm})/\{(29.95\text{ mm}/2)\times 113.2\text{ rpm}/60\}=0.583\text{ sec.}$$

Figure 35:
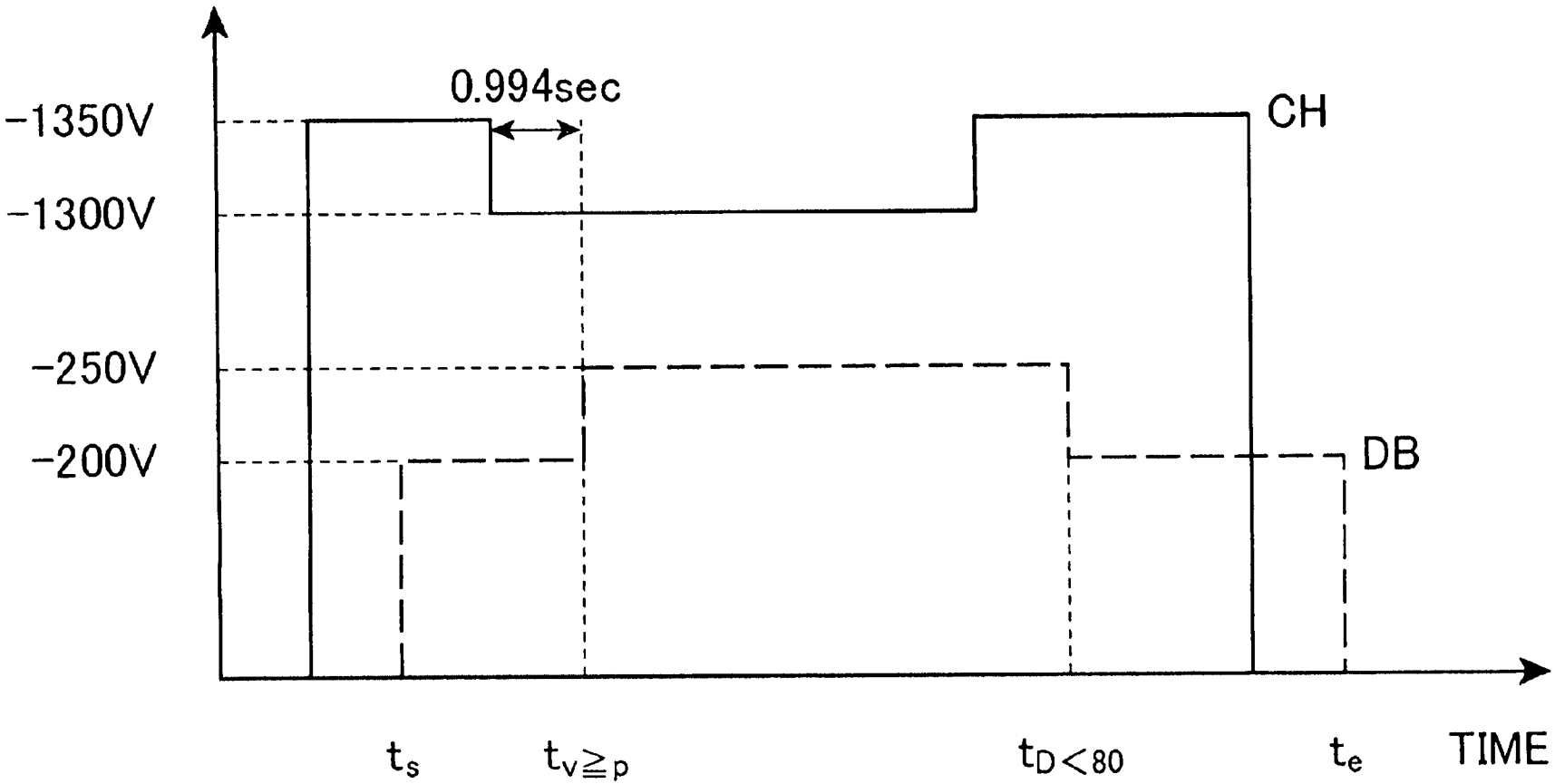
FIG. 35 is a timing diagram illustrating a change of a charge potential on a photosensitve drum surface according to the first modification example of the fifth embodiment of the present invention.

Referring to FIG. 35, a timing of reducing the charge potential on the surface of the photosensitive drum 7 according to the first modification example of the fifth embodiment is illustrated. A dashed line in FIG. 35 represents the change timing of the output amount of the development voltage DB according to the fifth embodiment. However, the output amount of the development voltage DB is not changed according to the first modification example of the fifth embodiment. As illustrated in FIG. 35, a timing of reducing the charge potential on the photosensitive drum 7 is faster than the timing $t_{v\geqq p}$ in an amount of time of 0.994 sec., where the timing $t_{v\geqq p}$ is the change timing of the output amount of the development voltage DB as the predetermined timing according to the fifth embodiment. The voltage to be applied to the charging roller 9 is changed from the default value of −1350V to the post-changing value of −1300V at the timing faster than the timing $t_{v\geqq p}$ in the amount 0.994 sec., thereby, allowing an advantage similar to the fifth embodiment.

The width aa of the image density Dx according to the fifth through eighth embodiments can be expressed by using, for example, a distance of 16.47 mm from the LED head 6 to the development roller 4 on the photosensitive drum 7 and a circumference speed ratio of 1.26 of the development roller 4 relative to the photosensitive drum 7.

$$aa=16.47\times 1.26=20.75\text{ mm},$$

where the width aa may be optionally selected within a range of $20.75\leqq aa<DV$ pitch P. For, example, the DV pitch P is 48.8 mm. However, since the width aa defines a minimum length (i.e., a minimum time period) of the increased value of the development voltage DB, sponge voltage SB or absolute value DS, a value of the width aa may be preferably small within the range. In other words, the embodiments of the present invention do not correspond to a change of an image density of which a width is smaller than the width aa. The above value is an example and may be changed depending on the size of the photosensitive drum 7, the size of the development roller 4 or the circumference speed ratio.

According to the first through eighth embodiments, the printer controller 27 includes the determination mechanism determining whether or not the voltage to be applied to the developer supply mechanism is changed based on the value calculated by the image density calculation mechanism. However, the determination mechanism can be independent from the printer controller 27.

According to the first through eighth embodiments, the calculation of the image density and the determination of changing the voltage to be applied to the developer supply mechanism are executed during the development process. However, the calculation of the image density and the determination of changing the voltage are not limited to be executed during the development process. The electrostatic latent image can be developed after completion of a series of processes including the calculation of the image density and the determination of changing the voltage to be applied to the developer supply mechanism.

The first through eighth embodiments and the first and second modification examples described above apply to the printer as an example. However, the embodiments and the modifications of the present invention are not limited to the printer and can be applied to an apparatus, a device and the like employing the electrophotographic method such as facsimile and a copier.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus comprising:

a data conversion mechanism converting received image data into printing data;

a charging mechanism charging an image carrier;

an exposure mechanism forming an electrostatic latent image on the image carrier charged by the charging mechanism based on the printing data;

a developer supply mechanism supplying a developer to the image carrier having the electrostatic latent image with electrostatic force;

an image density calculation mechanism calculating an image density of an image having a predetermined number of lines in the printing data;

a determination mechanism determining whether a voltage to be applied to the developer supply mechanism is changed based on a calculation result calculated by the image density calculation mechanism; and a voltage change mechanism changing the voltage to be applied to the developer supply mechanism based on a determination result determined by the determination mechanism, wherein the image density calculation mechanism calculates the image density of a region of the image, the region of the image being shifted in a sub-scanning direction by a prescribed line number while maintaining the predetermined number of lines.

2. The image forming apparatus according to claim 1, wherein the voltage to be applied to the developer supply mechanism includes a development bias voltage and a sponge bias voltage.

3. The image forming apparatus according to claim 1, wherein the developer supply mechanism comprises: a developer carrier supplying the developer to the image carrier; and a developer supplier supplying the developer to the developer carrier, and wherein the voltage change mechanism changes the development bias voltage to be applied to the developer carrier based on the determination result determined by the determination mechanism.

4. The image forming apparatus according to claim 3, wherein the voltage change mechanism changes the development bias voltage to be applied to the developer carrier in a case where the image density calculated by the image density calculation mechanism exceeds a predetermined amount and a width of the image of the image density exceeds an amount of a development cycle of the developer carrier.

5. The image forming apparatus according to claim 1, wherein the developer supply mechanism comprises: a developer carrier supplying the developer to the image carrier; and a developer supplier supplying the developer to the developer carrier, and wherein the voltage change mechanism changes the sponge bias voltage to be applied to the developer supplier based on the determination result determined by the determination mechanism.

6. The image forming apparatus according to claim 5, wherein the voltage change mechanism changes the sponge bias voltage to be applied to the developer supplier in a case where the image density calculated by the image density calculation mechanism exceeds a predetermined amount and a width of the image of the image density exceeds an amount of a development cycle of the developer carrier.

7. The image forming apparatus according to claim 1, wherein the developer supply mechanism comprises: a developer carrier supplying the developer to the image carrier; and a developer supplier supplying the developer to the developer carrier, and wherein the voltage change mechanism changes the development bias voltage to be applied to the developer carrier and the sponge bias voltage to be applied to the developer supplier, respectively.

8. The image forming apparatus according to claim 7, wherein the voltage change mechanism increases a voltage difference between the development bias voltage to be applied to the developer carrier and the sponge bias voltage to be applied to the developer supplier.

9. The image forming apparatus according to claim 7, wherein the voltage change mechanism changes the development bias voltage to be applied to the developer carrier and the sponge bias voltage to be applied to the developer supplier respectively in a case where the image density calculated by the image density calculation mechanism exceeds a predetermined amount and a width of the image of the image density exceeds an amount of a development cycle of the developer carrier.

10. The image forming apparatus according to claim 9, wherein the voltage change mechanism increases a voltage difference between the development bias voltage to be applied to the developer carrier and the sponge bias voltage to be applied to the developer supplier in a case where the image density calculated by the image density calculation mechanism exceeds a predetermined amount and a width of the image of the image density exceeds an amount of a development cycle of the developer carrier.

11. The image forming apparatus according to claim 1, wherein the image density calculation mechanism calculates during a development process the image density of the image having the predetermined number of lines in the printing data.

12. The image forming apparatus according to claim 1, wherein the determination mechanism determines whether the voltage to be applied to the developer supply mechanism is changed during a development process based on the calculation result calculated by the image density calculation mechanism.

* * * * *